United States Patent [19]

Nakamura et al.

[11] Patent Number: 4,770,990

[45] Date of Patent: Sep. 13, 1988

[54] SILVER HALIDE PHOTOGRAPHIC LIGHT-SENSITIVE MATERIAL CONTAINING A COMPOUND CAPABLE OF IMAGEWISE RELEASING A PHOTOGRAPHICALLY USEFUL GROUP DURING DEVELOPMENT

[75] Inventors: Koki Nakamura; Shigeo Hirano; Osamu Takahashi, all of Kanagawa, Japan

[73] Assignee: Fuji Photo Film Co., Ltd., Kangawa, Japan

[21] Appl. No.: 852,044

[22] Filed: Apr. 14, 1986

[30] Foreign Application Priority Data

Apr. 12, 1985 [JP] Japan ..... 60-77799

[51] Int. Cl.[4] ..... G03C 1/02; G03C 5/54

[52] U.S. Cl. ..... 430/564; 430/223; 430/955; 430/956; 430/957; 430/958; 430/959; 430/960

[58] Field of Search ..... 430/223, 955, 956, 957, 430/958, 959, 960, 564

[56] References Cited

U.S. PATENT DOCUMENTS

| | | | |
|---|---|---|---|
| 3,725,062 | 4/1973 | Anderson et al. | 430/242 |
| 4,248,962 | 2/1981 | Lau | 430/958 X |
| 4,409,323 | 10/1983 | Sato et al. | 430/958 X |
| 4,434,225 | 2/1984 | Sugita et al. | 430/552 X |
| 4,500,633 | 2/1985 | Menjo et al. | 430/957 X |
| 4,564,587 | 1/1986 | Watanabe et al. | 430/957 X |
| 4,628,024 | 12/1986 | Kobayashi et al. | 430/955 X |

FOREIGN PATENT DOCUMENTS 0167168 1/1986 European Pat. Off. ..... 430/957

*Primary Examiner*—Mukund J. Shah

*Attorney, Agent, or Firm*—Sughrue, Mion, Zinn, Macpeak, and Seas

[57] ABSTRACT

A silver halide photographic material is disclosed. The material comprises a support and at least one silver halide emulsion layer formed thereon, in which said emulsion layer or other layer contains a compound represented by formula (I)

(I)

wherein X represents an atomic group capable of releasing (Time)$_t$PUG by undergoing an oxidation-reduction reaction with $CA{=}(CR_1{-}CR_2)_n{=}C_B$; $C_A$ and $C_B$ each represents a carbon atom; n represents an integer of 0, 1, 2, or 3; $R_1$ and $R_2$ each a hydrogen atom or a group substitutable for a hydrogen atom; EWG represents an electron withdrawing group having a Hammett's $\sigma$ para value greater than 0.3; $-(Time)_t$PUG represents a group bonded to $C_B$ through an oxygen atom thereof; Time represents a timing group; t represents 0 or 1; and PUG represents a photographically useful group.

12 Claims, No Drawings

SILVER HALIDE PHOTOGRAPHIC LIGHT-SENSITIVE MATERIAL CONTAINING A COMPOUND CAPABLE OF IMAGEWISE RELEASING A PHOTOGRAPHICALLY USEFUL GROUP DURING DEVELOPMENT

FIELD OF THE INVENTION

This invention relates to a silver halide photographic material, and more particularly to a silver halide photographic material containing a compound capable of imagewise releasing a photographically useful group in a development processing step.

BACKGROUND OF THE INVENTION

Hitherto, as a compound releasing a photographically useful group corresponding to the density of images upon development, there have been known (1) hydroquinone derivatives releasing a development inhibitor corresponding to the density of images at development (so-called DIR hydroquinone), (2) hydroquinone derivatives releasing a silver halide solvent corresponding to the density of images, and (3) hydroquinone derivatives or sulfonamide phenol derivatives releasing a diffusible dye corresponding to the amount of developed silver.

Examples of the DIR hydroquinone are described in U.S. Pat. Nos. 3,379,529, 3,620,746, 4,377,634, Japanese Patent Application (OPI) Nos. 129536/74, 153336/81, 153342/81, etc. (the term "OPI" as used herein refers to a "published unexamined Japanese patent application"). Examples of the hydroquinone derivative releasing a silver halide solvent are described in U.S. Pat. No. 4,459,351, etc. Also, examples of the hydroquinone derivative releasing a diffusible dye are described in U.S. Pat. Nos. 3,698,897, 3,725,062, etc., and examples of the sulfonamide phenol derivative releasing a diffusible dye are described in *Yuuki Goosei Kagaku Kyokai Shi* (*Journal of the Society of Organic Synthesis Chemistry*), Vol. 39, p. 331 (1981), *Kagaku no Ryoiki* (*Domain of Chemistry*), Vol. 39, p. 617 (1981), *Kinoo Zairyo* (*Functional Materials*), Vol. 3, p. 66 (1983), *Photographic Science and Engineering*, Vol. 20, p. 155 (1976), *Angew. der Chemie, International Edition in English*, Vol. 22, p. 191 (1983), *Yuuki Goosei Kagaku Kyokai Shi* (*Journal of the Society of Organic Synthesis Chemistry*), Vol. 40, p. 176 (1982), *Nikka Kyo Geppo (Monthly Bulletin of the Chemical Society of Japan)*, Vol. 35 (11), p. 29 (1982), etc.

The known compounds described in the above patents, etc., have been widely used according to the photographic effects of the photographically useful groups released from the compounds, but the functions required for the oxidation reduction mother nucleus which is a minimum unit performing the oxidation reduction reaction for releasing photographically useful groups have many common points. This is because, recently, it has become more important as a point required that high-quality photographs be obtained quickly, simply, and stably, and the above-described compounds are used as elements for fulfilling such a purpose or assisting the attainment of the purpose. That is, the common performance required for the oxidation-reduction mother nuclei of the above-described compounds is the point that the photographically useful group can be released quickly in a short period of time with good timing and good efficiency.

Then, the performance required to these the oxidation reduction mother nuclei is described below in more detail. Firstly, in order that these oxidation-reduction nuclei show a sufficient activity during the development process, it is required that the speed of causing a cross-oxidation reaction with the oxidation product of a developing agent or an auxiliary developing agent formed during development or the speed of becoming an oxidation product thereof directly or by reducing a silver halide or other silver salts is sufficiently high. Secondly, it is required that the photographically useful group is released from the oxidation product of the oxidation-reduction nucleus thus formed at high speed and the release of the group occurs efficiently. Also, thirdly, it is required that these oxidation-reduction mother nuclei be sufficiently stable during storage, and do not give photographically undesirable influences by being decomposed by oxygen in air or by other materials.

Regarding the first point noted above, it is generally considered to be possible to increase the oxidation speed of the oxidation-reduction mother nucleus by reducing the oxidation potential of the oxidation-reduction mother nucleus. However, the reduction of the oxidation potential is generally accompanied by the increase of the speed of being oxidized by oxygen in air as described in *Journal of American Chemical Society*, Vol. 60, p. 2084 (1938), and hence gives an undesirable result considering the third point noted above. Accordingly, it is difficult to obtain both the high reactivity during processing and stability during storage by reducing the oxidation potential for realizing the high reactivity during processing.

On the other hand, from the viewpoint of preventing the occurrence of oxidation by oxidation in air, the protection of oxidation-reduction mother nuclei is frequently performed. Such protection can be relatively effectively used with the pH of a developer is high, when the specific accelerating effect by the processing composition as described in Japanese Patent Application (OPI) Nos. 19703/84, 201057/84, etc., can be ideally utilized, or when the processing period is very long. However, in general, if the oxidation-reduction mother nuclei are protected, additional one stage or more reaction numbers are required for the realization of the function of the oxidation-reduction nuceli. Accordingly, it requires a long period of time to realize the function of the oxidation-reduction nuclei since the initiation of a development proces, whereby it becomes difficult to obtain a sufficient function thereof in a short period of processing. Thus, there are many difficulties for obtaining both the quick processing and the sufficient realization of the function thereof although a further increase of the processing speed has now been desired.

Regarding the second viewpoint, that is, the speed and the efficiency for releasing a photographically useful group from the oxidation product of an oxidation-reduction nucleus, the compounds described in the above-described patents, etc., are insufficient, and hence if the speed and the efficiency can be increased, it can greatly accelerate the realization of the function thereof.

SUMMARY OF THE INVENTION

The object of this invention is to provide a silver halide photographic light-sensitive material containing a photographic reagent releasing quickly and efficiently a photographically useful group after being oxidized in a development processing step.

As a result of various investigations on the compounds releasing a photographically useful group in proportion to the density of images at development, the inventors have discovered that only when the compound has an electron attractive group at the 2-position or the vinyloguous position thereof to the photographically useful group which is released from the oxidation product of the compound, the realization of the functon can be remarkably accelerated. That is, in general, in the step that a photographically useful group is released from the oxidation reduction mother nucleus, the bond bonding the oxidation product and the photographically useful group is cleaved. It has now been found that for causing the cutting of the photographically useful group, the addition of a nucleophilic material existing at development, such as a hydroxide ion to the carbon atom to which the photographically useful group is bonded and, in succession thereto, cutting of the bond between carbon atoms bonding the photographically useful group and the nucleophilic material occur but each step is insufficient in speed and efficiency.

As a result of extensive investigations, the inventors have discovered that when a compound capable of releasing a photographically useful group has an electron withdrawing group at the 2-position or the vinyloguous position thereof to the photographically useful group in the oxidation product of the oxidation-reduction nuclei and the bond between the oxidation-reduction mother nucleus and the photographically useful group is a carbon-oxygen bond, the cutting of the carbon-oxygen bond between the oxidation-reduction mother nucleus and the photographically useful group occurs at unexpectedly high speed and efficiency to release the photographically useful group. Furthermore, it has surprisingly been found that the oxidation-reduction mother nucleus having an electron withdrawing group at the 2-position or the vinyloguous position thereof to the photographically useful group which is released as described above is sufficiently stable during storage and for practical purpose with or without being protected.

The present invention has been achieved based on the aforesaid discovery and is a silver halide photographic light-sensitive material comprising a support having thereon at least a silver halide emulsion layer, wherein the silver halide emulsion layer or other hydrophilic colloid layer contains a compound capable of imagewise releasing a photographically useful group after being oxidized, which is represented by formula (I)

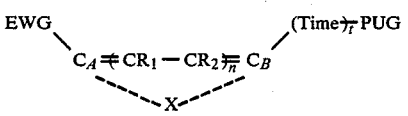

(I)

wherein X represents an atomic group capable of releasing (Time)$_t$PUG by undergoing an oxidation-reduction reaction during photographic development processing together with CA=CR$_1$—CR$_2$)$_n$C$_B$; $C_A$ and $C_B$ each represents a carbon atom; n represents an integer of 0, 1, 2, or 3; $R_1$ and $R_2$ each represents a hydrogen atom or a substituent; EWG represents an electron withdrawing group having a Hammett's $\sigma$ para value of over 0.3; (Time)$_t$PUG represents a group bonded to $C_B$ through an oxygen atom thereof (i.e., an oxygen atom of the (Time)$_t$PUG group); Time represents a timing group; t represents 0 or 1; and PUG represents a photographically useful group.

DESCRIPTION OF PREFERRED EMBODIMENTS

Now, specific examples of X according to the above-described formula (I), including showing the bonding to the $C_A$=CR$_1$—CR$_2$)$_n$C$_B$ group, are illustrated below.

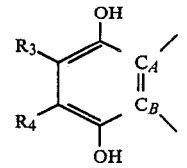

(a)

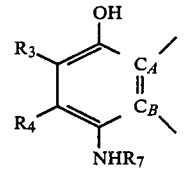

(b)

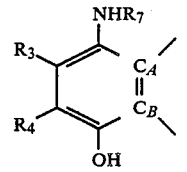

(c)

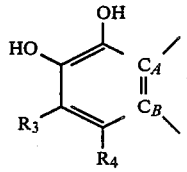

(d)

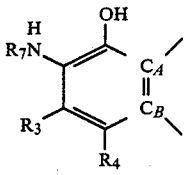

(e)

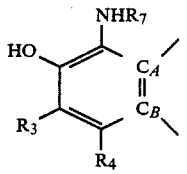

(f)

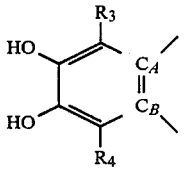

(g)

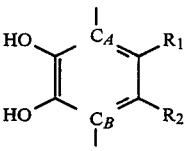

(h)

-continued (i)

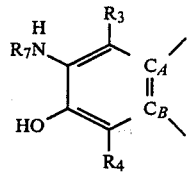

(j)

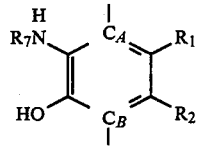

(k)

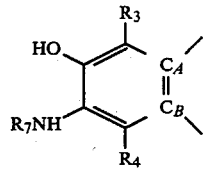

(l)

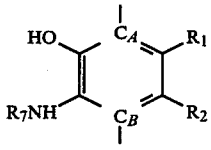

(m)

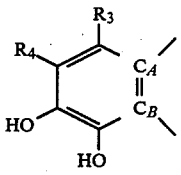

(n)

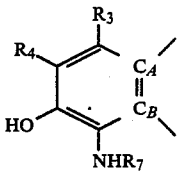

(o)

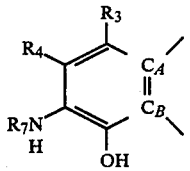

(p)

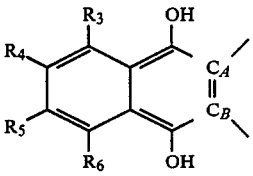

(q)

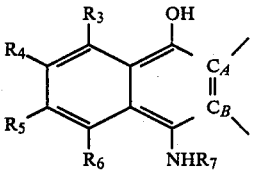

-continued (r)

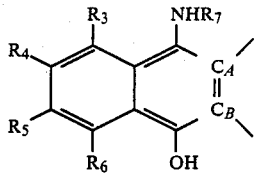

(s)

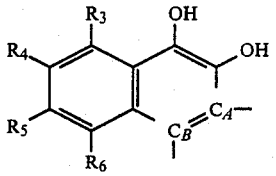

(t)

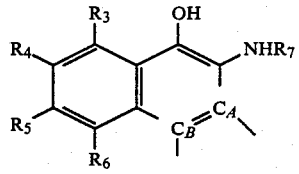

(u)

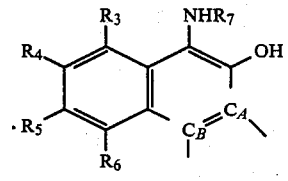

(v)

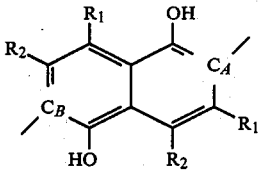

(w)

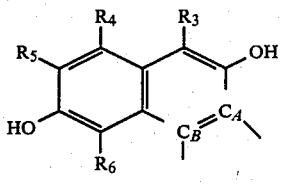

(x)

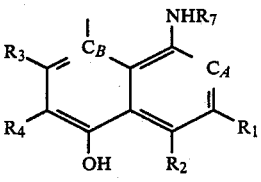

In the above-described formulae, the formulae (a), (b), (c), (d), (e), (f), (h), (j), (k), (m), (n), (o), (p), (q), (r), (s), (t), (u), and (w) are preferred and further formulae (a), (b), (c), (d), (e), (f), (p), (q), (r), (s), (t), and (u) are more preferred, and formulae (a), (d), and (s) are most preferred.

In the above formulae, $R_1$, RHD 2, $R_3$, $R_4$, $R_5$, and $R_6$ each represents a hydrogen atom, a substituted or unsubstituted alkyl group having from 1 to 30 carbon atoms (e.g., a methyl group, an ethyl group, an isopropyl group, a 2-decyl group, a t-octyl group, an octadecyl group, a benzyl group, a vinyl group, a 3-ethoxycarbonylpropyl group, etc.), a substituted or unsubstituted aryl group having from 6 to 30 carbon atoms (e.g., a phenyl group, a 3-chlorophenyl group, a 4-cyanophenyl group, a naphthyl group, etc.), a substituted or unsubstituted alkylthio group having from 1 to 30 carbon atoms (e.g., a methylthio group, an ethylthio group, a n-octylthio group, a 2-octylthio group, a dodecylthio group, a 1-ethoxycarbonyl-1-decylthio group, a 2-cyanoethylthio group, etc.), a substituted or unsubstituted arylthio group having from 6 to 30 carbon atoms (e.g., a phenylthio group, a 4-chlorophenylthio group, a 2-n-octyloxy-5-t-octylphenylthio group, a 4-t-butylphenylthio group, a 1-naphthylthio group, etc.), a substituted or unsubstituted alkoxy group having from 1 to 30 carbon atoms (e.g., a methoxy group, an ethoxy group, an allyloxy group, a 2-propyloxy group, etc.), a substituted or unsubstituted aryloxy group having from 6 to 30 carbon atoms (e.g., a phenoxy group, a 4-chlorophenoxy group, a 4-acetylaminophenoxy group, a 2-acetylamino-4-butanesulfonylphenoxy group, a 3-cyanophenoxy group, a 3-dodecyloxyphenoxy group, a 3-pentadecylphenoxy group, etc.), a substituted or unsubstituted amino group having from 1 to 30 carbon atoms (e.g., a dimethylamino group, a diethylamino group, a n-hexylamino group, a cyclohexylamino group, a bis(2-cyanoethyl)amino group, etc.), a substituted or unsubstituted amido group having from 1 to 30 carbon atoms (e.g., an acetylamino group, a chloroacetylamino group, a trifluoroacetylamino group, a dodecenylsuccinimido group, a 2-hexedecenyl-3-carboxypropionylamino group, a pivaloylamino group, a 2-(2,4-di-t-pentylphenoxy)butyroylamino group, etc.), a substituted or unsubstituted sulfonamido group having from 1 to 30 carbon atoms (e.g., a benzenesulfonylamino group, a 4-chlorphenylsulfonylamino group, an N-methyl-4-methoxyphenylsulfonylamino group, a methanesulfonylamino group, a n-octanesulfonylamino group, a 4-methylphenylsulfonylamido group, etc.), a substituted or unsubstituted alkoxycarbonylamino group having from 1 to 30 carbons atoms (e.g., an ethoxycarbonylamino group, an ethoxycarbonyl-N-methylamino group, an N-ethylphenoxycarbonylamino group, an isobutyloxycarbonylamino group, a benzyloxycarbonylamino group, etc.), a substituted or unsubstituted ureido group having from 1 to 30 carbon atoms (e.g., a 3,3-diethylureido group, a 3-cyclohexylureido group, a morpholinocarbonylamino group, a 3-(4-cyanophenyl)ureido group, a 3-n-octyl-1-methylureido group, a 1,3-diphenylureido group, etc.), a substituted or unsubstituted carbamoyl group having from 1 to 30 carbon atoms (e.g., a methylcarbamoyl group, an ethylcarbamoyl group, a butylcarbamoyl group, a 4-methoxyphenylcarbamoyl group, a 3-(2,4-di-t-pentylphenoxy)propylcarbamoyl group, a pyrrolidinocarbonyl group, a hexadecylcarbamoyl group, a di-n-octylcarbamoyl group, etc.), a substituted or unsubstituted alkoxycarbonyl group having from 1 to 30 carbon atoms (e.g., a methoxycarbonyl group, an ethoxycarbonyl group, a phenoxycarbonyl group, a hexadecyloxycarbonyl group, etc.), a substituted or unsubstituted sulfamoyl group having from 1 to 30 carbon atoms (e.g., a methylfulfamoyl group, a diethylsulfamoyl group, a 3-(2,4-di-t-pentylphenoxy)propylsulfamoyl group, an N-methyl-N-octadecylsulfamoyl group, a bis(2-methoxyethyl)sulfamoyl group, a 3-chlorophenylsulfamoyl group, a morpholinosulfonyl group, etc.), a substituted or unsubstituted sulfonyl group having from 1 to 30 carbon atoms (e.g., a methanesulfonyl group, a propylsulfonyl group, a dodecylsulfonyl group, a 4-methylphenylsulfonyl group, a 2-ethoxy-5-t-butylphenylsulfonyl group, a 2-carboxyphenylsulfonyl group, etc.), a cyano group, a halogen atom (e.g., a fluorine atom, a chlorine atom, a bromine atom, an iodine atom, etc.), a substituted or unsubstituted acyl group having from 1 to 30 carbon atoms (e.g., an acetyl group, a trichloroacetyl group, a 2-phenoxypropionyl group, a benzoyl group, a 3-acetylaminobenzoyl group, etc.), a carboxy group, a sulfo group, a nitro group, a heterocyclic ring residue having at most 30 carbon atoms (e.g., a 1-tetrazolyl group, a 1,2,4-triazol-1-yl group, a 5-nitroindazol-1-yl group, a 5-methylbenzotriazol-1yl group, a benzoxazol-2-yl group, etc.), a sulfur residue bonded to a heterocyclic ring having at most 30 carbon atoms (e.g., a 1-phenyltetrazol-5-ylthio group, a benzothiozol-2-ylthio group, a 6-methyl-1,3,3a,7-tetraazaindene-4-ylthio group, etc)., etc., or they may be the photographically useful groups (PUG) or (Time)$_{\overline{n}}$PUG.

Furthermore, said $R_1$ and $R_2$, $R_3$ and $R_4$, $R_4$ and $R_5$, and $R_5$ and $R_6$ may combine with each other to form a saturated or unsaturated carbocyclic ring or a saturated or unsaturated heterocyclic ring, such as, preferably, one of the following.

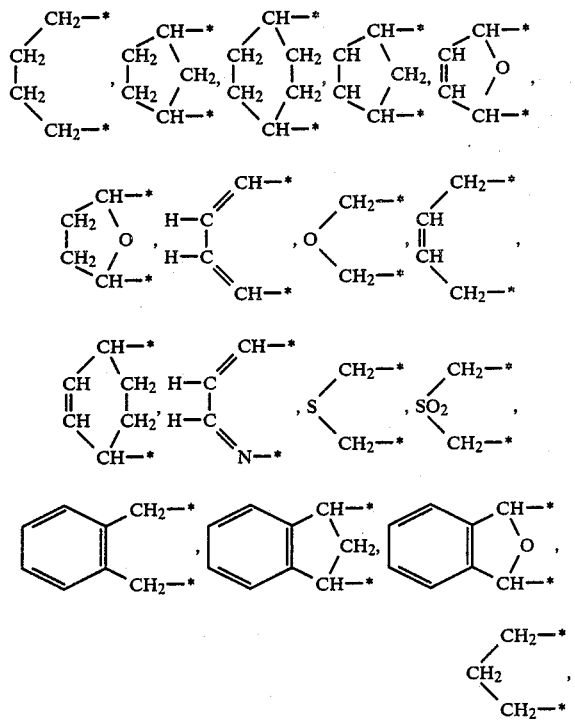

(wherein, *represents a portion bonding as $R_1$, $R_2$, $R_3$, $R_4$, $R_5$, or $R_6$).

$R_7$ in the above-described formulae represents a substituted or unsubstituted sulfonyl group having from 1 to 30 carbon atoms (e.g., a 4-methylphenylsulfonyl group, a methanesulfonyl group, a n-octylsulfonyl group, a 2-chloro-5-acetylaminophenylsulfonyl group, a 2-(2-methoxyethyl)-5-nitrophenylsulfonyl group, a 4-chlorophenylsulfonyl group, etc.), or a substituted or unsubstituted acyl group having from 1 to 30 carbon atoms (e.g., an acetyl group, a benzoyl group, a 2-ethoxycarbonylbenzoyl group, a 4-nitrobenzoyl group, a chloroacetyl group, a 3,4-dimethyoxybenzoyl group, etc.), and is preferably a sulfonyl group.

EWG in the aforesaid formula (I) represents an electron withdrawing substituent bonded to $C_A$ having a Hammett's $\sigma$ para value greater than 0.3. Specific examples of EWG are a cyano group, a nitro group, a substituted or unsubstituted carbamoyl group having from 1 to 30 carbon atoms (e.g., a methylcarbamoyl group, an ethylcarbamoyl group, a 4-methoxyphenylcarbamoyl group, an N-methyl-N-octadecylcarbamoyl group, a 3-(2,4-di-t-pentylphenoxy)propylcarbamoyl group, a pyrrolidinocarbonyl group, a hexadecylcarbamoyl group, a di-n-octylcarbamoyl group, etc.), a substituted or unsubstituted sulfamoyl group having from 1 to 30 carbon atoms (e.g., a methylsulfamoyl group, a diethylsulfamoyl group, a 3-(2,4-di-t-pentylphenoxy)propylcarbamoyl group, a phenylsulfamoyl group, a pyrrolidinosulfonyl group, a morpholinosulfonyl group, etc.), a substituted or unsubstituted alkoxycarbonyl group having from 1 to 30 carbon atoms (e.g., a methoxycarbonyl group, an ethoxycarbonyl group, a phenoxycarbonyl group, a 2-methoxyethoxycarbonyl group, a hexadecyloxycarbonyl group, etc.), a substituted or unsubstituted sulfonyl group having from 1 to 30 carbon atoms (e.g., a methanesulfonyl group, a 4-methylphenylsulfonyl group, a dodecylsulfonyl group, etc.), a substituted or unsubstituted acyl group having from 1 to 30 carbon atoms (e.g., an acetyl group, a hexanoyl group, a benzoyl group, a 4-chlorobenzoyl group, etc.), a trifluoromethyl group, a carboxy group, a substituted or unsubstituted heterocyclic residue having at most 30 carbon atoms (e.g., a benzoxazol-2-yl group, a 5,5-dimethyl-2-oxazol-2-yl group, etc.), etc., but is particularly preferably a carbamoyl group, an alkoxycarbonyl group, or a sulfamoyl group.

The amino group or the hydroxy group shown by X in above-described formula (I) may be protected by a protective group which can be released during the development step, and X as defined herein is understood to include such protected embodiments. Examples of the protective group are an acyl group (e.g., an acetyl group, a chloroacetyl group, a cycloacetyl group, a benzyl group, a 4-cyanobenzoyl group, a 4-oxopentanoyl group, etc.), an alkoxycarbonyl group (e.g., an ethoxycarbonyl group, a phenoxycarbonyl group, a 4-methoxybenzyloxycarbonyl group, etc.), an aminocarbonyl group (e.g., a methylcarbonyl group, a 4-nitrophenylaminocarbonyl group, a 2-pyridylaminocarbonyl group, a 1-imidazolylcarbonyl group, etc.), and further the protective groups described in Japanese Patent Application (OPI) Nos. 197037/84 and 201057/84.

Moreover, the protective group may, if possible, combine with $R_1$, $R_2$, $R_3$, $R_4$, $R_5$, $R_6$, or $R_7$ to form a 5- to 7-membered ring such as the following.

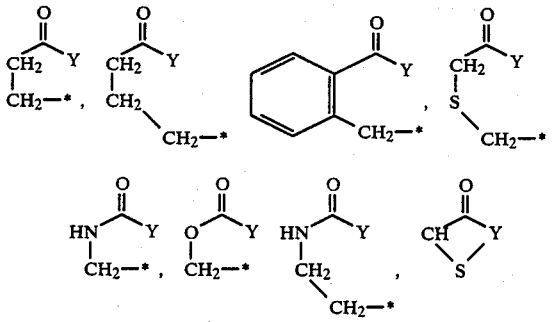

-continued

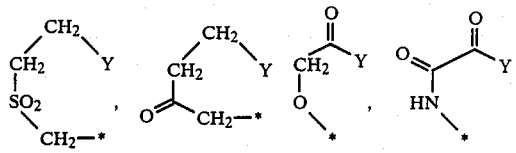

In the foregoing, Y is bonded to a phenolic oxygen atom or a nitrogen atom of an amino group bonded to an aromatic ring. * represents a portion bonded as $R_1$, $R_2$, $R_3$, $R_4$, $R_5$, $R_6$, or $R_7$.

Below, $\text{-(Time)}_t\text{PUG}$ in formula (I) is explained in detail.

$\text{-(Time)}_t\text{PUG}$ is bonded to $C_B$ of the oxidation reduction mother nucleus shown by

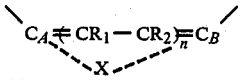

in formula (I) through an oxygen atom thereof, and is first released as $\text{(Time)}_t\text{PUG}$ when the oxidation-reduction mother nucleus becomes the oxidation product thereof.

Time is a timing group bonded to $C_B$ through an oxygen atom and t represents 0 or 1. In the case that t=0, PUG is directly bonded to $C_B$ through an oxygen atom. When t is 1, the timing group means a group releasing PUG through one stage reaction or more from Time-PUG released from the oxidation product of the oxidation reduction mother nucleus, but $\text{(Time)}_t\text{PUG}$ itself may form a photographically useful group.

The bonding relation of PUG and Time is explained in more detail below.

When the atom of PUG bonding to $\text{—Time)}_t$ is an oxygen atom, t may be 0 or 1 and when t=1, the timing group is represented by one or more of formulae (T-1) to (T-10) described below.

When t is 1 in general formula (I) described above, the timing group is preferably one or more of the following groups, in which (*) represents the position bonding to $C_B$ and (*)(*) represents the position to which PUG is bonding.

First is formula (T-1)

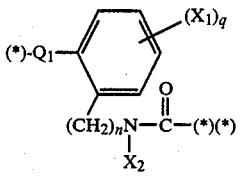

(T-1)

wherein $Q_1$ represents (*)—O—,

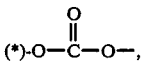

(*)—O—$CH_2$—O—, (*)—O—$CH_2$—, (*)—O—$CH_2$—S—,

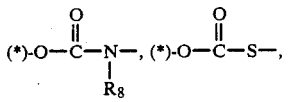

or

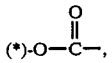

wherein $R_8$ represents a hydrogen atom, an aliphatic group, an aromatic group or a heterocyclic group.

$X_1$ in formula (T-1) represents a hydrogen atom, an aliphatic group, an aromatic group, a heterocyclic group, —O—$R_9$, —S$R_9$,

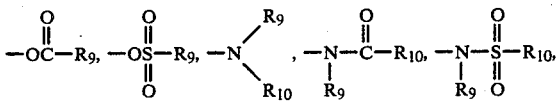

—COO$R_9$,

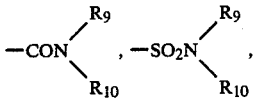

—CO—$R_9$, —$SO_2$—$R_9$, a cyano group, a halogen atom (e.g., a fluorine atom, a chlorine atom, a bromine atom, an iodine atom, etc.), a nitro group (wherein, $R_9$ and $R_{10}$, which may be the same or different, each is the same as defined for $R_8$).

$X_2$ represents the same group as stated for $R_8$ and q represents an integer of 1 to 4. When q is 2 to 4, the substituents shown by $X_1$s can be the same or different and further, when q is 2 to 4, $X_1$s can combine with each other to form a ring. Also, n represents 0, 1, or 2.

Examples of the groups represented by formula (T-1) described above are described, for example, in U.S. Pat. No. 4,248,962.

Second is formula (T-2)

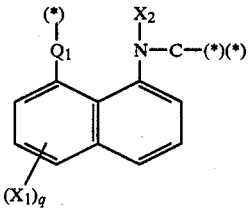

(T-2)

wherein $Q_1$, $X_1$, $X_2$, and q are the same as defined for formula (T-1).

Third is formula (T-3)

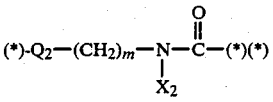

(T-3)

wherein $Q_2$ represents (*)—O—,

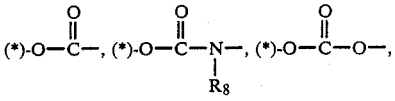

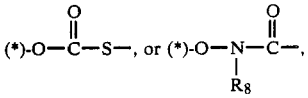

m represents an integer of 1 to 4, preferably 1, 2, or 3, and $R_8$ and $X_2$ are the same as defined for formula (T-1).

Fourth is formula (T-4)

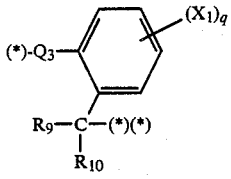

(T-4)

wherein $Q_3$ represents (*)—O—,

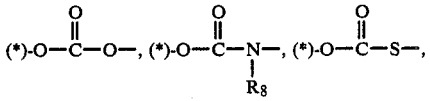

(*)—O—$CH_2$—O—, or (*)—O—$CH_2$—S—, and $R_8$, $R_9$, $R_{10}$, $X_1$ and q are the same as defined for formula (T-1). Examples of the groups shown by formula (T-4) are the timing groups described in U.S. Pat. No. 4,409,323.

Fifth is formula (T-5)

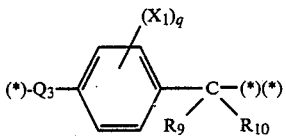

(T-5)

wherein $Q_3$, $R_9$, $R_{10}$, $X_1$, and q are the same as defined for formula (T-4).

Sixth is formula (T-6)

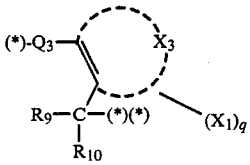

(T-6)

wherein $X_3$ represents an atomic group composed of an atom selected from carbon, nitrogen, oxygen and sulfur or a combination of two or more of such atoms forming a 5- to 6-membered heterocyclic ring, which can be further condensed with a benzene ring or 5- to 7-membered heterocyclic ring. Examples of the preferred heterocyclic ring are pyrrole, pyrazole, imidazole, triazole, furan, oxazole, thiophene, thiazole, pyridine, pyridazine, pyrimidine, pyrazine, azepine, oxepine, indole, benzofuran, quinoline, etc.

Also, $Z_3$, $X_1$, q, $R_9$, and $R_{10}$ are the same as defined for formula (T-4). Examples of the groups shown by formula (T-6) are the timing groups described in British Pat. No. 2,096,783.

Seventh is formula (T-7)

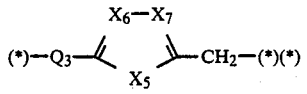

(T-7)

wherein $X_5$ represents an atomic group composed of an atom selected from carbon, nitrogen, oxygen, and sulfur or a combination of two or more of such atoms forming a 5- to 7-membered heterocyclic ring. $X_6$ and $X_7$ each represents

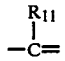

or —N=, wherein $R_{11}$ represents a hydrogen atom, an aliphatic group, or an aromatic group. The aforesaid heterocyclic group may be further condensed with a benzene ring or a 5- to 7-membered heterocyclic ring.

Examples of the preferred heterocyclic ring are pyrrole, imidazole, triazole, furan, oxazole, oxadiazole, thiophene, thiazole, thiadiazole, pyridine, pyridazine, pyrimidine, pyrazine, azepine, oxepine, isoquinoline, etc.

Also, $Q_3$, $X_1$, and q are the same as defined for formula (T-4).

Eighth is formula (T-8)

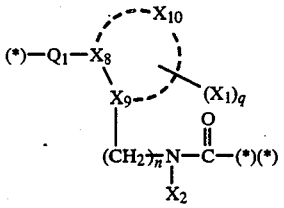

(T-8)

wherein $X_{10}$ represents an atomic group composed of an atom selected from carbon, nitrogen, oxygen, and sulfur, or a combination of two or more these atoms and necessary for forming a 5- to 7-membered heterocyclic ring and $X_8$ and $X_9$ each represents

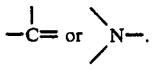

The aforesaid heterocyclic ring may be further condensed with a benzene ring or a 5- to 7-membered heterocyclic ring. Examples of the preferred heterocyclic rings are pyrrolidine, piperidine, benzotriazole, etc., in addition to those illustrated for formula (T-6).

Also, $Q_1$, $X_1$, $X_2$, n, and q have the same significance as defined for formula (T-1).

Ninth is formula (T-9)

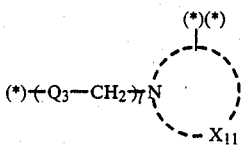

(T-9)

wherein $X_{11}$ is the same as $X_{10}$ defined for formula (T-8) and $Q_3$ is the same as defined for formula (T-4).

Examples of the preferred heterocyclic rings are illustrated below.

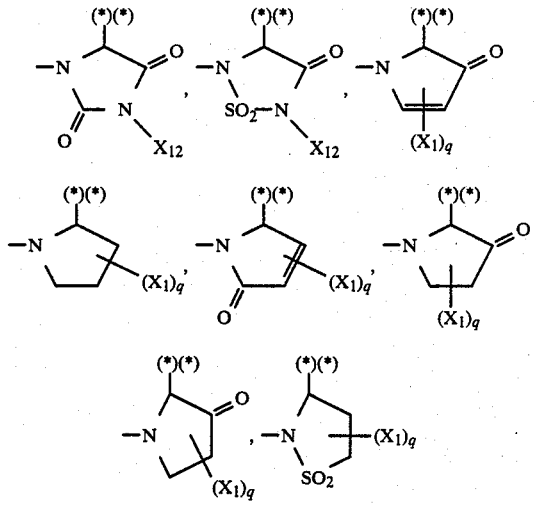

In the above formulae, $X_1$ and q are the same as defined for formula (T-1), $X_{12}$ represents a hydrogen atom, an aliphatic group, an aromatic group, an acyl group, a sulfonyl group, an alkoxycarbonyl group, a sulfamoyl group, a heterocyclic ring group or a carbamoyl group, and l represents 0 or 1.

Tenth is formula (T-10)

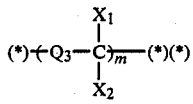

(T-10)

wherein $X_1$ and $X_2$ are the same as defined for formula (T-1), $Q_3$ has the same significance as defined for formula (T-4), and m has the same significance as defined for formula (T-3), and is preferably 1 or 2.

When $X_1$, $X_2$, $R_8$, $R_9$, $R_{10}$, and $R_{11}$ in above-described formulae (T-1) to (T-10) include an aliphatic group moiety, the moiety may be a saturated or unsaturated, substituted or unsubstituted, chain or cyclic, straight chain or branched chain group, preferably having from 1 to 20 carbon atoms. When above-described $X_1$, $X_2$, $R_8$, $R_9$, $R_{10}$, and $R_{11}$ include an aliphatic group moiety, the moiety generally has from 6 to 20, and preferably from 6 to 10 carbon atoms, and is, more preferably a substituted or unsubstituted phenyl group. Also, when above-described $X_1$, $X_2$, $R_8$, $R_9$, $R_{10}$, and $R_{11}$ include a heterocyclic ring group moiety, the moiety is a 5-membered or 6-membered heterocyclic ring having at least one of nitrogen atom, oxygen atom, and sulfur atom as the hetero atom(s). Preferred examples of the heterocyclic ring group are a pyridyl group, a furyl group, a thienyl group, a triazolyl group, an imidazolyl group, a pyrazolyl group, a thiadazolyl group, an oxadiazolyl group, or a pyrrolidinyl group.
Preferred examples of the aforesaid timing group are illustrated below.
(1)
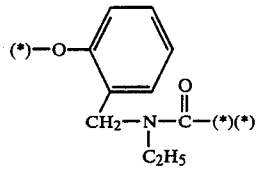
(2)
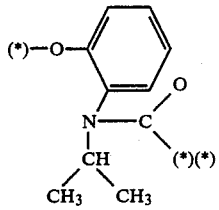
(3)
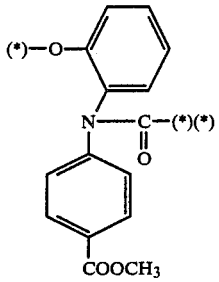
(4)
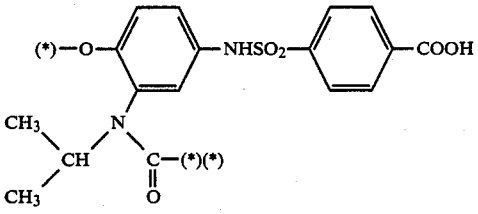
(5)
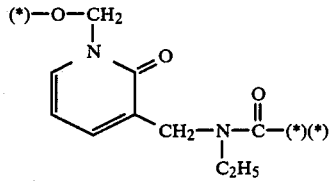
(6)
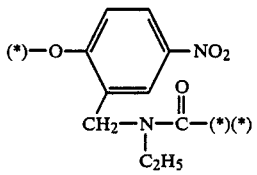
(7)
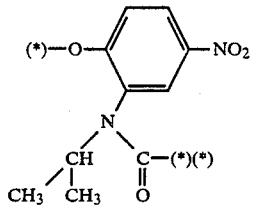
-continued
(8)
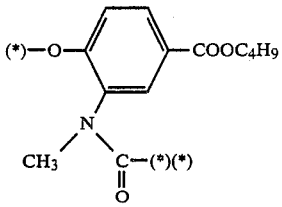
(9)
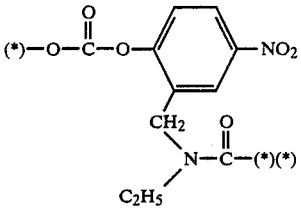
(10)
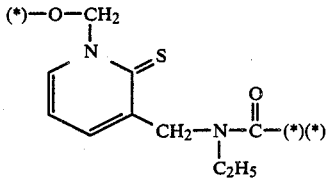
(11)
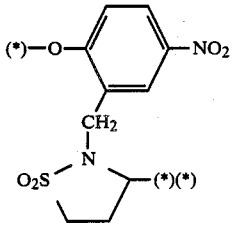
(12)
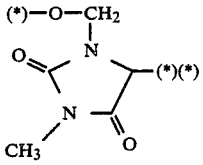
(13)
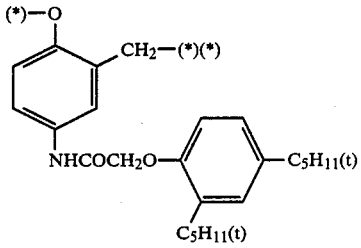
(14)
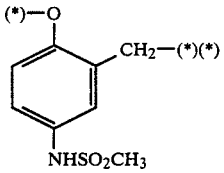

-continued
(15)
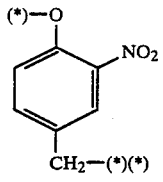
(16)
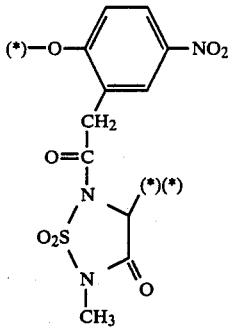
(17)
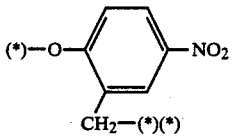
(18)
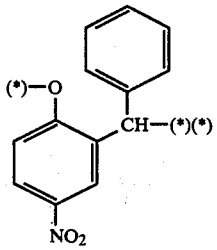
(19)
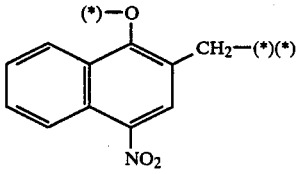
(20)
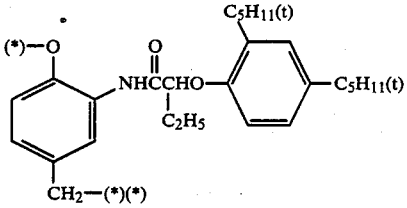
-continued
(21)
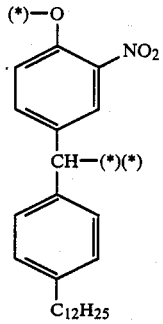
(22)
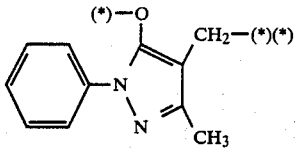
(23)
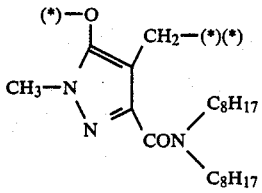
(24)
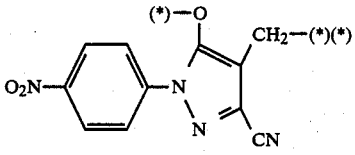
(25)
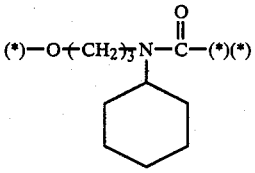
(26)
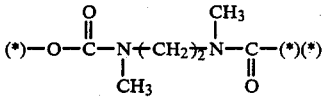
(27)
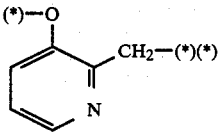
(28)
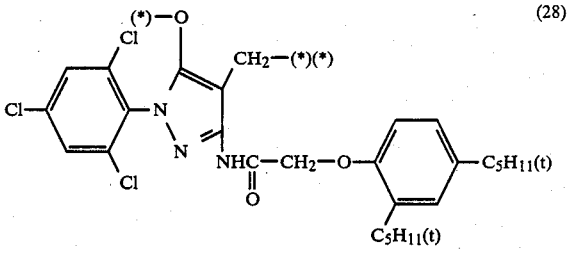

-continued (29)

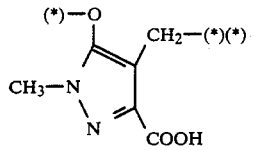

(30)

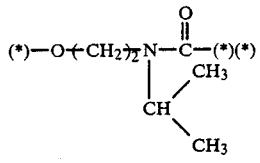

(31)

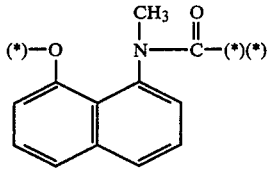

(32)

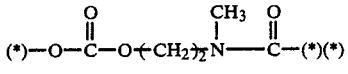

(33)

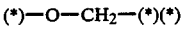

(34)

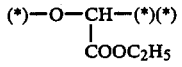

(35)

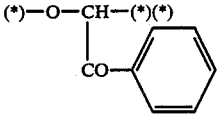

(36)

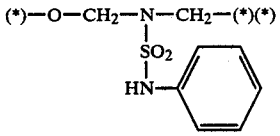

(37)

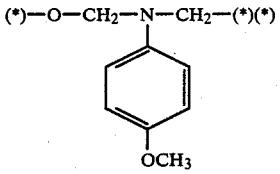

(38)

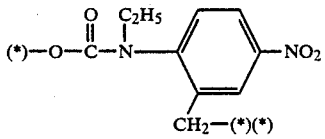

(39)

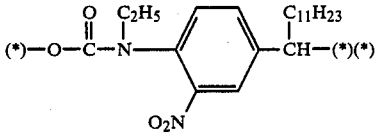

(40)

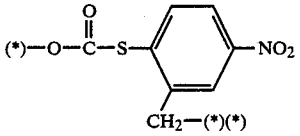

-continued (41)

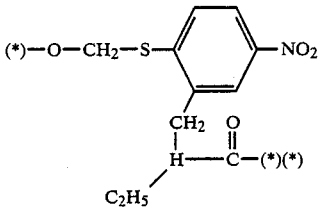

(42)

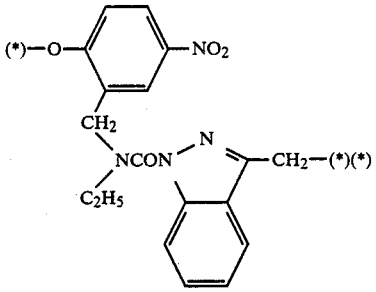

PUG in formula (I) described above represents a photographically useful group.

Examples of photographically useful groups include development inhibitors, development accelerators, fogging agents, couplers, coupler-releasing couplers, diffusible or non-diffusible dyes, silver removal inhibitors, silver removal accelerators, silver halide solvents, competing compounds, developing agents, auxiliary developing agents, fix accelerators, fix inhibitors, image stabilizers, toning agents, processing dependence improving agents, dot improving agents, image stabilizers, photographic dyes, surface active agents, hardening agents, ultraviolet absorbents, optical whitening agents, desensitizers, contrast increasing agents, chelating agents, etc., or precursors thereof.

These photographically useful groups are overlapped with each other in the points of usefulness, and are further explained below by specific examples.

Examples of development inhibitors are compounds having a mercapto group bonded to a heterocyclic ring such as substituted or unsubstituted mercaptoazoles [e.g., 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-{3-(3-methylureido)-phenyl}-5-mercaptotetrazole, 1-(4-nitrophenyl)-5-mercaptotetrazole, 5-(2-ethylhexanoylamino)-2-mercaptobenzimidazole, etc.], substituted or unsubstituted mercaptoazaindenes (e.g., 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, 4,6-dimethyl-2-mercapto-1,3,3a,7-tetraazaindene, etc.) and substituted or unsubstituted mercaptopyrimidines (e.g., 2-mercaptopyrimidine, 2-mercapto-4-methyl-6-hydroxypyrimidine, 2-mercapto-4-propylpyrimidine, etc.) and heterocyclic compounds capable of forming imino silver, such as substituted or unsubstituted benzotriazoles (e.g., benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, 4,5,6,7-tetrachlorobenzotriazole, etc.), substituted or unsubstituted indazoles (e.g., indazole, 5-nitroindazole, 3-nitroindazole, 3-chloro-5-nitroindazole, 3-cyanoindazole, 3-n-methanesulfonylindazole, etc.), and substituted or unsubstituted benzimidazoles (e.g., 5-nitrobenzimidazole, 4-nitrobenzimidazole, 5,6-dichlorobenzimidazole, 5-cyano-6-chlorobenzimidazole, 5-trifluoromethyl-6-chlorobenzimidazole, etc.).

Also, the development inhibitor as the photographically useful group in this invention may be a compound which becomes a compound having a development inhibiting property after being released from the oxidation-reduction mother nucleus shown by formula (I) described above by a displacement reaction occurring after an oxidation-reduction reaction in a development processing step and further is converted into a compound having substantially no development inhibiting property or greatly reduced development inhibiting property.

The development inhibitor which changes the development inhibiting property as described above can be represented by formula (II)

$$-AF-CCD \qquad (II)$$

wherein AF represents groups shown by the following formulae which also show the substituted position of CCD. Also, (*)(*)(*) shows the bonding position to Time.

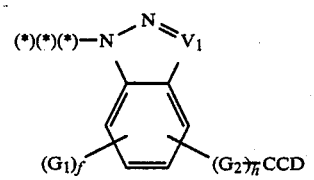

(P-1)

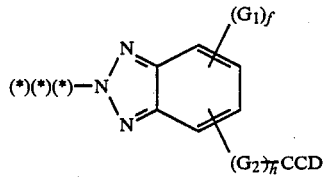

(P-2)

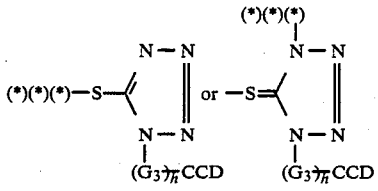

(P-3)

-continued

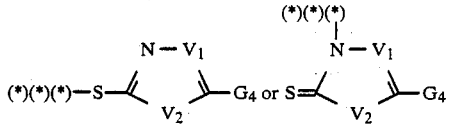

(P-4)

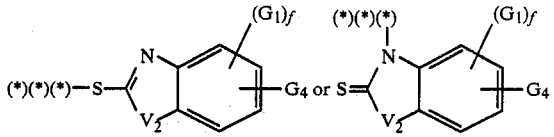

(P-5)

In the above formulae, $G_1$ represents a hydrogen atom, a halogen atom, an alkyl group (e.g., a methyl group, an ethyl group, etc.), an acylamino group (e.g., a benzamido group, a hexaneamido group, etc.), an alkoxy group (e.g., a methoxy group, a benzyloxy group, etc.), a sulfonamido group (e.g., a methanesulfonamido group, a benzenesulfonamido group, etc.), an aryl group (e.g., a phenyl group, a 4-chlorophenyl group, etc.), an alkylthio group (e.g., a methylthio group, a butylthio group, etc.), an alkylamino group (a cyclohexylamino group, etc.), an anilino group (e.g., an anilino group, a 4-methoxycarbonylanilino group, etc.), an amino group, an alkoxycarbonyl group (e.g., a methoxycarbonyl group, a butoxycarbonyl group, etc.), an acyloxy group (e.g., an acetyl group, a butanoyl group, a benzoyl group, etc.), a nitro group, a cyano group, a sulfonyl group (e.g., a butanesulfonyl group, a benzenesulfonyl group, etc.) an aryloxy group (e.g., a phenoxy group, a naphthyloxy group, etc.), a hydroxy group, a thioamido group (e.g., a butanethioamido group, a benzenethiocarbamoylamido group, etc.), a carbamoyl group (e.g., a carbamoyl group, an N-arylcarbamoyl group, etc.), a sulfamoyl group (e.g., a sulfamoyl group, an N-arylsulfamoyl group, etc.), a carboxyl group, a ureido group (e.g., a ureido group, an N-ethylureido group, etc.), or aryloxycarbonyl group (e.g., a phenoxycarbonyl group, a 4-methoxycarbonyl group, etc.); $G_2$ represents the substituents illustrated above as $G_1$, which can become divalent groups; $G_3$ represents a substituted or unsubstituted alkylene group or a substituted or unsubstituted arylene group, which may have therein an ether linkage, an ester linkage, a thioether linkage, an amido linkage, a ureido linkage, an imido linkage, a sulfonyl linkage, a sulfonamido linkage, a carbonyl linkage, etc., and also the linkage group and the alkylene group(s) or arylene group(s) may combine with each other to form a divalent group as a whole; $V_1$ represents a nitrogen atom or a methine atom; $V_2$ represents an oxygen atom, a sulfur atom,

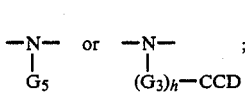

$G_4$ represents the substituents illustrated as $G_1$ or $(G_3)_h$CCD; $G_5$ represents a hydrogen atom, an alkyl group (e.g., a methyl group, an ethyl group, etc.), or an aryl group (e.g., a phenyl group, a naphthyl group, etc.); f represents an integer of 1 or 2; and h represents 0 or 1. When f is 2, the two $G_2$s can be the same or different. In formulae (P-4) and (P-5) described above, at least one of the groups shown by $V_2$ and $G_4$ is a group including CCD.

When $G_1$, $G_2$, $G_3$, $G_4$, or $G_5$ in above-described formulae (P-1), (P-2), (P-3), (P-4) and (P-5) includes an alkyl group moiety, the alkyl group may be a substituted or unsubstituted, straight or branched chain, chain-like or cyclic, or saturated or unsaturated group having 1 to 22, preferably 1 to 10 carbon atoms. Furthermore, when $G_1$, $G_2$, $G_3$, $G_4$ or $G_5$ includes an aryl group moiety, the aryl group has 6 to 10 carbon atoms and is preferably a substituted or unsubstituted phenyl group.

CCD in formula (II) described above preferably represents the groups shown by formulae (D-1) to (D-16).

First are formulae (D-1) and (D-2)

$$-COOR_{12} \quad \text{(D-1)}$$

$$-\underset{\underset{O}{\|}}{C}OR_{13} \quad \text{(D-2)}$$

wherein $R_{12}$ and $R_{13}$ represent a substituted or unsubstituted alkyl group (preferably having from 1 to 10 carbon atoms, e.g., a methyl group, an ethyl group, a 2,3-dichloropropyl group, a 2,2,3,3-tetrafluoropropyl group, a butoxycarbonylmethylcyclohexylaminocarbonylmethyl group, a methoxyethyl group, a propargyl group, etc.), a substituted or unsubstituted aryl group (preferably having from 6 to 10 carbon atoms, e.g., a phenyl group, a 3,4-methyleneoxyphenyl group, a n-methoxyphenyl group, a p-cyanophenyl group, a m-nitrophenyl group, etc.), or a substituted or unsubstituted aralkyl group (preferably having from 7 to 12 carbon atoms, e.g., a benzyl group, a p-nitrobenzyl group, etc.).

Second are formulae (D-3), (D-4), and (D-5).

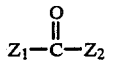

(D-3)

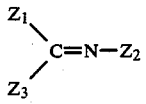

(D-4)

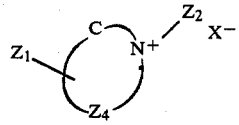

(D-5)

wherein $Z_1$ and $Z_2$ each represents a chemical bond to AF or a hydrogen atom, an alkylamino group (e.g., $CH_3$—NH—, $CH_3$—N—, etc.), an alkyl group (e.g., a methyl group, a propyl group, a methoxymethyl group, a benzyl group, etc.), an aryl group (e.g., a phenyl group, a 4-chlorophenyl group, a naphthyl group, a 4-methoxyphenyl group, a 4-butaneamidophenyl group, etc.), an acylamido group, the nitrogen atom of which may be substituted (e.g., an acetoamido group, a benzamido group, etc.), or a 4- to 7-membered substituted or unsubstituted heterocyclic ring group containing atom(s) selected from nitrogen atom, sulfur atom, and oxygen atom as the hetero atom (e.g., a 2-pyridyl group, a 2-pyrrolidinyl group, a 4-imidazolyl group, a 3-chloro-5-pyrazolyl group, etc.).

In formula (D-4), $Z_3$ represents a hydrogen atom, a halogen atom, an alkyl group (e.g., a methyl group, a propyl group, etc.), an aryl group (e.g., a phenyl group, a 4-chlorophenyl group, a naphthyl group, etc.), a heterocyclic ring group (a 4- to 7-membered heterocyclic ring group including atom(s) selected from nitrogen atom, sulfur atom, and oxygen atom as the hetero atom, e.g., a 2-pyridyl group, a 2-pyrrolidinyl group, etc.), an alkoxy group (e.g., a methoxy group, a butoxy group, etc), an alkoxy group (e.g., an acetyl group, a benzoyl goup, etc.), a carbamoyl group the nitrogen atom of which may be substituted (e.g. an N-butylcarbamoyl group, an N-phenylcarbamoyl group, etc.), a sulfamoyl group the nitrogen atom of which may be substituted (e.g., an N-phenylsulfamoyl group, etc.), a sulfonyl group (e.g., a propanesulfonyl group, a benzenesulfonyl group, etc.), an alkoxycarbonyl group (e.g., an ethoxycarbonyl group, etc.), an acylamino group (e.g., an acetamido group, a benzamido group, etc.), a sulfonamido group (e.g., a benzenesulfonamido group, etc.), an alkylthio group (e.g., a butylthio group, etc.), or a ureido group the nitrogen atom of which can be substituted (e.g., a 3-phenylureido group, a 3-butylureido group, etc.). Also, said $Z_1$ and $Z_3$ can combine with each other to form a ring.

In formula (D-5) described above, $Z_4$ represents an atomic group (selected from carbon atom(s), hydrogen atom(s), nitrogen atom(s), oxygen atom(s), and sulfur atom(s)) forming a 5-membered or 6-membered unsaturated heterocyclic ring, and $X^-$ represents an organic sulfonic acid anion, an organic carboxylic acid anion, a halogen ion, or an inorganic anion (e.g., a tetrafluoroborate ion, etc.).

Examples of the heterocyclic ring shown by $Z_4$ are those shown by the following formulae

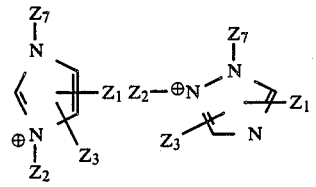

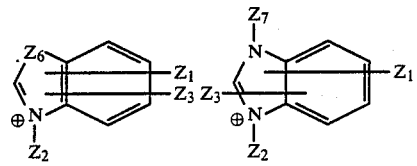

wherein $Z_1$ is bonded at a substitutable position, $Z_7$ is the same as $Z_1$ or $Z_2$, and $Z_6$ represents an oxygen atom or a sulfur atom.

Third is formula (D-6)

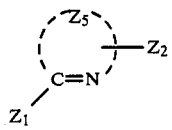

(D-6)

wherein $Z_1$ and $Z_2$ are same as defined above and $Z_5$ represents an atomic group (selected from carbon atom(s), oxygen atom(s), and nitrogen atom(s)) which forms a 5- to 7-membered ring together with

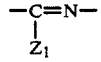

and provides no aromaticity to

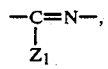

i.e., a ring containing

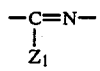

does not have $\pi$ electrons of $4n+2$. $Z_5$ is preferably an alkylene group (which may be substituted, such as $-(CH_2)_4-$), or an alkenylene group (which may be substituted), such as $-CH_2-CH=CH-CH_2$,

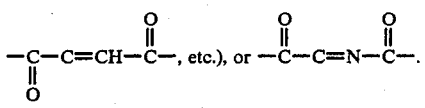

When $Z_1$, $Z_2$, $Z_3$, or $Z_7$ in above-described formulae (D-3), (D-4), (D-5) and (D-6) includes an alkyl group moiety, the alkyl group may be a substituted or unsubstituted, straight or branched chain, chain-like or cyclic, or saturated or unsaturated alkyl group having from 1 to 16, and preferably from 1 to 10 carbon atoms. Also, when $Z_1$, $Z_2$, $Z_3$, or $Z_7$ include an aryl group moiety, the aryl group has from 6 to 10 carbon atoms, and is preferably a substituted or unsubstituted phenyl group.

Fourth are formulae (D-7), (D-8), (D-9), and (D-10).

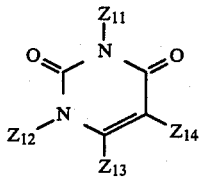

(D-7)

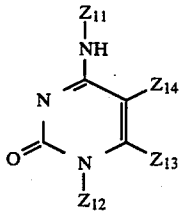

(D-8)

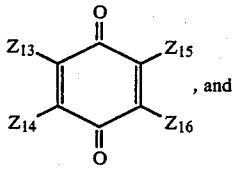

, and (D-9)

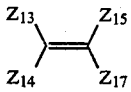

(D-10)

In formulae (D-7) to (D-10) described above, at least one of $Z_{11}$ to $Z_{17}$ is the above-described group AF or a group containing AF.

In the above formulae, $Z_{11}$ and $Z_{12}$ each represents a hydrogen atom, an alkyl group, an aryl group, or a group AF.

In the above-described formulae, $Z_{13}$, $Z_{14}$, $Z_{15}$, and $Z_{16}$ each represents a hydrogen atom, an alkyl group, an aryl group, a halogen atom (e.g., chlorine atom), an alkoxy group (e.g., a methoxy group, a butoxy group, etc.), an aryloxy group (e.g., a phenoxy group, a p-carboxyphenoxy group, etc.), an arylthio group (e.g., a phenylthio group, etc.), an alkylthio group (e.g., a methylthio group, a butylthio group, etc.), an alkoxycarbonyl group (e.g., an ethoxycarbonyl group, an octylcarbonyl group, etc.), an aryloxycarbonyl group (e.g., a phenoxycarbonyl group, etc.), an alkanesulfonyl group (e.g., a methanesulfonyl group, etc.), a sulfamoyl group (e.g., a sulfamoyl group, a methylsulfamoyl group, etc.), a carbamoyl group (e.g., a carbamoyl group, an N-phenylcarbamoyl group, etc.), a ureido group (e.g., an N-methylureido group, etc.), an acyl group (e.g., an acetyl group, a benzoyl group, etc.), an acylamino group (e.g., an acetamido group, a benzoamido group, etc.), an arylsulfonyl group (e.g., a benzenesulfonyl group, etc.), a heterocyclic ring group (a 5- or 6-membered ring having hetero atom(s) selected from nitrogen atom, oxygen atom and sulfur atom, e.g., an imidazolyl group, a 1,2,4-triazolyl group, a thiadiazolyl group, an oxadiazolyl group, etc.), an acyloxy group (e.g., an acetyloxy group, etc.), a nitro group, a cyano group, a carboxyl group, a thiocarbamoyl group (e.g., a phenylthiocarbamoyl group, etc.), a sulfamoylamino group (e.g., an N-phenylsulfamoylamino group, etc.), a diacylamino group (e.g., a diacetylamino group, etc.), an allylideneamino group (e.g., a benzylideneamino group, etc.), or the group AF.

Also, $Z_{17}$ in formula (D-10) described above represents the following groups.

That is, in $Z_{17}$, AF may combine through the group shown below capable of becoming a divalent group: They are a halogen atom, an alkoxycarbonyl group, an aryloxycarbonyl group, an alkanesulfonyl group, a sulfamoyl group, a carbamoyl group, an acyl group, a diacylamino group, an arylsulfonyl group, a heterocyclic ring group, a nitro group, a cyano group, a carboxyl group, a sulfonamido group. Specific examples of $Z_{17}$ are the groups defined for $Z_{12}$ to $Z_{16}$.

When $Z_{11}$, $Z_{12}$, $Z_{13}$, $Z_{14}$, $Z_{15}$, $Z_{16}$, or $Z_{17}$ in formulae (D-7), (D-8), (D-9), and (D-10) include an alkyl group moiety, the alkyl group may be a substituted or unsubstituted, straight or branched chain, chain-like or cyclic, or saturated or unsaturated alkyl group having 1 to 16, preferably 1 to 8 carbon atoms. Furthermore, when $Z_{11}$, $Z_{12}$, $Z_{13}$, $Z_{14}$, $Z_{15}$, $Z_{16}$, or $Z_{17}$ include an aryl group moiety, the aryl group has 6 to 10 carbon atoms, and is preferably a substituted or unsubstituted phenyl group.

In formula (D-9), $Z_{15}$ and $Z_{17}$ can combine with each other as a divalent group to form a ring (e.g., a benzene ring).

In formula (D-10), $Z_{15}$ and $Z_{17}$ can combine with each other as a divalent group to form a ring (e.g., a benzothiazolidene group).

Fifth are formulae (D-11), (D-12), (D-13), and (D-14).

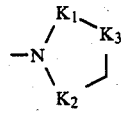

(D-11)

-continued (D-12)

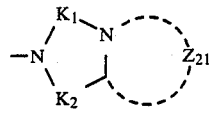

(D-13)

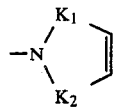

(D-14)

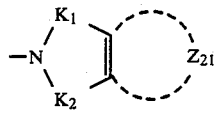

wherein $Z_{21}$ represents a saturated or unsaturated 6-membered ring, $K_1$ and $K_2$ each represents an electron withdrawing group (e.g.,

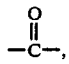

$—SO_2—$, etc.), and $K_3$ represents $—N—R_{14}$, wherein $R_{14}$ represents an alkyl group, preferably having 1 to 6 carbon atoms.

Sixth are formulae (D-15) and (D-16)

(D-15)

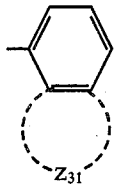

(in the case of h=0 in the formulae (P-1) to (P-5) described above).

(D-16)

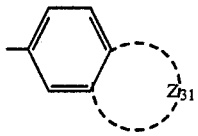

(in the case of h=0 in the formulae (P-1) to (P-5) described above).

In the above formulae, $Z_{31}$ represents a group forming a 5-membered or 6-membered ring lactone ring or a 5-membered imide ring.

Specific examples of PUG shown by formula (II) are 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-(phenoxycarbonyl)benzotriazole, 5-(p-cyanophenoxycarbonyl)-benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxyimidazole, 5-(2,3-dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylethoxycarbonyl)-2-mercaptobenzothiazole, 1-{4-(2-chloroethoxycarbonyl)phenyl-2-mercaptoimidazole, 2-[3-thiophene-2-ylcarbonyl}propyl]thio-5-mercapto-1,3,4-thiadiazole, 5-cinnamoylaminobenzotriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 3-{4-(benzo-1,2-isothiazole-3-oxo-1,1-dioxy-2-yl)phenyl}-5-mercapto-4-methyl-1,2,4-triazole, 6-phenoxycarbonyl-2-mercaptobenzoxazole, etc.

When PUG is a development accelerator, examples of such a development accelerator are those represented by formula (III)

$$(*)(*)(*)—L_1\overset{|}{\underset{|}{-}}L_2)_{\overline{k}}A \qquad \text{(III)}$$

wherein (*)(*)(*) represents a bonding position to Time, $L_1$ represents a group capable of further releasing from the released Time during development, $L_2$ represents a divalent linkage group, k represents 0 or 1, and A represents a group substantially giving a fogging action to silver halide emulsions in a developer.

Specific examples of $L_1$ are an aryloxy group, a heterocyclic oxy group, an arylthio group, an alkylthio group, a heterocyclic thio group, an azolyl group, etc.

Practical examples of $L_1$ are shown below.

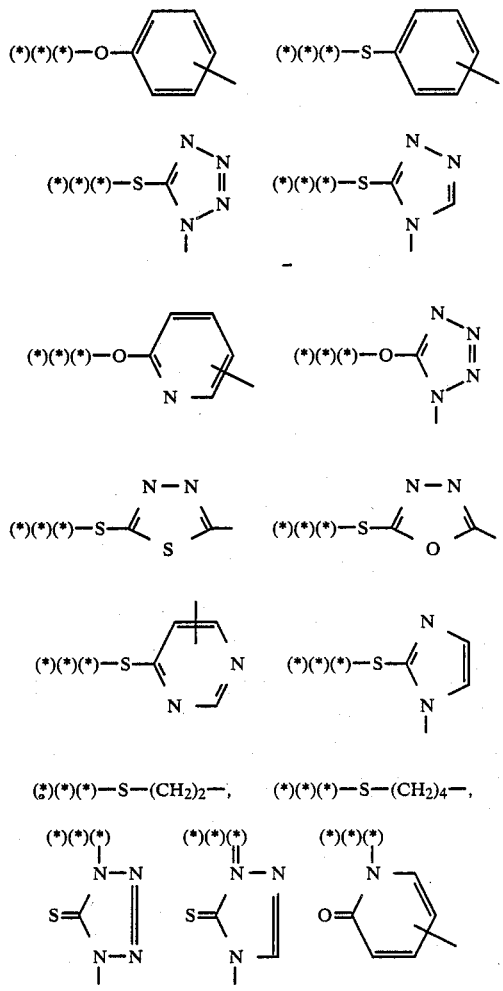

-continued

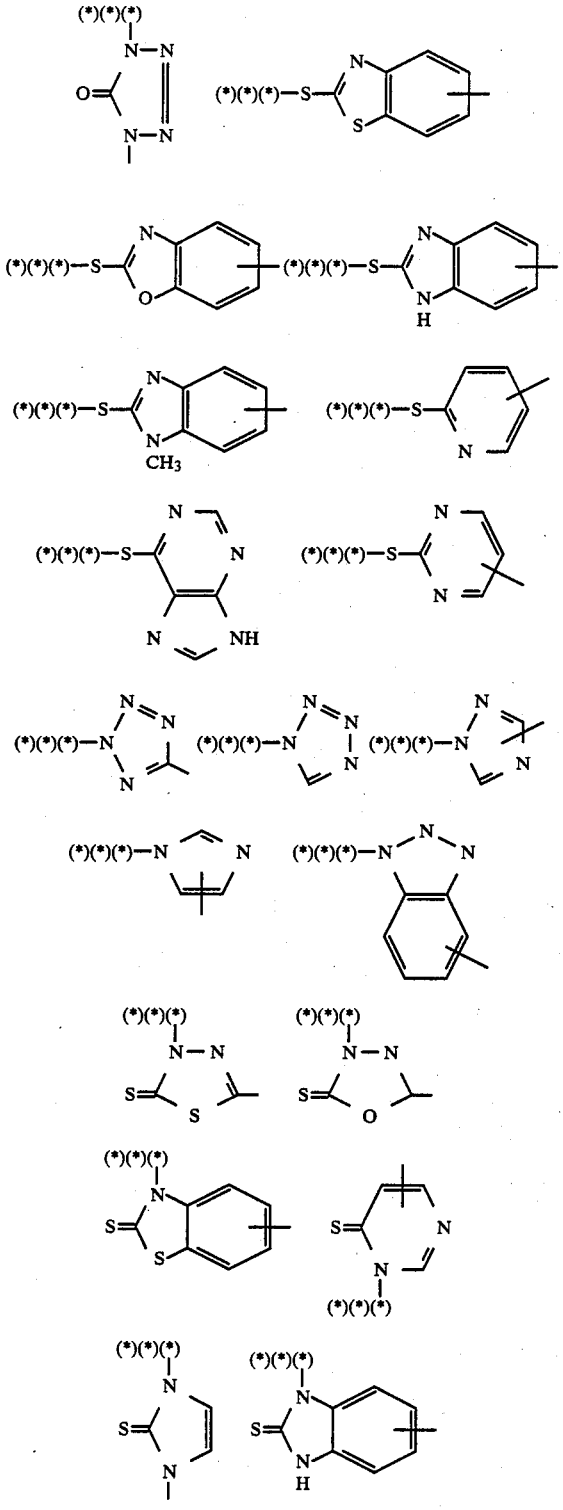

-continued

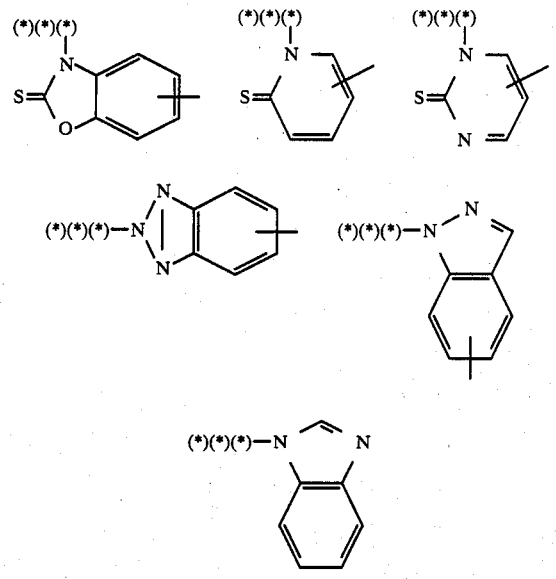

Examples of $L_2$ are an alkylene group, an alkenylene group, an arylene group, a divalent heterocyclic ring group, —O—, —S—, an imino group, —COO—, —CONH—, —NHCONH—, —NHCOO—, —$SO_2$NH—, —CO—, —$SO_2$—, —SO—, —NH-$SO_2$NH—, etc., and composites thereof.

Preferred examples of A are reducing groups (e.g., groups having the partial structures of hydrazine, hydrazide, hydrazone, hydroxylamine, polyamine, enamine, hydroquinone, catechol, p-aminophenol, o-aminophenol, aldehyde, and acetylene), groups capable of forming a developable silver sulfide nucleus by acting a silver halide upon development (e.g., groups having the partial structures of thiourea, thioamide, thiocarbamate, dithiocarbamate, thiohydrantoin, rhodanine, etc.), and quaternary salts (e.g., pyridinium salt, etc.).

Particularly useful groups in the groups shown by A are the groups represented by following formula (IV)

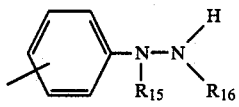

(IV)

wherein $R_{15}$ represents a hydrogen atom, a sulfonyl group or an alkoxycarbonyl group and $R_{16}$ represents an acyl group, a sulfonyl group, a carbamoyl group, an alkoxycarbonyl group, a sulfamoyl group, a thioacyl group, a thiocarbamoyl group, or a heterocyclic ring group. The benzene ring of formula (IV) above may overlap with the benzene ring of $L_1$ in formula (IV).

Specific examples of PUG shown by formula (III) described above are illustrated below, in which (*)(*)(*) shows the bonding position to Time.

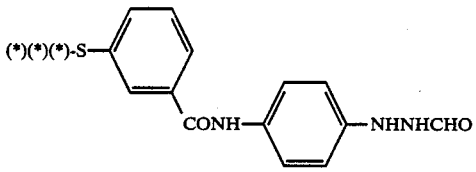

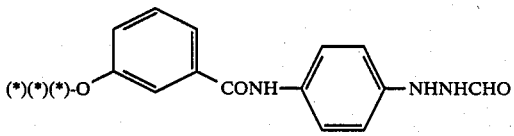

-continued
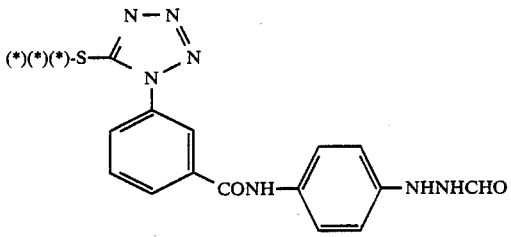
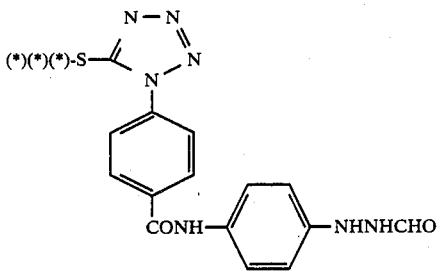
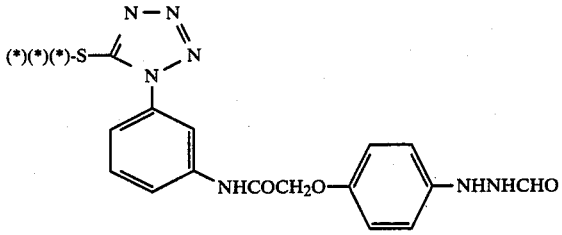
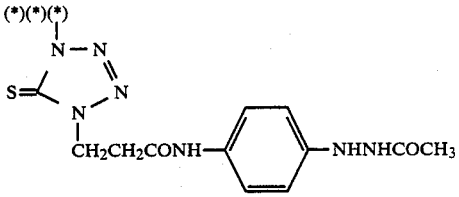
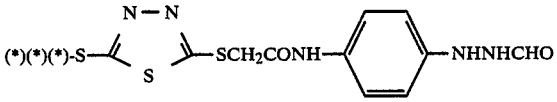
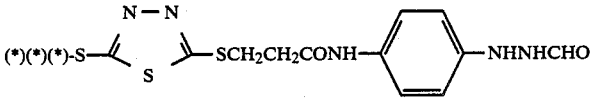
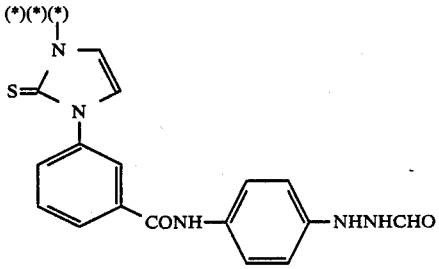
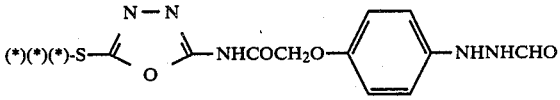
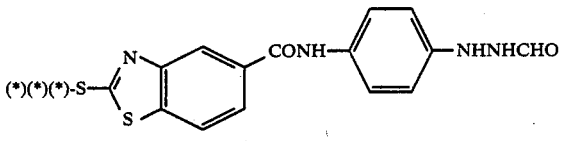
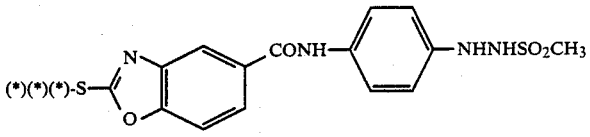
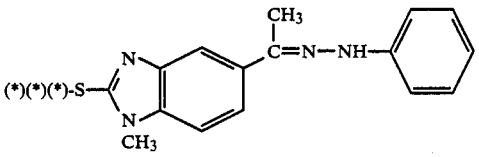
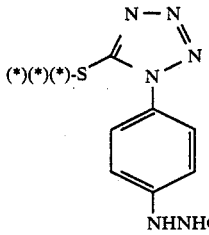
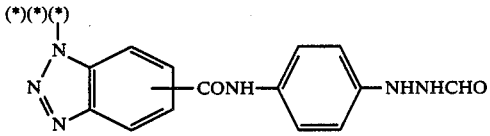
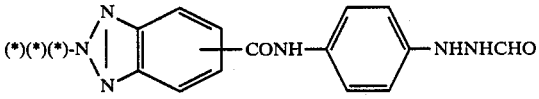

-continued

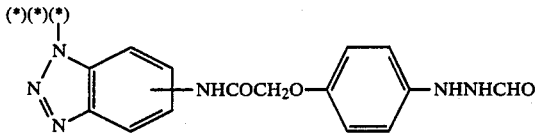

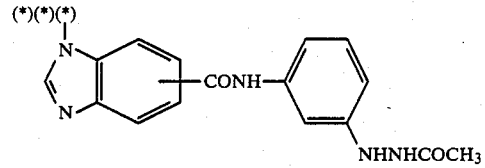

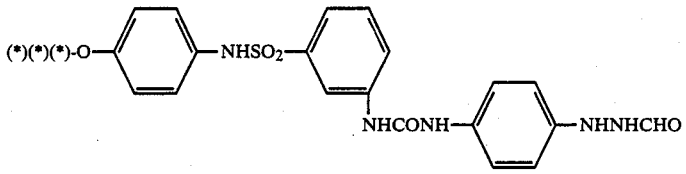

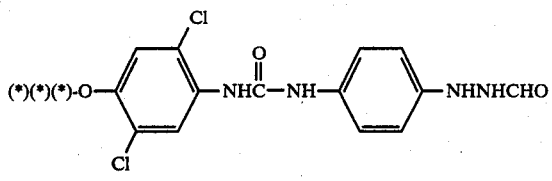

When PUG is a silver halide solvent, examples of such a silver halide solvent are those represented by following formula (V), (VI) or (VII) (wherein (*)(*)(*) shows the bonding position to Time).

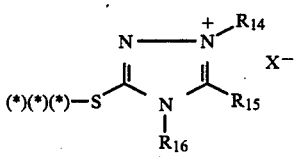

(V)

wherein $R_{14}$ and $R_{16}$ each represents a substituted or unsubstituted alkyl group, a substituted or unsubstituted aryl group, a substituted or unsubstituted amino group, a substituted or unsubstituted alkoxy group, or a substituted or unsubstituted heterocyclic ring group and $R_{15}$ represents a hydrogen atom, a substituted or unsubstituted alkyl group, a substituted or unsubstituted aryl group, or a substituted or unsubstituted heterocyclic ring group; $X^-$ represents an organic or inorganic anion; or said $R_{14}$ and $R_{15}$ or said $R_{15}$ and $R_{16}$ combine with each other to form a saturated or unsaturated carbon ring or a saturated or unsaturated heterocyclic ring;

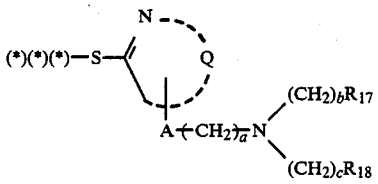

(VI)

wherein Q represents an atomic group necessary for forming a heterocyclic ring composed of atoms selected from carbon atoms, nitrogen atom(s), oxygen atom(s) and sulfur atom(s), $R_{17}$ and $R_{18}$ each represents a hydrogen atom, a hydroxy group, a carboxyl group, a sulfo group, a sulfamoyl group, a carbamoyl group, a sulfonamido group, an acylamino group, or an amino group, A represents a single linkage or an oxygen atom or a sulfur atom, a represents an integer of 0, 1, 2, or 3, and b and c each represents an integer of 0, 1, or 2.

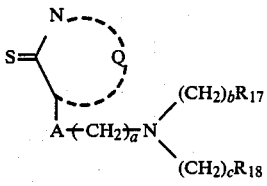

(VII)

wherein Q, A, $R_{17}$, $R_{18}$, a, b, and c have the same significance as defined for formula (VI).

Specific examples of the compound represented by formula (V), (VI) or (VII) described above are illustrated below.

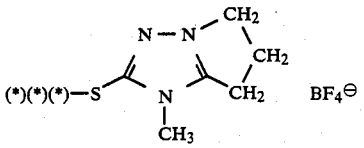

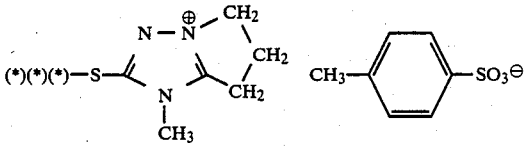

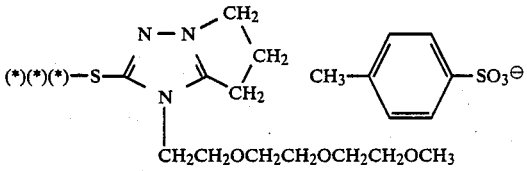

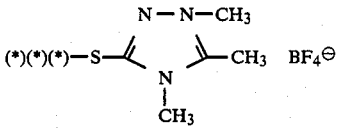

-continued

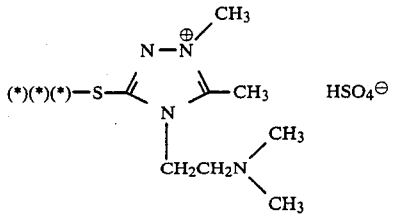

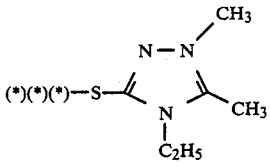

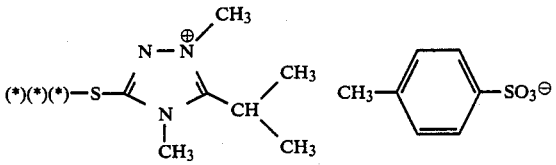

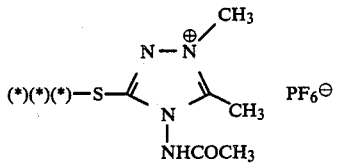

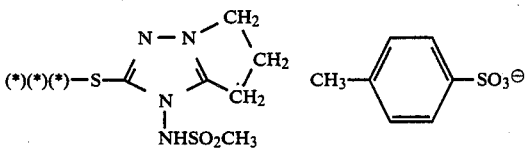

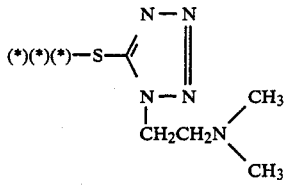

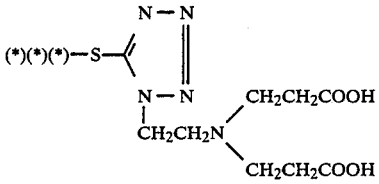

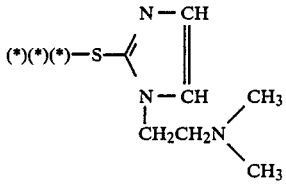

-continued

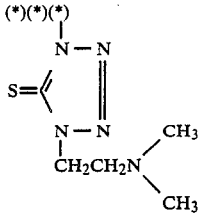

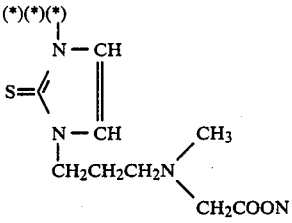

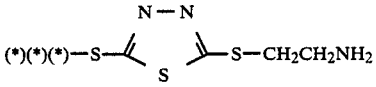

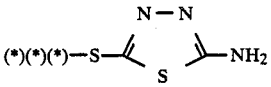

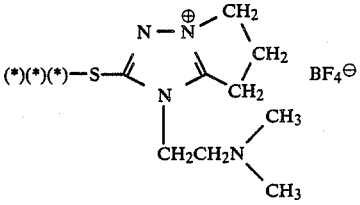

When PUG is a diffusible or non-diffusible dye, examples of such a dye are azo dyes, azomethine dyes, azopyrazolone dyes, indoaniline dyes, indophenol dyes, anthraquinone dyes, triarylmethane dyes, alizarine, nitro dyes, quinoline dyes, indigo dyes, phthalocyanine dyes, etc. Furthermore, there are leuco compounds of these dyes, i.e., the above-described dyes in which the absorption wavelength is temporarily shifted, and furthermore there are dye precursors such as tetrazolium salts, etc. Moreover, these dyes may form chelate dyes with a proper metal. These dyes are described, for example, in U.S. Pat. Nos. 3,880,658, 3,931,144, 3,932,380, 3,932,381, 3,942,987, etc.

The dyes or the dye precursors for use in this invention as PUG are preferably azo dyes, azomethine dyes, indoaniline dyes and the dye precursors of these dyes.

Specific examples of the preferred dyes and dye precursors are illustrated below.

1
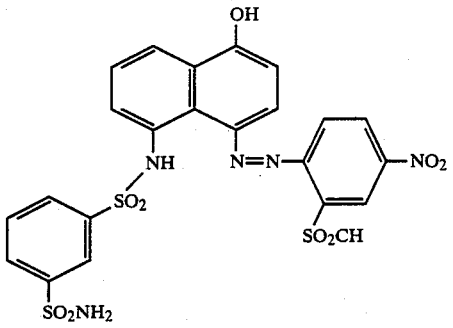
2
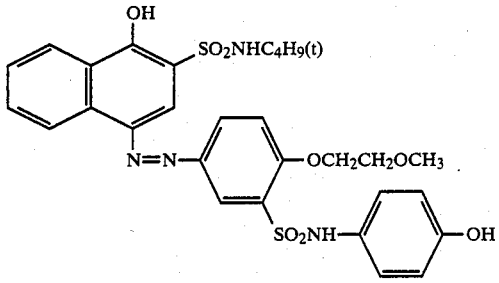
3
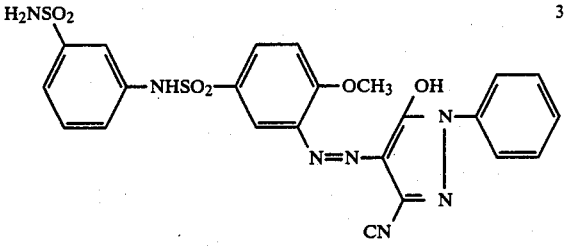
4
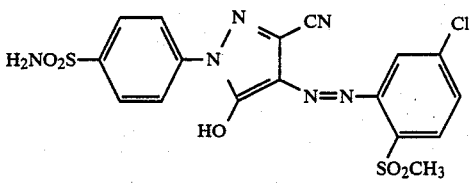
5
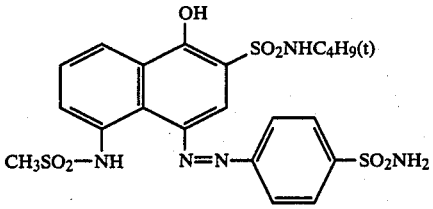
6
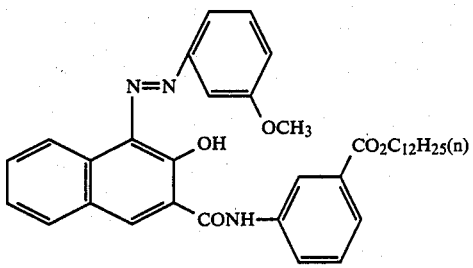
7
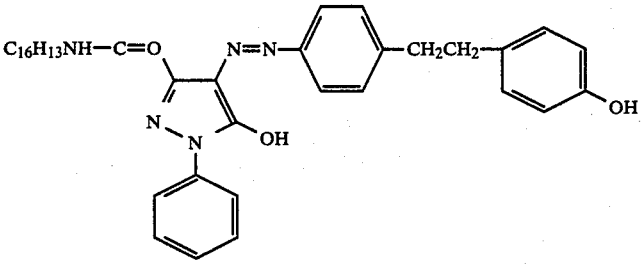
8
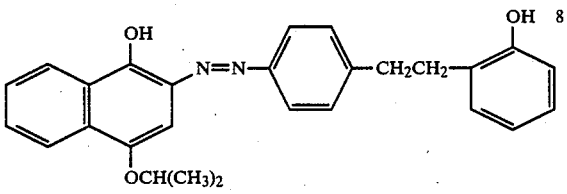
9
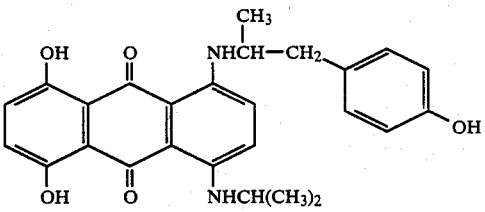

-continued
10
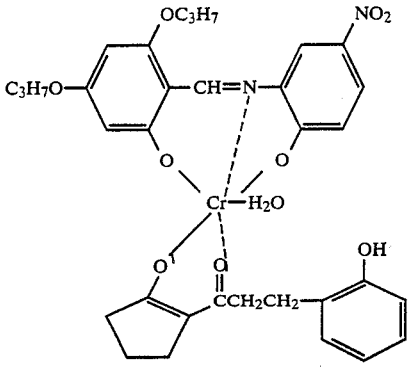
11
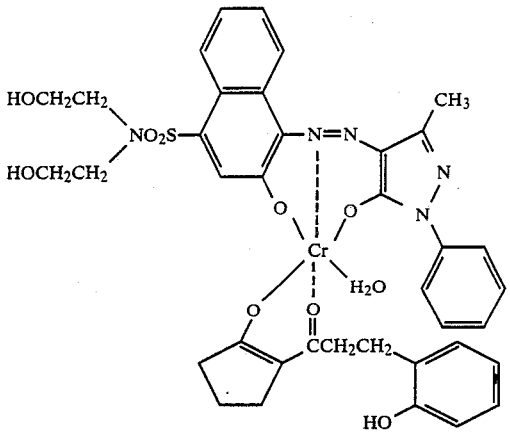
12
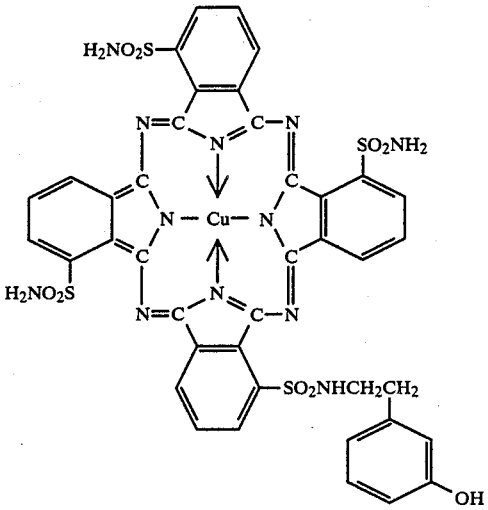
13
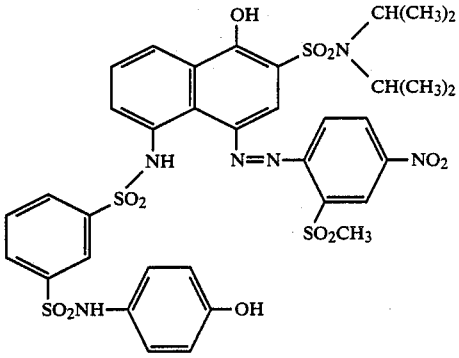
14
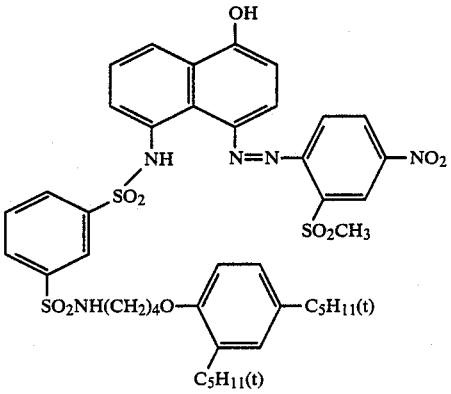
15
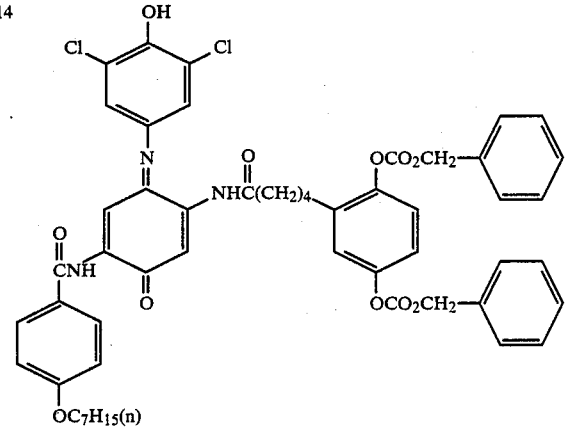
16
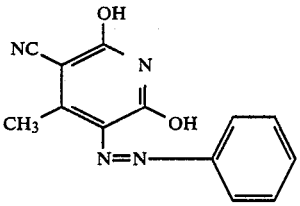
17
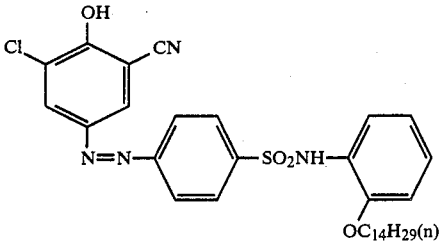

-continued
18
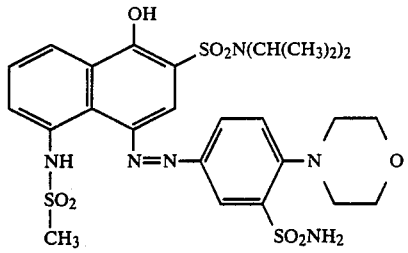
19
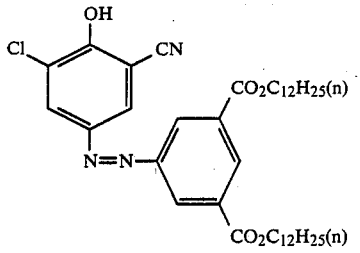
20
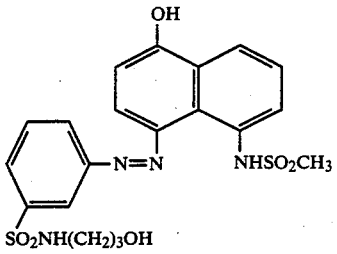
21
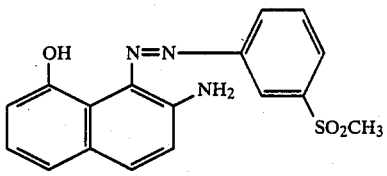
22
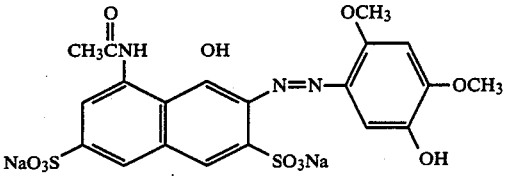
23
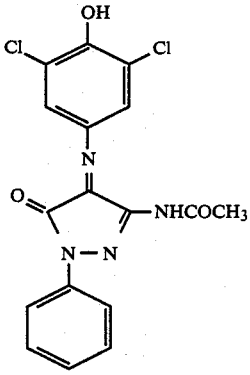
24
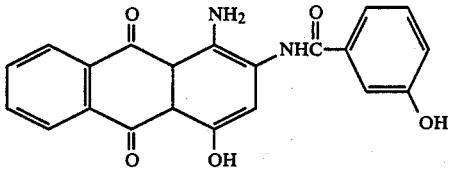
25
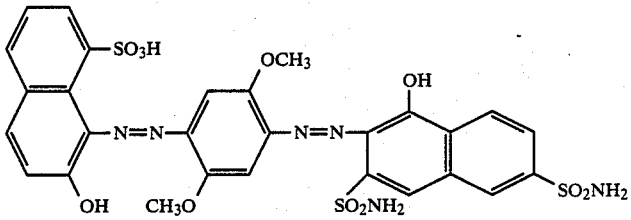
26
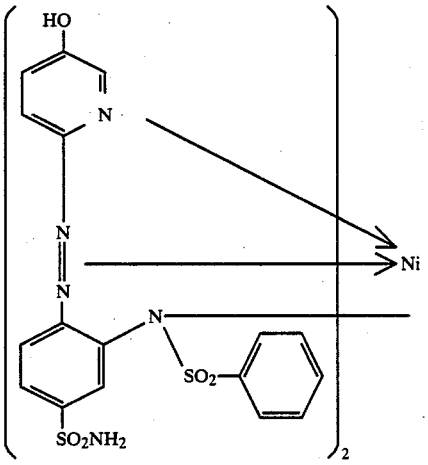
27
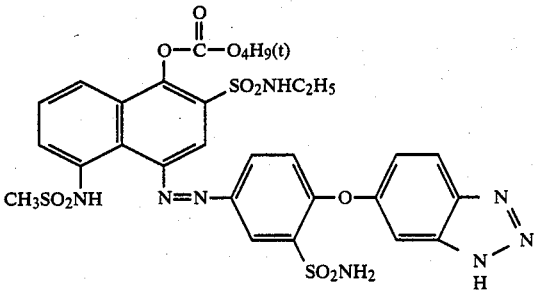

-continued
28
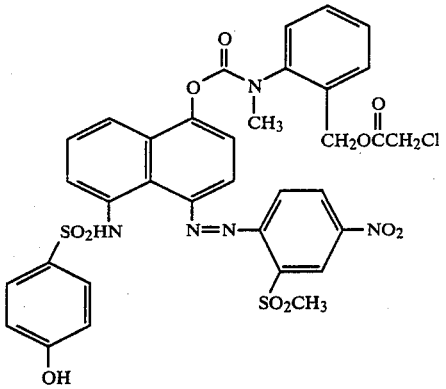
29
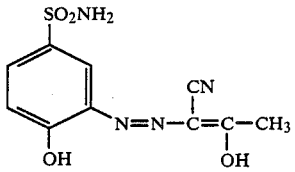
30
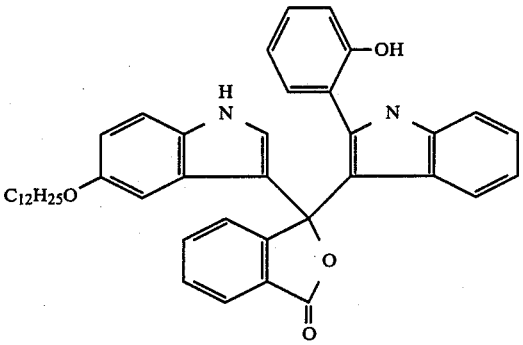
31
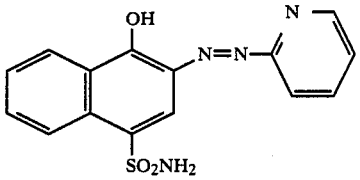
33
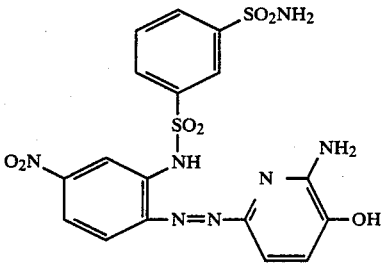
34
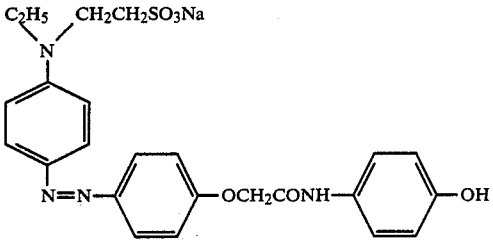
35
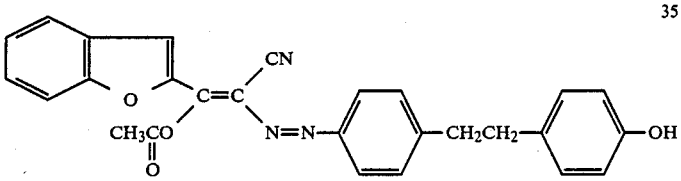
36
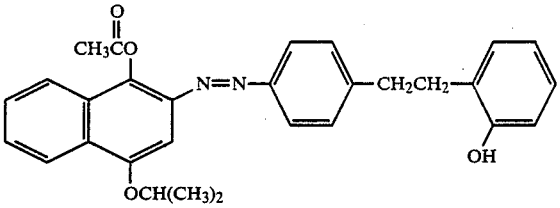

-continued
37
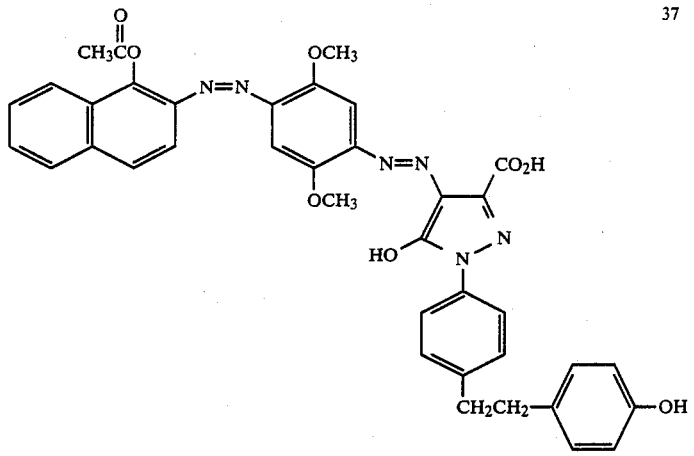
38
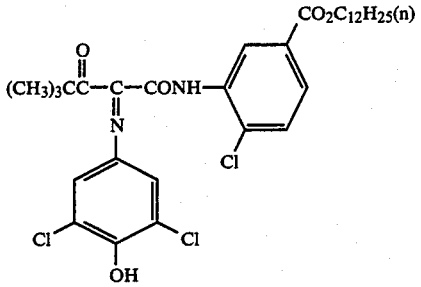
39
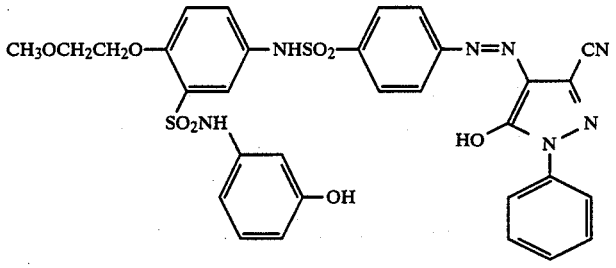
40
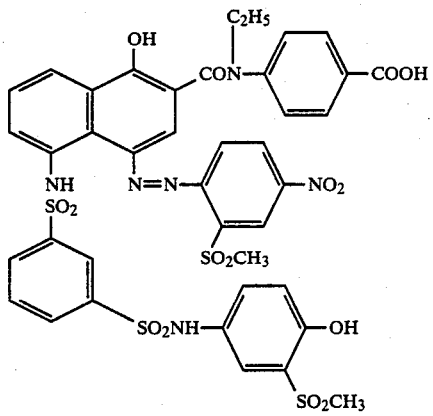
41
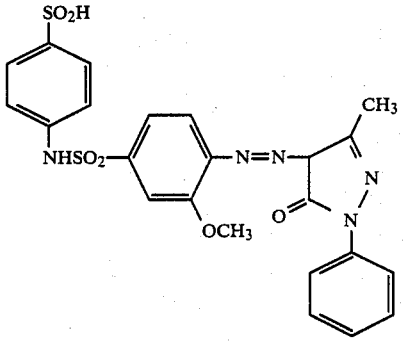

-continued

42

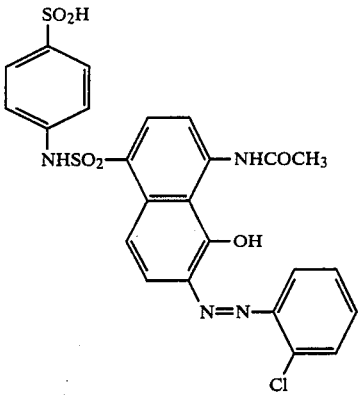

43

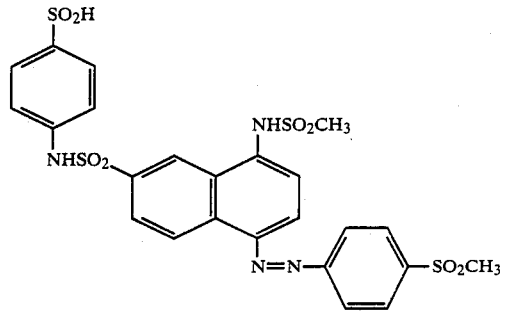

44

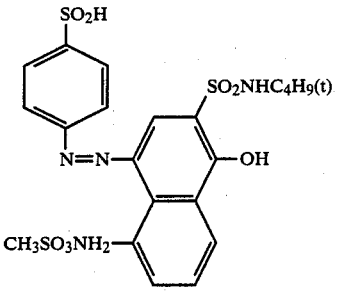

45

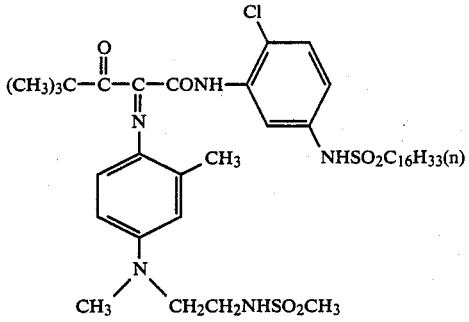

46

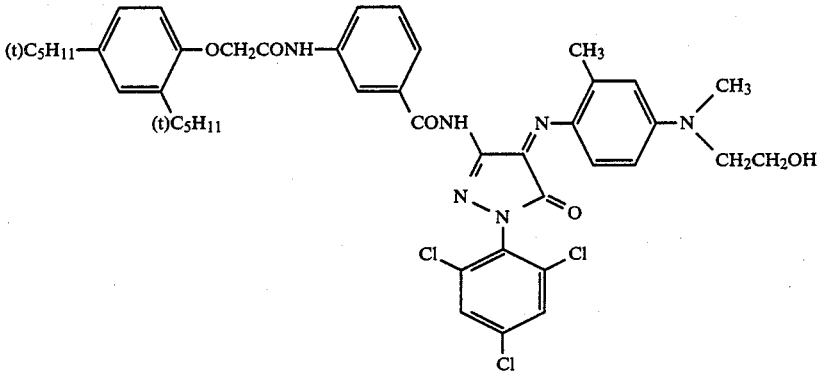

47

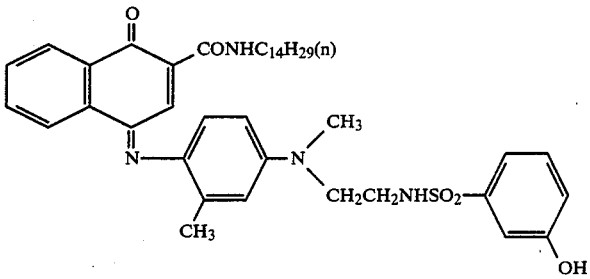

Specific examples of the compounds of formula (I) described above for use in this invention are shown below, but the scope of this invention is not limited to these compounds. In the following formulae, the bending solid line means a carbon chain having carbon atoms) at the corner(s) and the terminal(s) saturated with hydrogen atoms. For example,

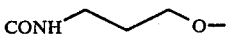

means a

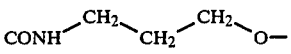

group,

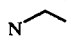
means a
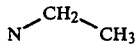
group, and
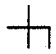
means a
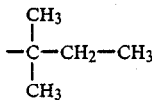
group, i.e., a —(t)$C_5H_{11}$ group, and so on.
I-1
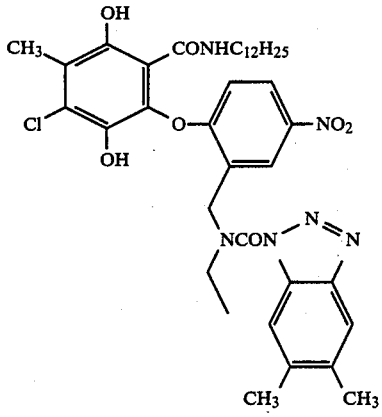
I-2
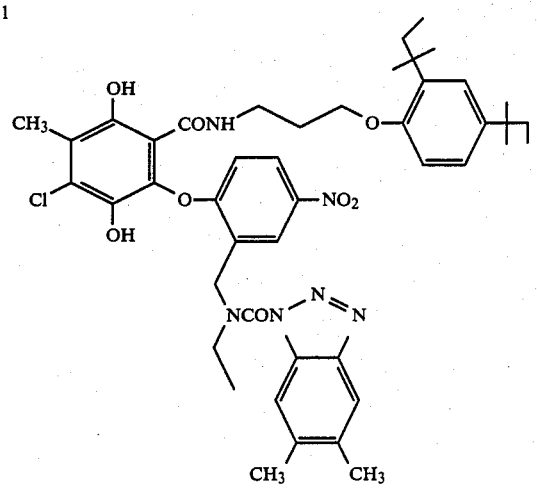
I-3
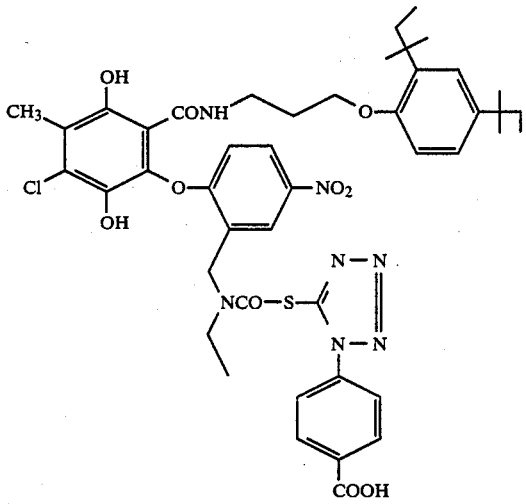
I-4
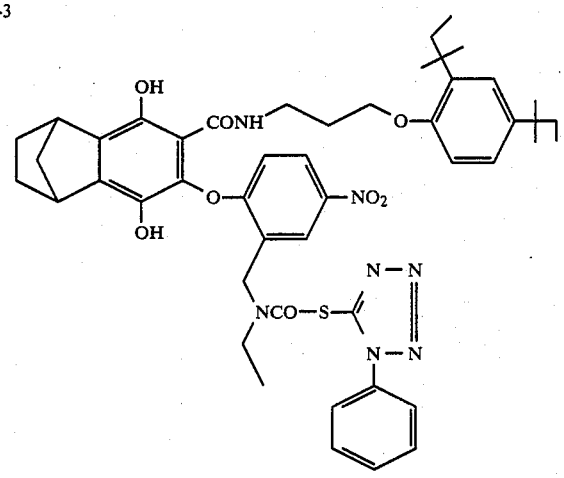

-continued
I-5
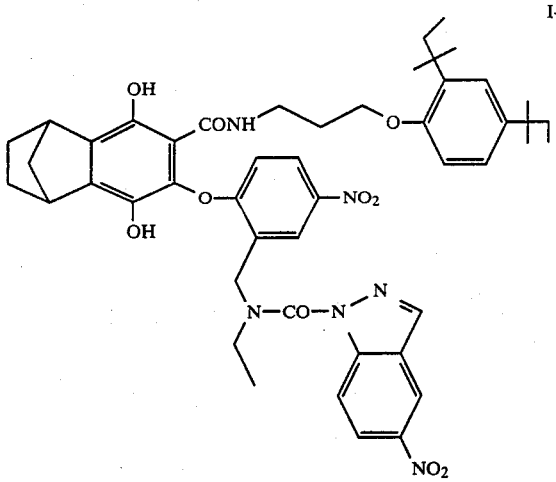
I-6
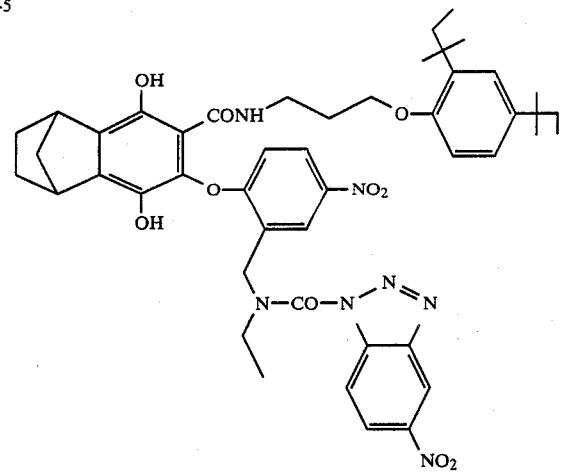
I-7
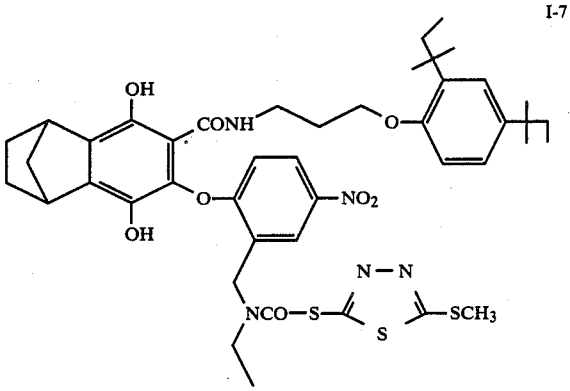
I-8
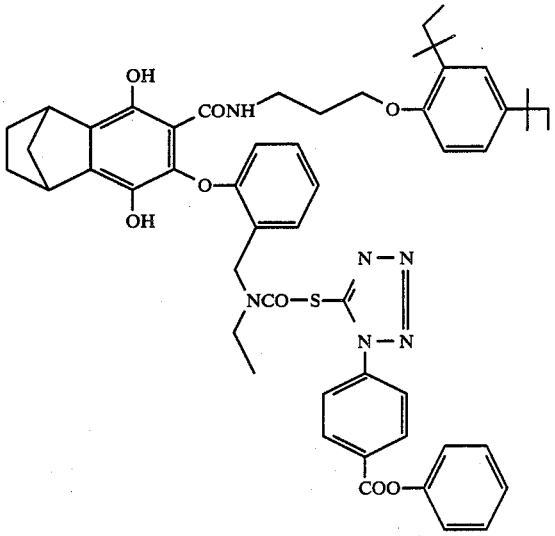
I-9
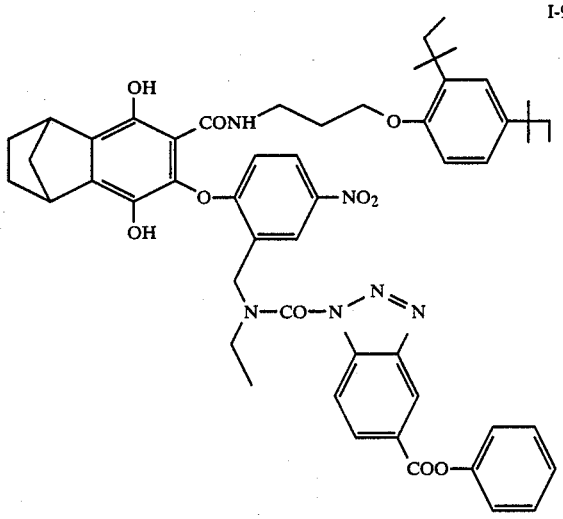
I-10
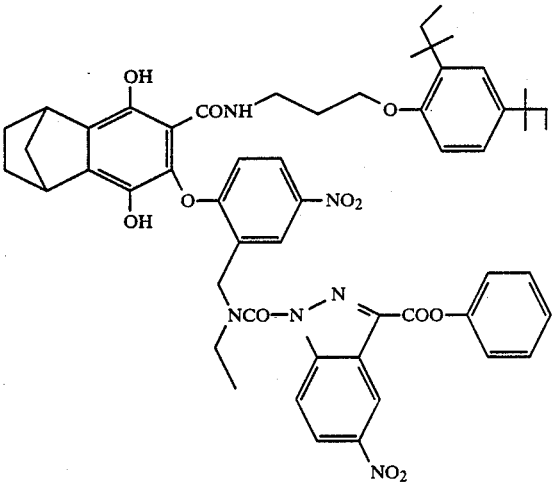

-continued
I-11
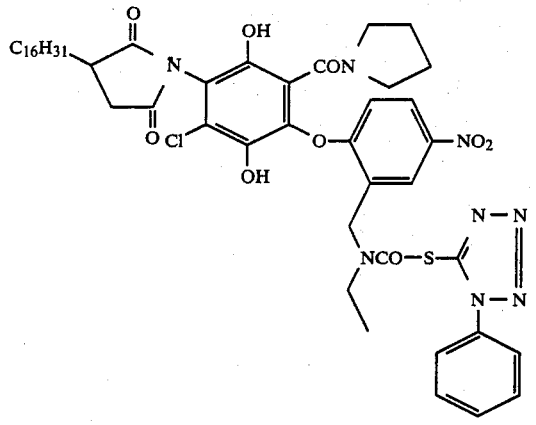
I-12
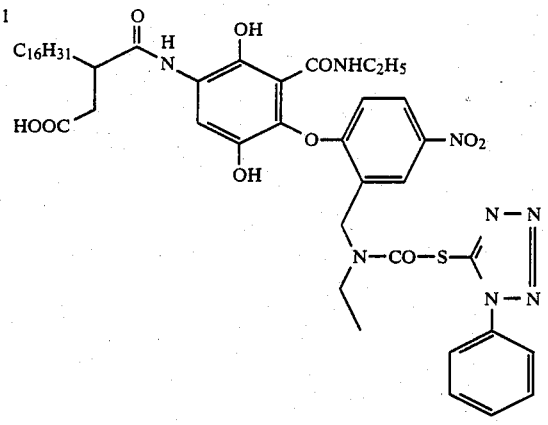
I-13
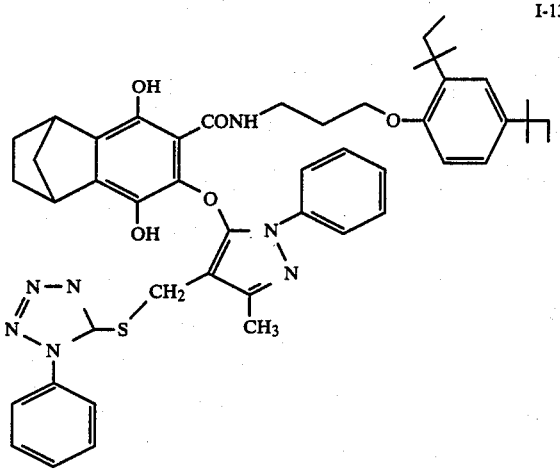
I-14
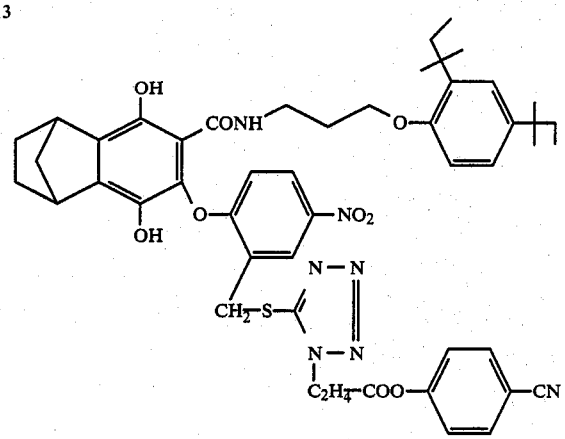
I-15
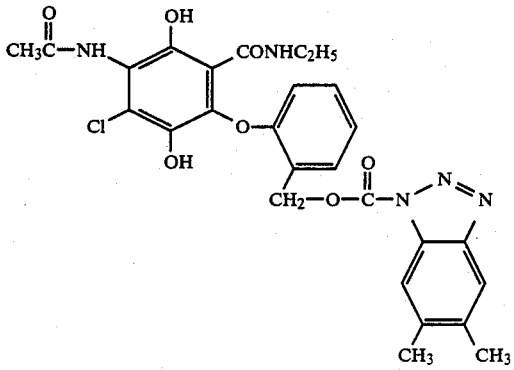
I-16
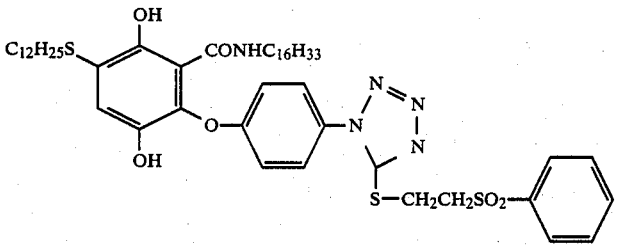

-continued
I-17
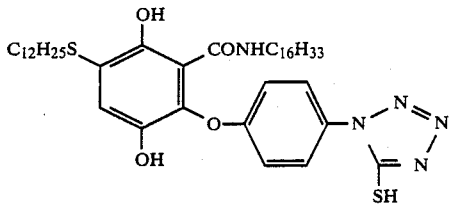
I-18
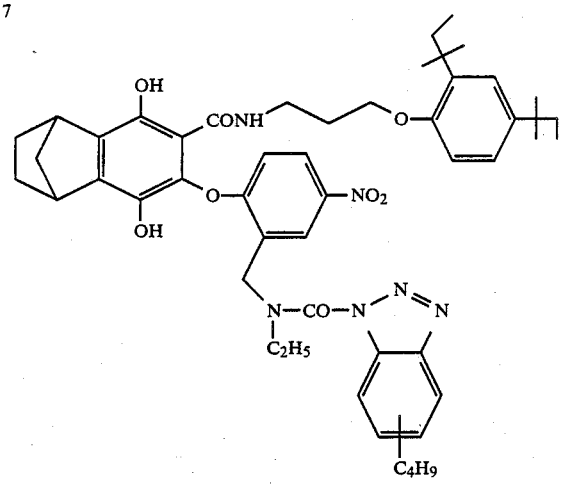
I-19
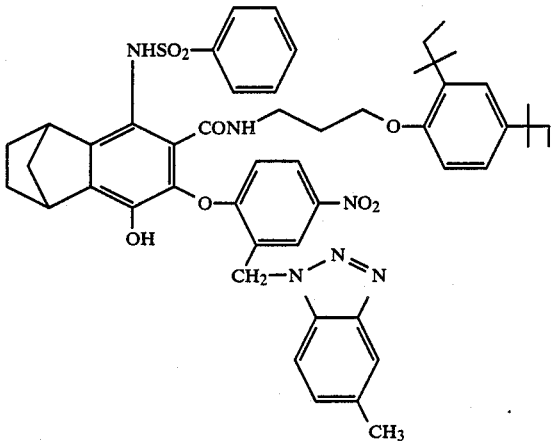
I-20
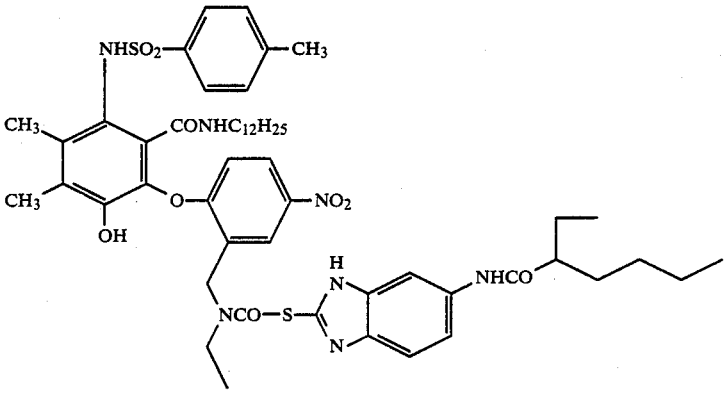

-continued
I-21
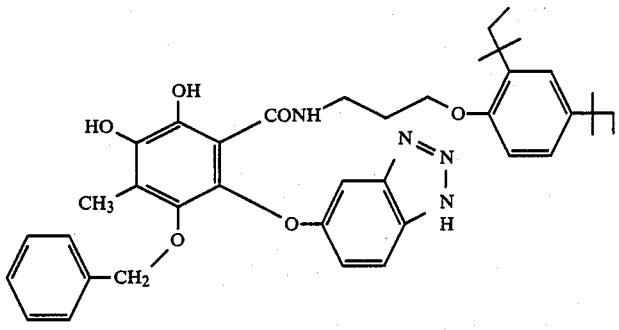
I-22
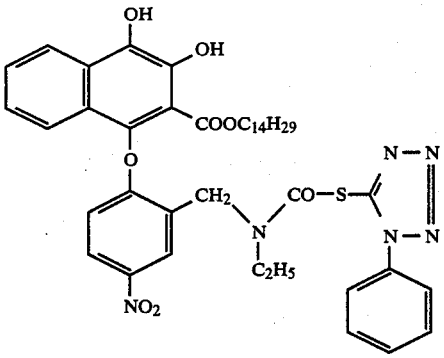
I-23
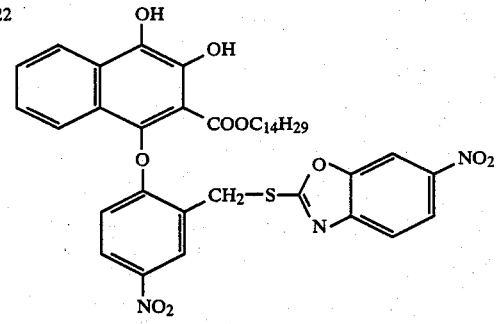
I-24
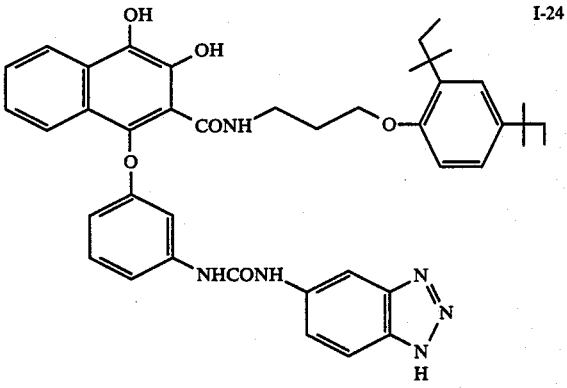
I-25
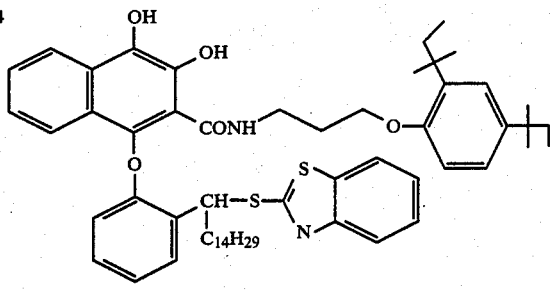
I-26
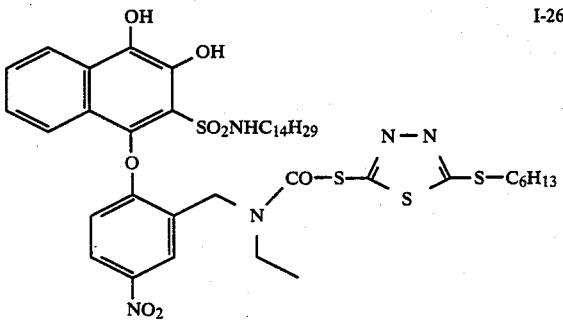
I-27
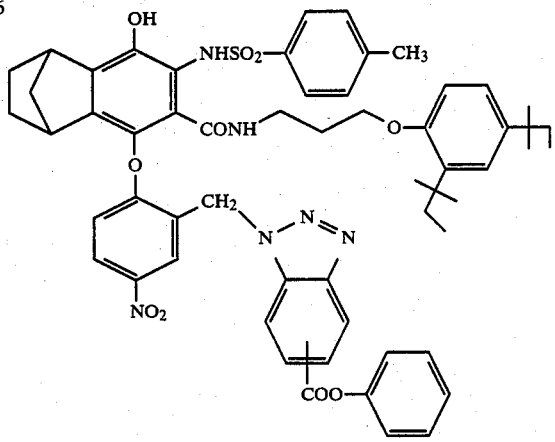

-continued
I-28
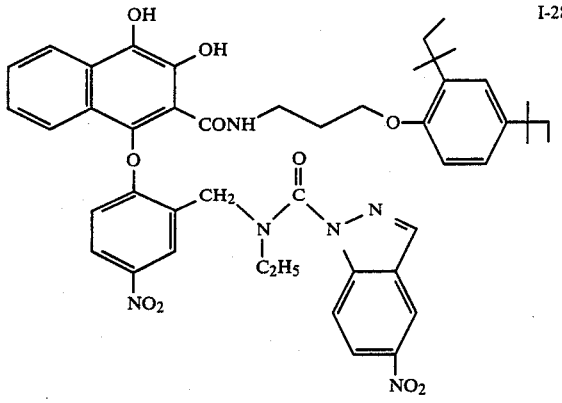
I-29
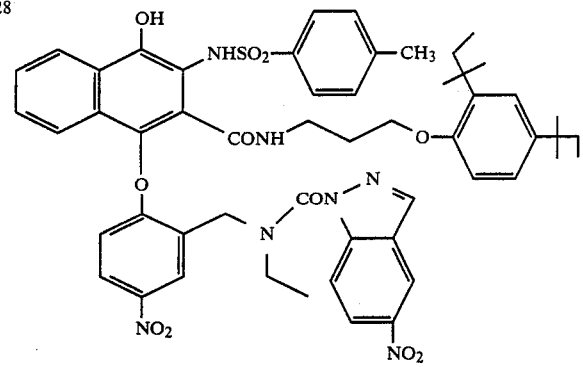
I-30
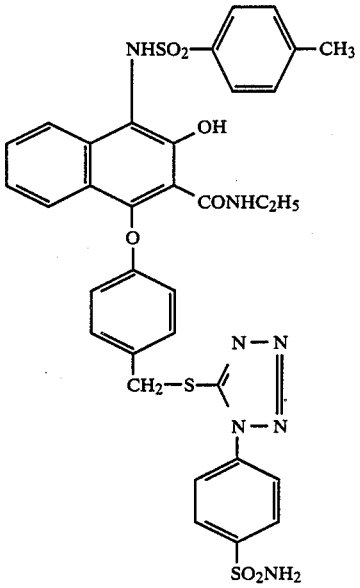
I-31
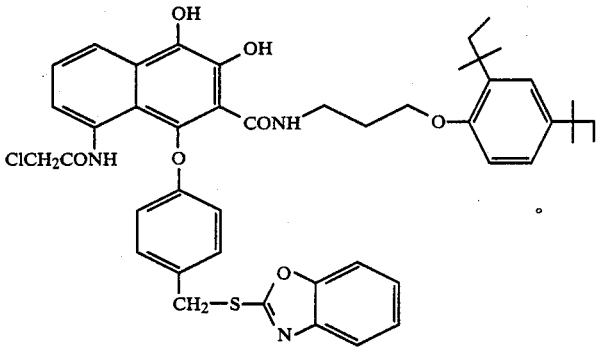

-continued
I-32
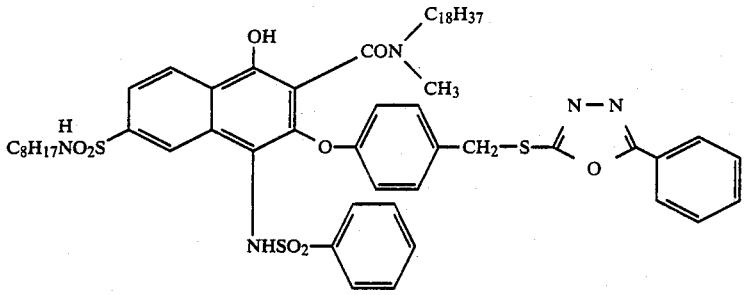
I-33
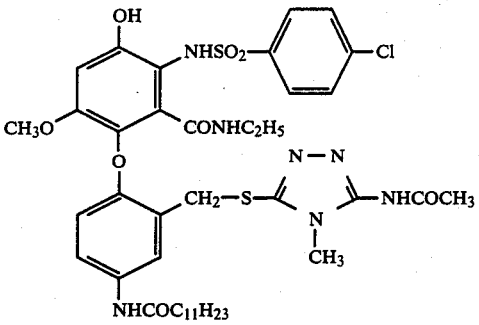
I-34
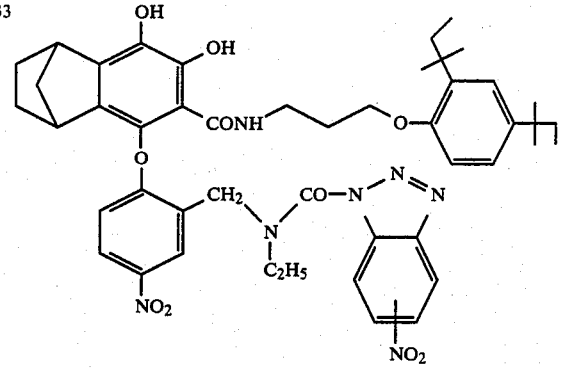
I-35
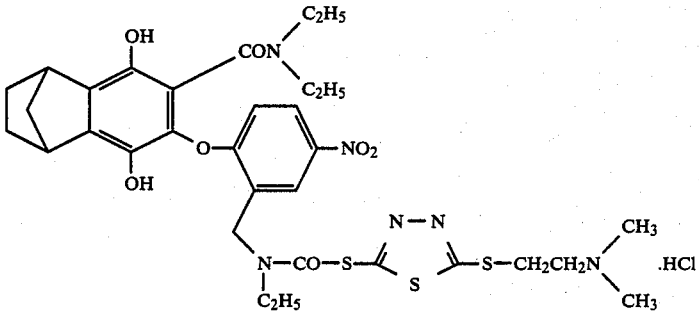
I-36
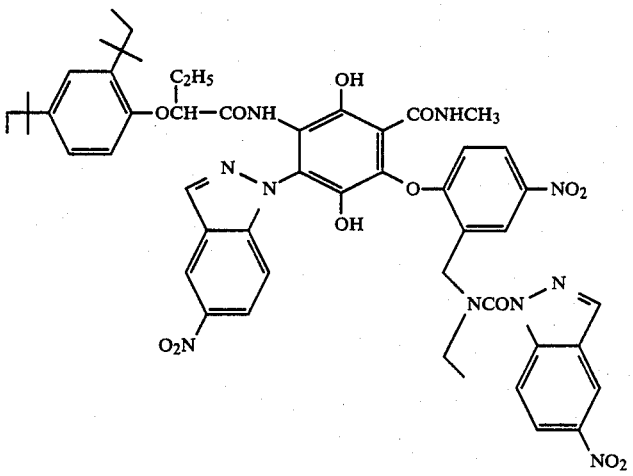

-continued
I-37
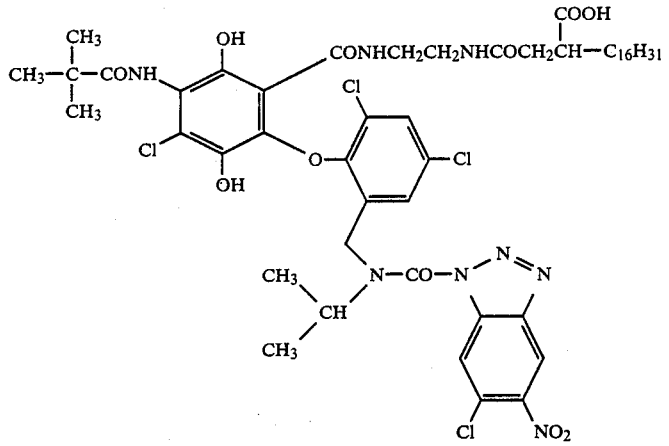
I-38
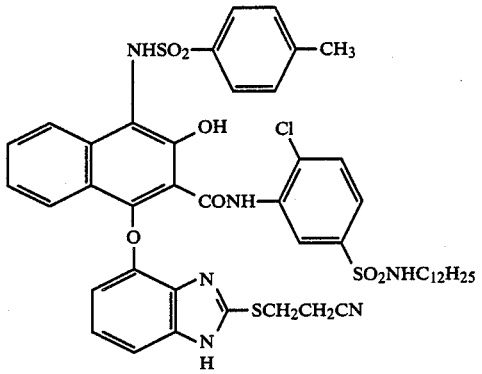
I-39
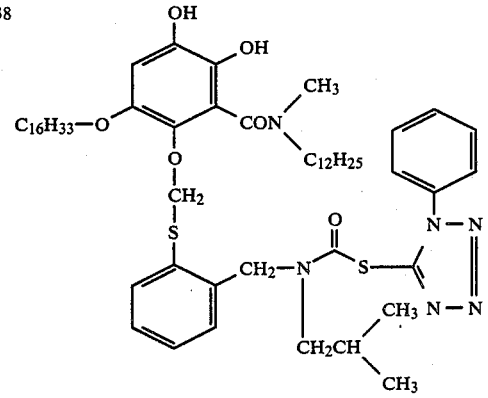
I-40
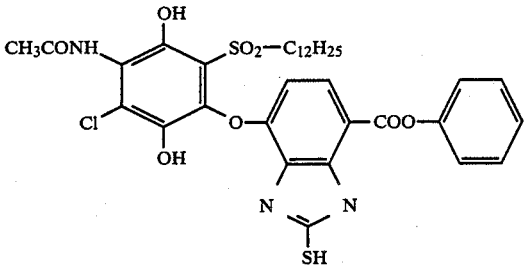
I-41
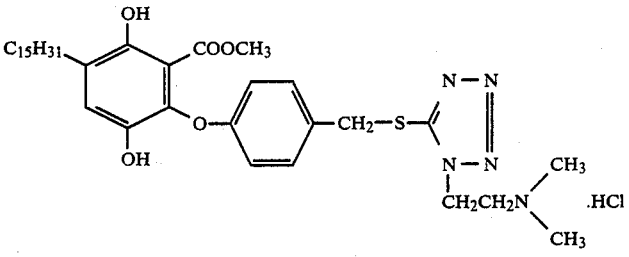

-continued
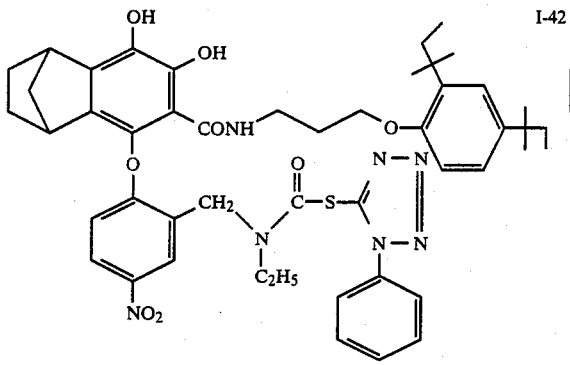
I-42
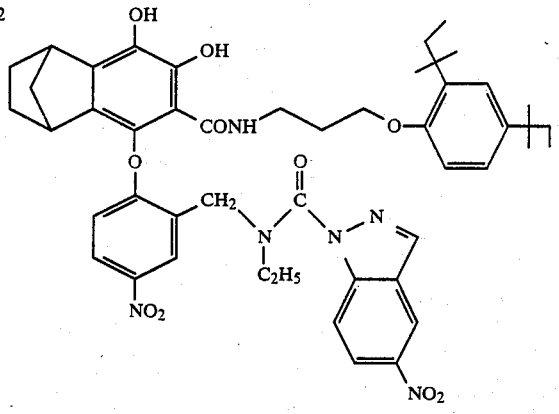
I-43
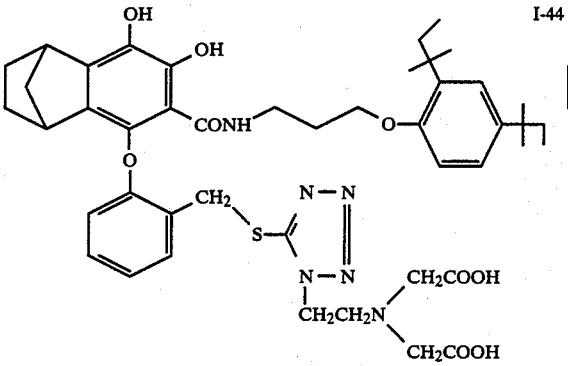
I-44
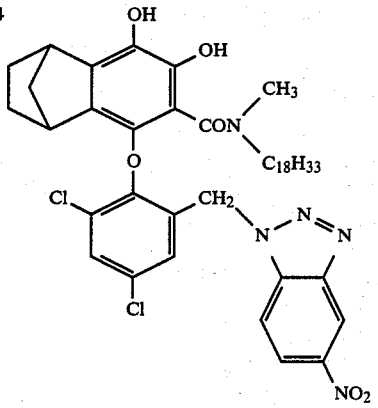
I-45
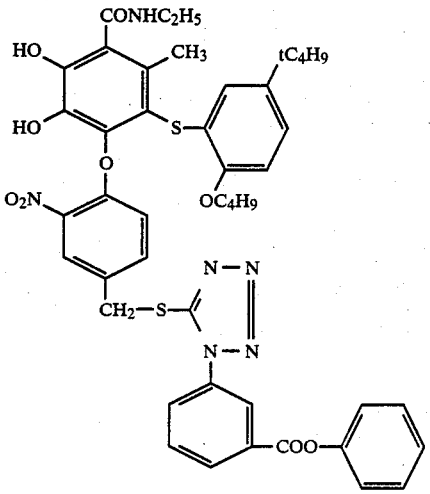
I-46

-continued
I-47
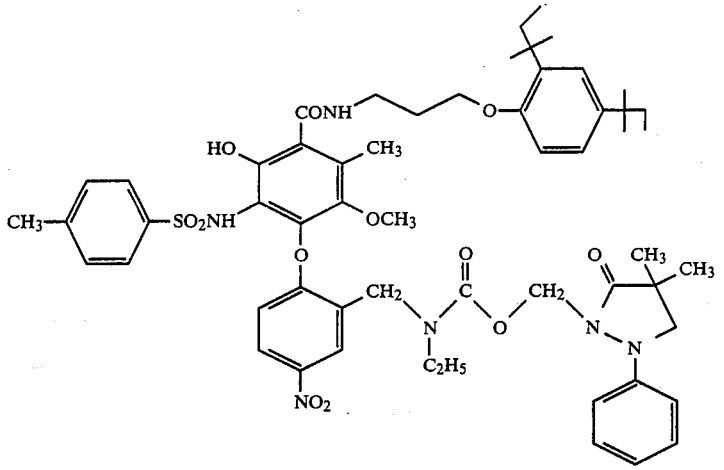
I-48
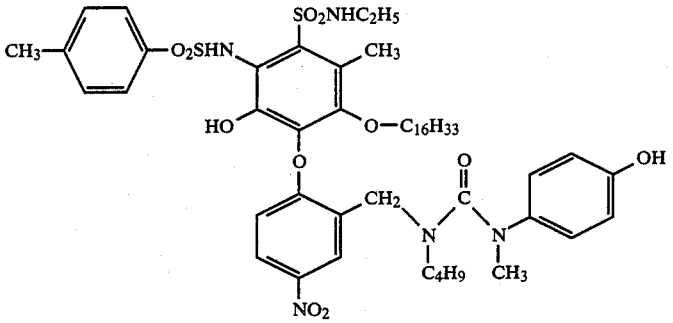
I-49
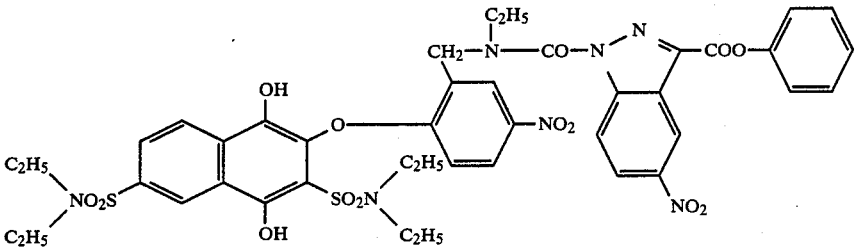
I-50
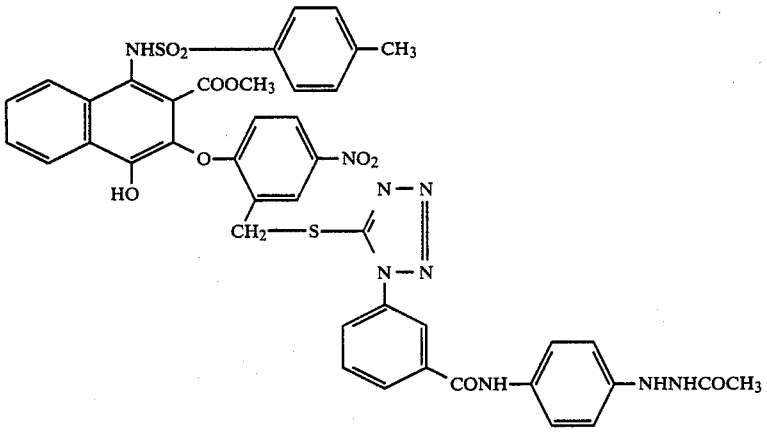

-continued
I-51
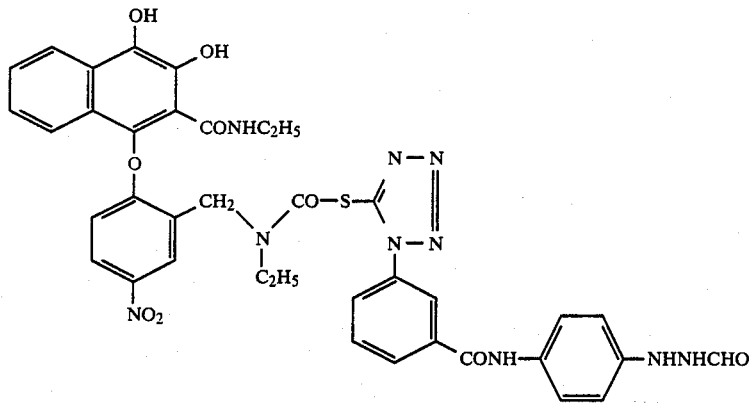
I-52
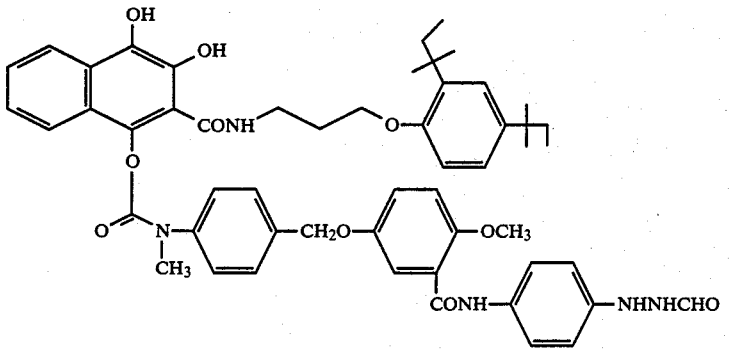
I-53
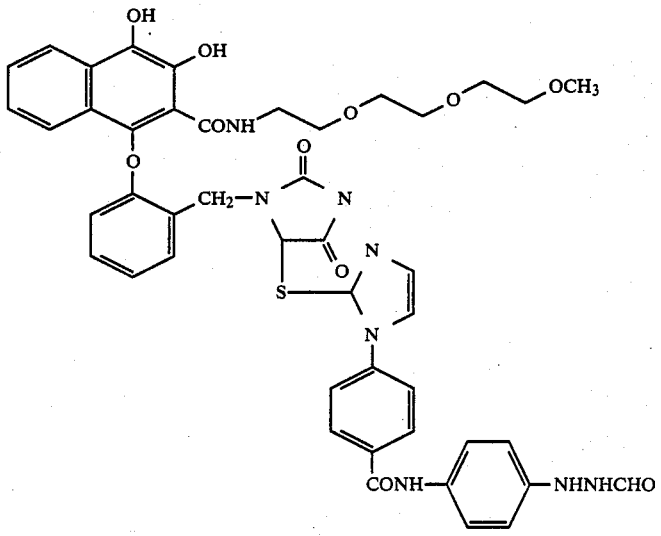

-continued
I-54
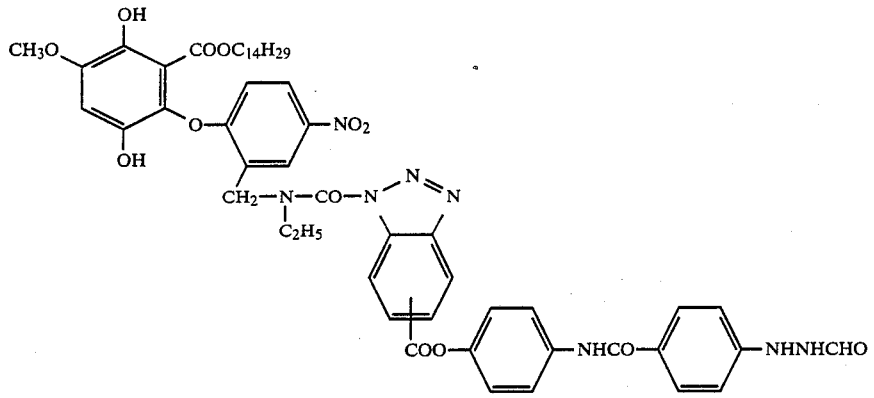
I-55
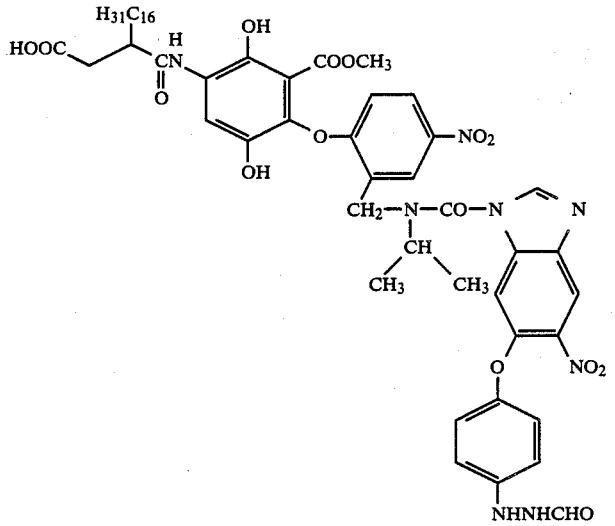
I-56
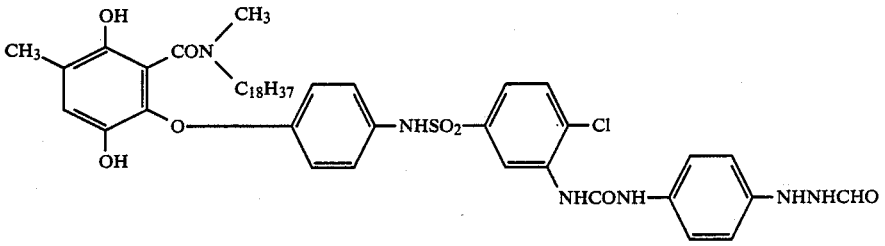
I-57
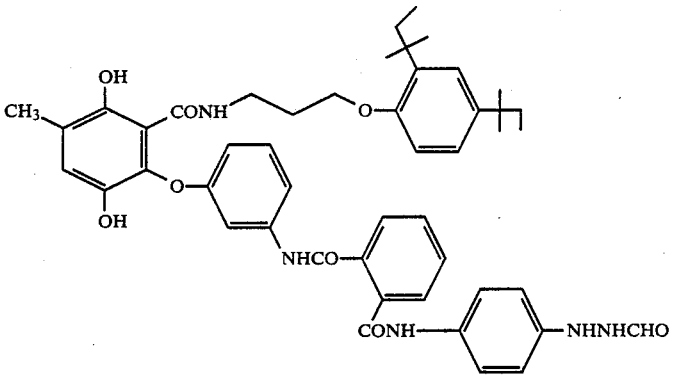

-continued
I-58
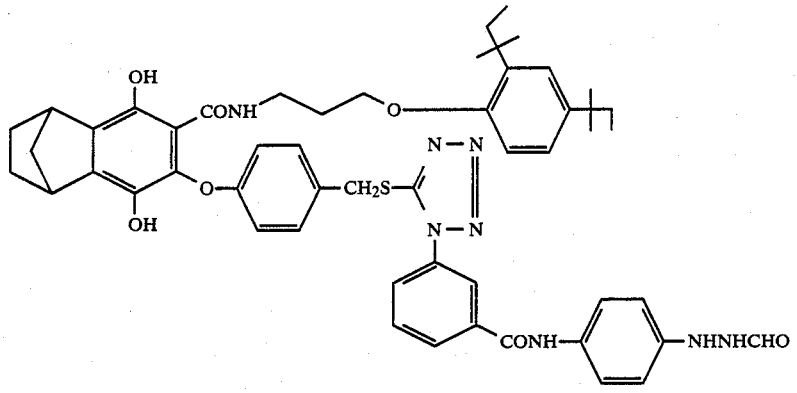
I-59
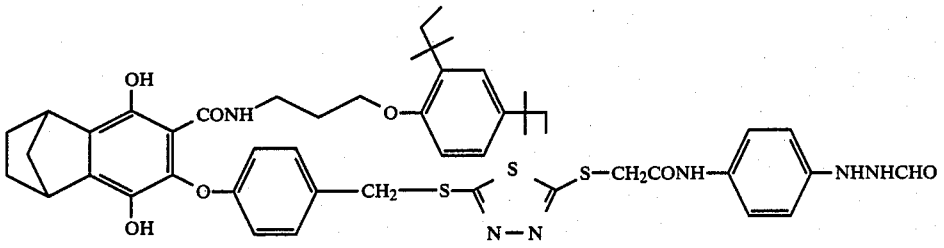
I-60
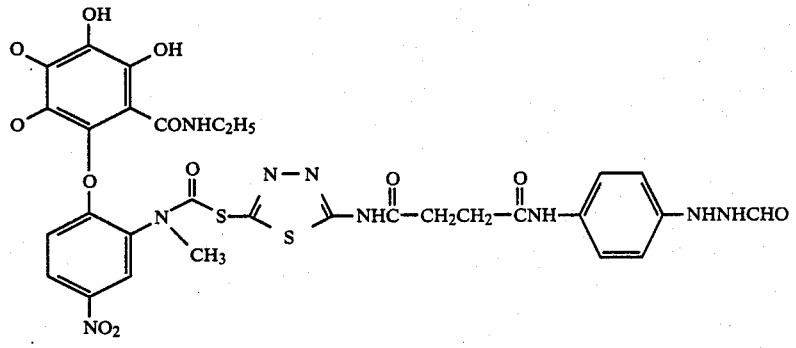
I-61
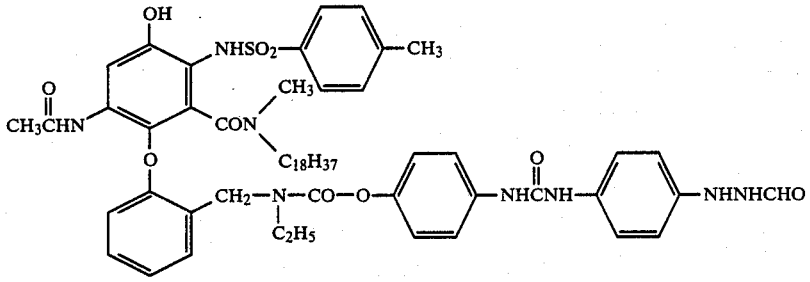

-continued

I-62

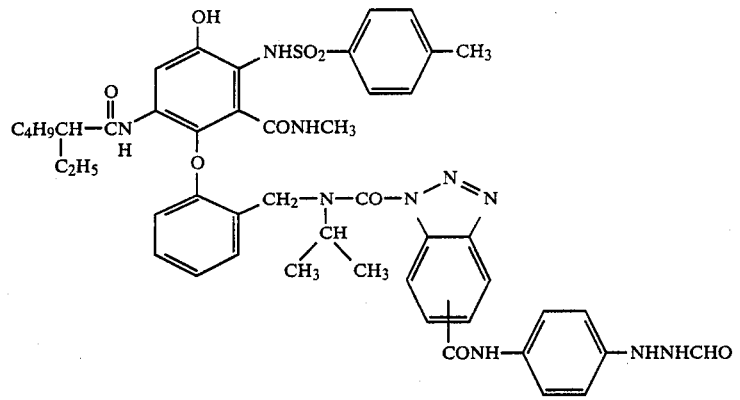

SYNTHESIS EXAMPLE 1

Synthesis of Compound I-5:

1-(1): Synthesis of 3,6-dihydroxybenzonorbornene-4-carboxylic acid:

A mixture of 81.8 g of 3,6-dihydroxybenzonorbornene, 260 g of potassium carbonate, and 400 ml of dimethylformamide was brought into contact with carbon dioxide at 50 kg/cm$^2$ in an autoclave to perform a reaction for 8 hours at 180° C.

After cooling the reaction mixture, water was added thereto and the mixture was acidified with hydrochloric acid. Then, ethyl acetate was added to the reaction mixture and the product thus formed was extracted. The organic layer formed was collected, washed with water, and then ethyl acetate was distilled off under reduced pressure. Then, hot water was added to the residue thus formed followed by stirring to provide 92.1 g of the crystals of 3,6-dihydroxybenzonorbornene-4-carboxylic acid with a yield of 90.2%.

1-(2): Synthesis of 3,6-dihydroxybenzonorbornene-4-carboxylic acid phenol ester:

By following the method described in Japanese Patent Application (OPI) No. 28139/78, the phenyl ester compound (oily) was obtained from 3,6-dihydroxybenzonorbornene-4-carboxylic acid.

1-(3): Synthesis of 3,6-dihydroxy-4-{3-(2,4-di-t-pentylphenoxy)propylcarbamoyl}benzonorbornene:

After mixing 14.8 g of the phenyl ester prepared in Step 1-(2) described above with 14.6 g of 3-(2,4-di-t-pentylphenoxy)propylamine, the reaction thereof was performed for 4 hours at reduced pressure of 20 mmHg under heating to 140° C. After cooling, the reaction mixture was crystallized from n-hexane to provide 15.1 g of 3,6-dihydroxy-4-{3-(2,4-di-t-pentylphenoxy)-propylcarbamoyl}benzonorbornene with a yield of 61.2%.

Melting point: 142° C.

1-(4): Synthesis of 3,6-dioxo-4-{3-(2,4-di-t-pentylphenoxy)propylcarbamoyl}-5-chlorobenzonorbornene:

In 60 ml of tetrahydrofuran was dissolved 4.9 g of the amide obtained in Step 1-(3) described above, and after adding 2.9 of N-chlorosuccinic acid imide to the solution, the reaction was performed for 6 hours. Thereafter, the solvent was distilled off from the reaction mixture thus obtained and then the product was purified by silica gel column chromatography to provide 5.0 g of 3,6-dioxo-4-{3-(2,4-di-t-pentylphenoxy)propylcarbamoyl}-5-chlorobenzonorbornene with a yield of 95.7%.

1-(5): Synthesis of 3,6-dihydroxy-4-{3-(2,4-di-t-pentylphenoxy)propylcarbamoyl}-5-{2-(N-ethyl-N-trifluoroacetylaminomethyl)-4-nitrophenoxy}benzonorbornene:

In ethyl acetate was dissolved 59.8 g of chloroquinone obtained in above Step 1-(4) and after adding 33.0 g of 2-(N-ethyl-N-trifluoroacetylaminomethyl)-4-nitrophenol and 23.9 g of potassium carbonate to the solution and the reaction was performed for 3 hours at room temperature. After the reaction was over, inorganic material was removed by filtration, and after adding an excessive amount of an aqueous solution of sodium hydrosulfite while cooling with ice water, the mixture was vigorously stirred. Five minutes later, stirring was stopped, and after acidifying the mixture by the addition of a small amount of hydrochloric acid, the organic layer thus formed was collected, washed with water, and dried by anhydrous sodium sulfate. Then, the solvent was distilled off from the reaction mixture and the product thus obtained was recrystallized from n-hexane to provide 78.1 g of 3,6-dihydroxy-4-{3-(2,4-di-t-pentylphenoxy)propylcarbamoyl}-5-{2-(N-ethyl-N-trifluoroacetylaminomethyl)-4-nitrophenoxy}benzonorbornene with a yield of 87.4%.

1-(6): Synthesis of 3-hydroxy-6-methoxy-4-{3-(2,4-di-t-pentylphenoxy)propylcarbamoyl}-5-{2-(N-ethyl-N-trifluoroacetylaminomethyl)-4-nitrophenoxy}benzonorbornene:

In acetone was dissolved 50.0 g of the hydroquinone compound prepared in above-described Step 1-(5), and, after adding 18.1 g of methyl iodide and 13.4 g of potassium carbonate to the solution, the mixture was refluxed for 5 hours.

After the reaction was over, inorganic material was removed by filtration, the solvent was distilled off from the reaction mixture, and the residue was purified by silica gel column chromatography, to provide 49.2 g of 3-hydroxy-6-methoxy-4-{3-(2,4-di-t-pentylphenoxy)-propylcarbamoyl}-5-{2-(N-trifluoroacetylaminomethyl)-4-nitrophenoxy}benzonorbornene as an oily product with a yield of 96.6%.

1-(7): Synthesis of 3-hydroxy-6-methoxy-4-{(3-(2,4-di-t-pentylphenoxy)propylcarbmoyl}-5-{2-(N-ethylaminomethyl)-4-nitrophenoxy}benzonorbornene:

In methanol was dissolved the methyl ether compound prepared in above Step 1-(6), and after adding an aqueous 2N potassium hydroxide solution to the solution, the reaction was performed for 5 hours at room temperature. After the reaction was over, the reaction mixture was neutralized and the product was extracted with ethyl acetate and dried with anhydrous sodium sulfate. After distilling off the solvent from the reaction product, the product was purified with alumina column chromatography to provide 41.0 g of 3-hydroxy-6-methoxy-4-{3-(2,4-di-t-pentylphenoxy)propylcarbamoyl}-5-(2-N-ethylaminomethyl-4-nitrophenoxy)-benzonorbornene as an oily product with a yield of 94.5%.

1-(8): Synthesis of 3-hydroxy-6-methoxy-4-{3-(2,4-di-t-pentylphenoxy)propylcarbamoyl}-5-[2-{N-(5-nitroindazol-1-ylcarbonyl)}-N-ethylaminomethyl-4-nitrophenoxy]benzonorbornene:

In acetonitrile was dissolved 14.0 g of the amine compound prepared in above Step 1-(7), and, after adding 2.4 g of triethylamine to the solution, the mixture was stirred under cooling with ice water to provide solution (A).

Apart from this, 6.5 g of 5-nitroindazole and 4.5 g of potassium t-butoxide were mixed with acetonitrile, and after adding 0.5 g of active carbon to the mixture, the resulting mixture was stirred at room temperature. To the mixture was dropwise added 7.9 g of trichloromethyl chloroformate. After performing reaction for one hour at room temperature, the reaction mixture was filtered under reduced pressure to remove active carbon, and then the solvent was distilled off under reduced pressure. Then, 50 ml of acetonitrile was added to the residue thus formed to provide solution (B).

Solution (B) was added dropwise slowly to solution (A) under ice water cooling, and thereafter the reaction was performed for 3 hours. Then, water was added to the reaction mixture and after distilling off acetonitrile at reduced pressure, ethyl acetate was added to the residue formed to perform extraction. The organic layer thus formed was collected, dried with anhydrous sodium sulfate, and after distilling off the solvent, the product thus formed was purified with silica gel column chromatography to provide 9.0 g of an oily product with a yield of 50.5%.

1-(9): Synthesis of 3,6-dihydroxy-4-{3-(2,4-di-t-pentylphenoxy)propylcarbamoyl}-5-[2-{N-(5-nitroindazol-1-ylcarbonyl)}-N-ethylaminomethyl-4-nitrophenoxy]benzonorbornene:

In anhydrous acetonitrile was dissolved 7.0 g of the compound prepared in above Step 1-(8) and after adding 4.0 g of sodium iodide to the solution, 3.0 g of trimethylchlorosilane was added dropwise to the mixture. After conducting the reaction for 15 hours at room temperature, water was added to the reaction mixture, and then acetonitrile was distilled off. Then, ethyl acetate was added to the residue thus formed, and the product was extracted. The organic layer thus obtained was collected, dried by anhydrous sodium sulfate, and the solvent was distilled off. The residue thus formed was carefully separated by silica gel column chromatography, and the solvent was distilled off from the product thus obtained to provide 3.5 g of 3,6-dihydroxy-4-{3-(2,4-di-t-pentylphenoxy)propylcarbamoyl}-5-{[N-(5-nitroindazol-1-ylcarbonyl)}-N-ethylaminomethyl-4-nitrophenoxy]benzonorbornene (Compound I-5) as fine yellow solids, with a yield of 50.8%.

Melting point: 106° to 109° C.

SYNTHESIS EXAMPLE 2

Synthesis of Compound I-18:

2-(1): Synthesis of 3-hydroxy-6-methoxy-4-{3-(2,4-di-t-pentylphenoxy)propylcarbamoyl}-5-[2-{N-(5-n-butylbenzotriazol-1-ylcarbonyl)}-N-ethylaminomethyl-4-nitrophenoxy]benzonorbornene:

In acetonitrile was dissolved 7.0 g of the amine compound prepared in Step 1-(7) of Synthesis of Example 1 and after adding 1.2 g of triethylamine to the solution, the mixture was stirred under ice water cooling to provide solution (C).

On the other hand, 1.8 g of 5-n-butyl benzotriazole and 1.2 g of potassium t-butoxide were mixed with acetonitrile and after adding thereto 0.3 g of active carbon, the resulting mixture was stirred at room temperature. Then 2 g of trichloromethyl chloroformate was added dropwise to the mixture. After conducting the reaction for one hour at room temperature, the reaction mixture was filtered to remove inorganic matters to provide solution (D).

Solution (D) was slowly added dropwise to solution (C) and thereafter, the reaction was performed for 3 hours. After the reaction was over, water, and ethyl acetate were added to the reaction mixture. The organic layer thus formed was collected, dried by anhydrous sodium sulfate, and the solvent was distilled off. The residue thus formed was purified by silica gel column chromatography to provide 4.7 g of an oily product with a yield of 51.9%.

2-(2): Synthesis of 3,6-dihydroxy-4-{3-(2,4-di-t-pentylphenoxy)propylcarbamoyl}-5-[2-{N-(5-n-butylbenzotriazol-1-ylcarbonyl)}-N-ethylaminomethyl-4-nitrophenoxy]benzonorbornene:

In anhydrous acetonitrile was dissolved 4.7 g of the compound prepared in above Step 2-(1) and after adding 1.6 g of sodium iodide to the solution, 3.0 g of trimethylchlorosilane was added dropwise to the mixture. After conducting the reaction for 20 hours at room temperature, water and ethyl acetate were added thereto for extraction. The organic layer thus formed was collected, washed with water, and dried over anhydrous sodium sulfate. Then, the solvent was distilled off and the residue thus obtained was carefully separated by silica gel column chromatography. Then, the solvent was distilled off to obtain 2.1 g of 3,6-dihydroxy-4-{3-(2,4-di-t-pentylphenoxy)propylcarbamoyl}-5-[2-{N-(5-n-butylbenzotriazol-1-ylcarbonyl)}-N-ethylaminomethyl-4-nitrophenoxy]benzonorbornene (Compound I-18) as colorless solids with a yield of 45.4%.

Melting point: 98° to 100° C.

SYNTHESIS EXAMPLE 3

Synthesis of Compound I-84:

3-(1): Synthesis of 3,6-dihydroxy-4-{3-(2,4-di-t-pentylphenoxy)propylcarbamoyl}-5-(4-nitrophenoxy)benzonorbornene:

In acetone was dissolved in 14.0 g of the chloroquinone prepared in above Step 1-(4) and, after adding 2.0 g of potassium carbonate and 3.4 g of 4-nitrophenol to the solution, the mixture was stirred for 2.5 hours at room temperature.

After the reaction was over, inorganic material was removed by filtration, and then acetone was distilled off from the reaction mixture. Then, the residue thus formed was dissolved in ethyl acetate, and after adding thereto an excessive amount of an aqueous solution of sodium hydrosulfite, the mixture was vigorously stirred for 5 minutes. Then, stirring was stopped, and after acidifying the reaction mixture with a small amount of hydrochloric acid, the organic layer thus formed was collected, washed with water, and dried over anhydrous sodium sulfate. Then, the product was recrystallized from n-hexane to provide 13.0 g of 3,6-dihydroxy-4-{3-(2,4-di-t-pentylphenoxy)propylcarbamoyl}-5-(4-nitrophenoxy)benzonorbornene with a yield of 82.5%.

3-(2): Synthesis of 3,6-diacetoxy-4-{3-(2,4-di-t-pentylphenoxy)propylcarbamoyl}-5-(4-nitrophenoxy)benzonorbornene:

In 150 ml of acetonitrile was dissolved 20 g of the hydroquinone compound prepared in above Step 3-(1) and after adding 50 ml of acetic anhydride and 50 ml of pyridine to the solution, the reaction was performed for 4 hours at room temperature. Then, the solvent was distilled off under reduced pressure, the residue thus formed was dried, and then extracted with water and ethyl acetate. The organic layer was collected, washed successively with diluted hydrochloric acid, water, and a saturated aqueous solution of sodium hydrogencarbonate, and then dried over anhydrous sodium sulfate. After distilling off the solvent, the residue was purified using a short silica gel column and an eluent of hexane-ethyl acetate to provide 20.0 g of the desired product with a yield of 88.3%.

3-(3): Synthesis of 3,6-diacetoxy-4-{3-(2,4-di-t-pentylphenoxy)propylcarbamoyl}-5-(4-aminophenoxy)benzonorbornene:

A mixture of 8.8 g of the diacetoxy compound prepared in above Step 3-(2), 100 ml of isopropyl alcohol, 10 ml of water, and 0.5 g of ammonium chloride was stirred at 60° C. To the mixture was added 10 g of reduced iron in a divided state while maintaining the mixture at about 70° C. After conducting the reaction for 3 hours at 70° C., the reaction mixture thus obtained was cooled and, after removing inorganic material by filtration, the solvent was distilled off. Then, to the residue thus formed were added water and ethyl acetate to perform extraction. The organic layer thus formed was collected, dried over anhydrous sodium sulfate, the solvent was distilled off, and the residue was purified by short silica gel column chromatography to provide 8.4 g of the desired product with a yield of 99.7%.

3-(4): Synthesis of 3,6-dihydroxy-4-{3-(2,4-di-t-pentylphenoxy)propylcarbamoyl}-5-[4-{4-(1-phenyl-3-cyano-5-hydroxypyrazol-4-ylazo)phenylsulfonylamino}phenoxy]benzonorbornene:

In chloroform was dissolved 8.4 g of the compound prepared in above Step 3-(3) and after adding 1.5 ml of pyridine to the solution, the mixture was stirred at room temperature. To the solution was added 4.7 g of 4-(1-phenyl-3-cyano-5-hydroxypyrazol-4-isoazo)benzenesulfonyl chloride and after performing reaction for 1.5 hours, the solvent was distilled off from the reaction mixture. Then, 50 ml of methanol was added to the residue thus formed and after adding thereto 17.0 g of hydroxylamine hydrochloride and 16.0 g of sodium acetate, the reaction was performed for 3 hours at room temperature. After the reaction was over, about 90% the solvent was distilled off and then ethyl acetate and water were added thereto for extraction. The organic layer thus formed was collected, washed with an aqueous saturated sodium hydrogencarbonate solution, further washed with water, diluted hydrochloric acid, and then water, and dried by anhydrous sodium sulfate. Then, the solvent was distilled off and the residue thus formed was recrystallized from methanol to provide 5.9 g of Compound I-84 with a yield of 50.5%.

Melting point: 213° to 215° C.

Now, the compound for use in this invention shown by formula (I) above is cross-oxidized by causing a redox reaction with the oxidation product of a developing agent or an auxiliary developing agent imagewise formed during development. Or, it is assumed that the compound of formula (I) itself is oxidized by directly reducing silver salt to imagewise release the photographically useful material, and is converted into a colorless oxidation product.

The aforesaid compound for use in this invention imagewise releases a photographically useful group quickly and with good timing and good efficiency and hence the compound can be widely used. For example, if the compound releases a development inhibitor, the development is imagewise inhibited to show DIR effects such as softening the tone of images, the improvement of sharpness of images, and the improvement of color reproducibility. Also, if the compound releases a diffusible dye or a non-diffusible dye, the formation of color images can be achieved.

The compound of formula (I) for use in this invention shows very desirable photographic effects by showing high activity and functioning with good efficiency as compared with conventionally known compounds showing similar actions as described hereinafter.

For obtaining the desired effect, the compound for use in this invention is incorporated in a silver halide emulsion layer and/or hydrophilic colloid layer disposed on or under the silver halide emulsion layer.

In the case of using the compound of formula (I) for the above-described various purposes, it is necessary to select an appropriate releasing group PUG according to the particular purpose, and the addition amount of the compound depends upon the kind of a photographic light-sensitive material and the nature of the PUG selected, but is generally from $1\times10^{-7}$ mole to $1\times10^{3}$ mole per mole of silver halide.

For example, when PUG is a development inhibitor, it is preferred that the compound of this invention is used in an amount of from $1\times10^{-7}$ mole to $1\times10^{-1}$ mole, and particularly preferably from $1\times10^{-6}$ mole to $5\times10^{-2}$ mole per mole of silver halide. Also, when PUG is a development inhibitor and a fogging agent, the addition amount is preferably the amount same as those in the case of development inhibitor described above When PUG is a dye and is used for image formation, it is predetermined that the compound of this invention is used in an amount of from $1\times10^{-3}$ mole to $1\times10$ mole, and particularly preferably from $1\times10^{-2}$ mole to 4 moles per mole of silver halide.

The compound of formula (I) is incorporated in a silver halide emulsion layer and/or other hydrophilic colloid layer by a conventional method. That is, if the compound is soluble in water, the compound may be added to an aqueous gelatin solution as a solution thereof dissolved in water. Also, if the compound is insoluble in water or sparingly soluble in water, the compound is dissolved in a solvent compatible with water, and then mixed with an aqueous gelatin solution, or may be added by the method described, for example, in U.S. Pat. No. 2,322,027. For example, the compound is dissolved in a high-boiling organic solvent such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), aliphatic acid esters (e.g., dibutoxyethyl succinate, diethyl azerate, etc.), trimesic acid esters (e.g., tributyl trimesate, etc.), etc., or in a low-boiling organic solvent having boiling point of about 30° C. to 150° C., such as ethyl acetate, butyl acetate, ethyl propionate, secondary butyl alcohol, methyl isobutyl ketone, β-ethoxyethyl acetate, methylcellosolve acetate, etc., and then dispersed in an aqueous hydrophilic colloid solution as the solution. In this case, a mixture of the above-described high-boiling organic solvent and low-boiling organic solvent may be used.

The compound of formula (I) for use in this invention may be dispersed in an aqueous hydrophilic colloid solution together with a reducing material such as hydroquinone or a derivative thereof, a catechol or a derivative thereof, an aminophenol or a derivative thereof, and ascorbic acid or a derivative thereof.

For the photographic emulsion layers of the photographic light-sensitive materials of this invention, silver bromide, silver iodobromide, silver iodochloro-bromide, silver chlorobromide, or silver chloride may be used as a photosensitive silver halide.

There is no particular restriction about the grain sizes of the silver halide in the photographic emulsions but it is preferred that the mean grain size (shown by the mean value based on the projected area using the diameters of grains when the silver halide grains are sphere or similar to sphere, or the edge lengths when the grains are cubic grains as the grain sizes) is less than 3 μm.

The grain size distribution may be narrow (so-called "mono-dispersed" emulsion) or broad.

The silver halide grains in the photographic emulsions may have a regular crystal form such as cube, octahedron, tetradecahedron, and rhombic dodecahedron or an irregular crystal form such as sphere and a tabular form, or further may be a composite form of these crystal forms. Moreover, the silver halide grains may be a mixture of silver halide grains having various crystal forms.

Also, a silver halide emulsion wherein super tabular silver halide grains having a diameter of the grains larger than 5 times the thickness thereof occupies more than 50% of the total projected area may be used. These silver halide emulsions are described in detail in Japanese Patent Application (OPI) Nos. 127921/83, 113927/83, etc.

The silver halide grains for use in this invention may have different phase between the inside thereof and the surface layer thereof. Also, they may be the grains mainly forming a latent image on the surfaces thereof or grains mainly forming a latent image in the insides thereof.

The photographic silver halide emulsion for use in this invention can be prepared using the method described in P. Grafkides, *Chimie et Physique Photographique,* published by Paul Montel Co., 1967; G. F. Duffin, *Photographic Emulsion Chemistry,* published by The Focal Press, 1966; V. L. Zelikman et al, *Making and Coating Photographic Emulsion,* published by The Focal Press, 1964, etc.

That is, an acid method, a neutralization method, an ammonia method, etc., may be used and as a system for reacting a soluble silver salt and a soluble halide, a single jet method, a double jet method, or a combination of these methods may be used.

Also, a so-called back mixing method for forming silver halide grains in the existence of excessive silver ions can be used. As a system of the double jet method, a so-called controlled double jet method wherein pAg in a liquid phase for forming silver halide is maintained at a constant value can be used. According to the method, a silver halide emulsion containing silver halide grains having a regular crystal form and almost uniform grain sizes is obtained.

Two or more kinds of silver halide emulsions prepared separately may be used as a mixture thereof.

Silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, a gold salt or a complex salt thereof, etc.

The silver halide emulsions for use in this invention may or may not be chemically sensitized. For the chemical sensitization, the method described, for example, in H. Frieser, *Die Grundlagen der Photographischen Prozesse mit Silberhalogenieden,* pages 675–734, published by Akademische Verlagsgesellschaft can be used.

That is, a sulfur sensitization method using active gelatin or a sulfur-containing compound capable of reacting with silver (e.g., thiosulfates, thioureas, mercapto compounds, rhodanines, etc.); a reduction sensitizing method using a reducing material (e.g., stannous salts, amines, hydrazine derivatives, formamidinesulfinic acid, silane compounds, etc.); and a noble metal sensitizing method using a noble metal compound (e.g., gold complex salts and complex salts of metals belonging to the group VIII of the periodic table, such as Pt, Ir, Pd, etc.) can be used individually or as a combination thereof.

The photographic emulsions for use in this invention can contain various compounds for preventing the formation of fog during the production, storage, or photographic processing of the light-sensitive materials or for stabilizing the photographic performance thereof. That is, there are various compounds known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, (in particular, 1-phenyl-5-mercaptotetrazole), etc.; mercaptopyrimidines; mercaptotriazines; thioketo compounds such as oxadolinthion, etc.; azaindenes such as triazaindenes, tetraazaindenes (particularly, 4-hydroxy-substituted (1,3,3a,7)tetraazaindenes), pentaazaindenes, etc.; benzenethiosulfonic acid, benzenesulfinic acid, benzenesulfonic acid amide, etc.

The photographic light-sensitive materials of this invention may further contain in the photographic emulsion layers and other hydrophilic colloid layers various surface active agents as coating aid and for static prevention, the improvement of slipping property, the improvement dispersibility, sticking prevention and the improvement of photographic properties (e.g., development acceleration, increase of contrast, sensitization, etc.).

Examples of the surface active agents are nonionic surface active agents such as saponin (steroid series), alkylene oxide derivatives (e.g., polyethylene glycol, a polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group (e.g., a carboxy group, a sulfo group, a phospho group, a sulfuric acid ester group, a phosphoric acid ester group, etc.), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurins, sulfosuccinic acid esters, sulfoalkyl polyoxyethylene alkylphenyl ethers, polyoxyethylene alkylphosphoric acid esters, etc.; amphoteric surface active agents such as aminoacids, aminoalkylsulfonic acids, aminoalkylsulfuric acid esters, aminoalkylphosphoric acid esters, alkylbetains, amine oxides, etc.; and cationic surface active agents such as alkylamine salts, aliphatic or aromatic quaternary ammonium salts, heterocyclic quaternary ammonium salts (e.g., pyridiniums, imidazoliums, etc.), phosphonium salts or sulfonium salts containing an aliphatic ring or a heterocyclic ring, etc.

The photographic light-sensitive materials of this invention may contain in the photographic emulsion layers polyalkylene oxide or derivatives thereof (e.g., the ethers, esters, amines, etc.), thioether compounds, thiomorpholines, quaternary ammonium salt compounds, urethane derivatives, urea derivatives, imidazole derivatives, 3-pyrazolidone derivatives for the purposes of increasing sensitivity, increase of contrast, or accelerating development.

The photographic light-sensitive materials of this invention contain in the photographic emulsion layers and/or other hydrophilic colloid layers a dispersion of a water-insoluble or water sparingly soluble synthetic polymer for improving dimensional stability. Examples of the polymer are polymers or copolymers composed of alkyl (meth)acrylate, alkoxyalkyl (meth)acrylate, glycidyl (meth)acrylate, (meth)acrylamide, vinyl ester (e.g., vinyl acetate), acrylonitrile, olefin, styrene, etc., solely or as a combination thereof or as a combination of the aforesaid monomer and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

The photographic silver halide emulsions for use in this invention may be spectrally sensitized by methine dyes, etc. The dyes which are used for the spectral sensitization include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. For these dyes can be applied nuclei usually utilized for cyanine dyes as basic heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to the aforesaid nuclei; the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

Also, for mercocyanine dyes or complex merocyanine dyes can be applied nuclei having a ketomethylene structure, such as pyrazoline-5-one nuclei, thiohydantoin nuclei, 2-thiooxazolidine-2,4-dione nuclei, thiazolidine-2,4-dione nuclei, rhodanine nuclei, etc.

For the photographic emulsion layers of the photographic light-sensitive materials of this invention, dye-forming couplers may be used, that is, compounds capable of coloring by the oxidative coupling with an aromatic primary amino developing agent (e.g., phenylenediamine derivatives, aminophenol derivatives, etc.) in color development processing. As such dye-forming couplers, there are magenta couplers such as 5-pyrazolone couplers, pyrazolobenzimidazole couplers, cyanoacetylcumarone couplers, open chain acylacetonitrile couplers, etc., yellow couplers such as acylacetamide couplers (e.g., benzoylacetanilides, pivaloylacetanilides, etc.), etc., and cyan couplers such as naphthol couplers, phenol couplers, etc.

It is preferred that these couplers are non-diffusible couplers having a hydrophilic group as a so-called "ballast group" in the molecule, or polymerized couplers. The couplers may be four-equivalent or two-equivalent for silver ions. Also, the couplers may be colored couplers having a color correction effect or couplers releasing a development inhibitor or development accelerator during development (so-called DIR couplers or DAR couplers, respectively).

Also, in place of DIR couplers, non-coloring DIR coupling compounds which form a colorless coupling reaction product and release a development inhibitor during development may be used.

Furthermore, the photographic light-sensitive materials may contain compounds releasing a development inhibitor with the progress of development in place of the DIR couplers.

Two or more kinds of the above-described couplers may be used for a same photographic emulsion layer for meeting the characteristics required for the light-sensitive materials or the same coupler may be incorporated in two or more emulsion layers.

The photographic light-sensitive materials of this invention may contain in the photographic emulsion layers and other hydrophilic colloid layers inorganic or organic hardening agents such as chromium salts (e.g., chromium alum, chromium acetate, etc.), aldehydes (e.g. formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (e.g., mucochloric acid, mucophenoxychloric acid, etc.), etc. They can be used singly or as a combination thereof.

As the binder or the protective colloid which can be used for the photographic emulsion layers and other hydrophilic colloid layers (e.g., protective layers, interlayers, etc.) of the light-sensitive materials of this invention, gelatin is advantageously used but other hydrophilic colloids can be used. For example, there are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; sugar derivatives such as sodium alginate, starch derivatives, etc., and synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As the gelatin, limed gelatin, acid-treated gelatin, enzyme-treated gelatin, etc., can be used.

The silver halide photographic light-sensitive materials of this invention may contain various additives such as whitening agents, dyes, desensitizers, coating aids, antistatic agents, plasticizers, anti-friction agent, matting agents, development accelerators, mordants, ultraviolet absorbents, fading preventing agents, color fog preventing agents, etc. These additives are practically described in *Research Disclosure,* No. 176, pages 22–31 (RD-17643) (Dec. 1978).

For photographically processing the silver halide photographic light-sensitive materials of this invention, a wet process, heat development, etc., can be used.

In the case of applying a wet process, known processing liquids can be used. Processing temperatures used usually range form 18° C. to 50° C., but may be lower than 18° C. or higher than 50° C. According to the purposes, a black and white photographic process for forming silver images or color photographic process for forming dye images can be applied.

A developer for black and white photographic process contains a conventionally known developing agent. As the developing agent, there are dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, and the heterocyclic compounds formed by the condensation of a 1,2,3,4-tetrahydroquinoline ring, and an indolene ring described in U.S. Pat. No. 4,067,872. The developers generally contain preservatives, alkali agents, pH buffers, antifoggants, etc., and, further may, if desired, contain color toning agents, development accelerators, surface active agents, defoaming agents, water softeners, hardening agents, tackifiers, etc.

A fixing liquid having a conventional composition can be used. As the fixing agent, thiosulfates, thiocyanates, and also organic sulfur compounds which are known to have an effect as fixing agent are used. The fix liquid may contain a water-soluble aluminum salt as a hardening agent.

In the case of forming dye images, a conventional process can be applied. For example, there are a nega-posi process (e.g., as described in *Journal of the Society of Motion Picture and Television Engineers,* Vol. 61, pp. 667–701 (1953); a color reversal process of obtaining dye positive images by developing with a developer containing a black and white developing agent to form negative silver images, applying at least one uniform light exposure or other proper fogging treatment, and then applying color development; and a silver dye bleaching process of developing photographic emulsion layers containing dye(s) after image-exposure to form silver images and bleaching the dye(s) using the silver images as a bleaching catalyst.

A color developer is generally composed of an alkaline aqueous solution containing a color developing agent. Examples of the color developing agent are primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.).

Other color developing agents described in L. F. A. Mason, *Photographic Processing Chemistry,* pages 226–229, published by The Focal Press, 1966, U.S. Pat. Nos. 2,193,015, 2,592,364, Japanese Patent Application (OPI) No. 64933/73, etc., may be used.

Color developers may further contain pH buffers such as sulfites, carbonates, borates, and phosphates of alkali metals, development inhibitors or fogging agents, etc., such as bromides, iodides, and organic antifoggants. The color developers may further contain, if desired, water softeners, preservatives such as hydroxylamine, etc., organic solvents such as benzyl alcohol, diethylene glycol, etc., development accelerators such as polyethylene glycol, quaternary ammonium salts, amines, etc., dye-forming couplers, competing couplers, fogging agents such as sodium borohydride, auxiliary developing agents such as 1-phenyl-3-pyrazolidone, etc., tackifiers, the polycarboxylic acid series chelating agents described in U.S. Pat. No. 4,083,723, the antioxidants described in West German Patent Application (OLS) No. 2,622,950, etc.

After color development, the photographic emulsion layers are usually bleached. The bleach process may be performed simultaneously with fix process or may be performed separately from fix process. As a bleaching agent, compounds of polyvalent metals such as iron (III), cobalt (III), chromium (VI), copper (II), etc., peracids, quinones, nitroso compounds, etc., can be used. For example, ferricyanides, bichromates, organic complex salts of iron (III) or cobalt (III), complex salts of aminopolycarboxylic acids such as ethylkenediaminetetraacetic acid, nitrilotriacetic acid, 1,3-diamino-2-propanoltetraacetic acid, etc., or organic acids such as citric acid tartaric acid, malic acid, etc.; persulfates; permanganates; nitrosophenol, etc., can be used. In these compounds, potassium ferricyanide, ethylenediaminetetraacetic acid iron (III) sodium, and ethylenediaminetetraacetic acid iron (III) ammonium are particularly useful. Ethylenediaminetetraacetic acid iron (III) complex salts can be used for a bleach solution and also for a bleach-fix (blix) solution.

The bleach solution or the blix solution may further contain various additives such as bleach accelerators described in U.S. Pat. Nos. 3,042,520, 3,241,966, Japanese Patent Publication Nos. 8506/70, 8836/70, etc., and the thiol compounds described in Japanese Patent Application (OPI) No. 65732/75, etc.

These compounds of formula (I) for use in this invention can be applied to various kinds of silver halide photographic light-sensitive materials as illustrated below.

(1) For example, the compounds of formula (I) are effective for improving the quality of silver halide photographic light-sensitive materials for making printing plates having silver chlorobromide or silver chloroiodobromide emulsion layers containing at least 60% silver chloride and 0 to 5% silver iodide (it is preferred that the silver halide emulsion be a mono-dispersed emulsion) and containing polyalkylene oxides. For example, when PUG of the compound of formula (I) is a development inhibitor, the compound can improve (prolong) the dot gradation without reducing the dot quality. Also, when PUG is a development accelerator, the compound is effective for increasing sensitivity and improving the dot images. In these cases, it is preferred that the compound is used in the range of from $1\times10^{-7}$ mole to $1\times10^{-1}$ mole, in particular $1\times10^{-6}$ mole to $1\times10^{-2}$ mole per mole of silver halide.

Also, the polyalkylene oxide compound may be added to the silver halide photographic light-sensitive material and/or a developer.

The polyalkylene oxide compounds for use in this case include the condensation products of a polyalkylene oxide composed of at least 10 units of alkylene oxide having from 2 to 4 carbon atoms, such as ethylene oxide, propylene-1,2-oxide, butylene-1,2-oxide, etc., preferably ethylene oxide and a compound having at least one active hydrogen atom, such as water, aliphatic alcohols, aromatic alcohols, fatty acids, organic amines, hexytol derivatives, etc., or block copolymers or two or more polyalkylene oxides. That is, specific examples of the polyalkylene oxide compounds are polyalkylene glycols, polyalkylene glycol alkyl ethers, polyalkylene glycol aryl ethers, polyalkylene glycol (alkylaryl) ester, polyalkylene glycol esters, polyalkylene glycol fatty acid amides, polyalkylene glycol amines, polyalkylene glycol block copolymers, polyalkylene glycol graft polymers, etc.

It is preferred that the polyalkylene oxide compound has a molecular weight of 500 to 10,000.

Practical examples of the polyalkylene oxide compound which is preferably used in this invention are as follows.

2. $C_{12}H_{25}O(CH_2CH_2O)_{15}H$
3. $C_8H_{17}CH{=}CHC_8H_{16}O(CH_2CH_2O)_{15}H$

4.

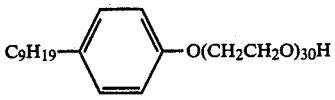

5. $C_{11}H_{23}COO(CH_2CH_2O)_{80}H$
6. $C_{11}H_{23}CONH(CH_2CH_2O)_{15}H$

7.

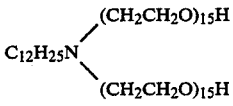

8. $C_{14}H_{29}N(CH_2)(CH_2CH_2O)_{24}H$

9.

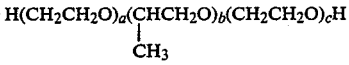

$a + b + c = 50$
$b/a + c = 10/9$

These polyalkylene oxide compounds may be used singly or as a combination thereof.

In the case of incorporating the above-described polyalkylene oxide compound in the silver halide photographic light-sensitive material, the compound is generally used in the range of from $5\times10^{-4}$ g to 5 g, and preferably from $1\times10^{-3}$ to 1 g, per mole of silver halide. Also, when the polyalkylene oxide compound is added to a developer, the compound is used in a range of from 0.1 g to 10 g per liter of the developer.

(2) The compounds of formula (I) for use in this invention are also effective for improving (prolonging) the dot gradation (without reducing the dot quality) of the photographic light-sensitive material having a mono-dispersed silver halide emulsion layer capable of forming high-contrast negative images using a stable developer by the action of a hydrazine derivative described in U.S. Pat. Nos. 4,224,401, 4,168,977, 4,241,164, 4,311,781, 4,272,606, 4,221,857, 4,243,739, 4,272,614, 4,269,929, etc.

In the above, reference to a "stable developer" means a developer containing at least 0.15 mole/liter of sulfite ions as a preservative, and having a pH of from 10.0 to 12.3. The developer is more stable than an ordinary lithographic developer (which can contain sulfite ions in a very small amount only) since it contains a large amount of the preservative and also is resistant to air-oxidation and stable as compared with a developer (pH=12.8) for a high-contrast image-forming system described in U.S. Pat. No. 2,419,975. In this case, the compound of formula (1) having a development inhibitor as PUG is preferably used in a range of from $1\times10^{-5}$ mole to $8\times10^{-2}$ mole, and particularly preferably from $1\times10^{-4}$ mole to $5\times10^{-2}$ mole, per mole of silver halide.

The hydrazine derivative which is used in the above-described case can be represented by formula (VIII)

$$R_1{-}NHNH{-}G{-}R_2 \qquad \text{(VIII)}$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group.

In formula (VIII) described above, the aliphatic group shown by $R_1$ preferably has from 1 to 30 carbon atoms, and is preferably a straight chain, branched, or cyclic alkyl group having from 1 to 20 carbon atoms. In this case, the branched alkyl group may be cyclized to form a saturated heterocyclic ring containing one or more hetero atoms in it. Also, the alkyl group may have a substituent such as an aryl group, an alkoxy group, a sulfoxy group, a sulfonamido group, a carbonamido group, etc.

The aromatic group shown by $R_1$ in formula (VIII) is a monocyclic or dicyclic aryl group or an unsaturated heterocyclic group. The unsaturated heterocyclic ring group may condense with a monocyclic or a dicyclic aryl group to form a heteroaryl group.

For example, there are a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, and those containing a benzene ring are preferred.

$R_1$ is particularly preferably an aryl group.

The aryl group or unsaturated heterocyclic ring group shown by $R_1$ may have a substituent and specific examples of the substituent are a straight chain, branched, or cyclic alkyl group (preferably having from 1 to 20 carbon atoms), an aralkyl group (preferably a monocyclic or dicyclic ring having an alkyl moiety of from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), etc.

The alkyl group shown by $R_2$ in formula (VIII) is preferably an alkyl group having from 1 to 4 carbon atoms and the alkyl group may have a substituent such as a halogen atom, a cyano group, a carboxy group, a sulfo group, an alkoxy group, a phenyl group, etc.

The aryl group, which may be substituted, shown by $R_2$ in formula (VIII) is a monocyclic or dicyclic aryl group including, for example, a benzene ring. The aryl group may have a substituent such as a halogen atom, an alkyl group, a cyano group, a carboxy group, a sulfo group, etc.

The aryloxy group, which may be substituted, shown by $R_2$ in formula (VIII) is preferably a monocyclic group, and examples of the substituent are halogen atoms, etc.

When G is a carbonyl group, $R_2$ is preferably a hydrogen atom, a methyl group, a methoxy group, an ethoxy group or a substituted or unsubstituted phenyl group, and is particularly preferably a hydrogen atom.

When G is a sulfonyl group, $R_2$ is preferably a methyl group, an ethyl group, a phenyl group, or a 4-methylphenyl group, and, particularly preferably a methyl group.

When G is a phosphoryl group, $R_2$ is preferably a methoxy group, an ethoxy group, a butoxy group, a phenoxy group, or a phenyl group, and is particularly preferably a phenoxy group.

When G is a sulfoxy group, $R_2$ is preferably a cyanobenzyl group, a methylthiobenzyl group, etc.

When G is an N-substituted or unsubstituted iminomethylene group, $R_2$ is preferably a methyl group, an ethyl group, or a substituted or unsubstituted phenyl group.

Also, $R_1$ or $R_2$ in formula (VIII) may be a group containing a ballast group which is usually used for immobile photographic additives such as couplers, etc. A ballast group is a group which has 8 or more carbon atoms and is relatively inactive with respect to photographic properties, and can be selected, e.g., from an alkyl group, an alkoxy group, a phenyl group, an alkylphenyl group, a phenoxy group, an alkylphenoxy group, etc.

Furthermore, $R_1$ or $R_2$ in formula (VIII) may contain a group strengthing the adsorption to the surfaces of silver halide grains. Examples of the adsorption group are a thiourea group, a heterocyclic thioamido group, a mercapto heterocyclic group, a triazole group, etc., described in U.S. Pat. No. 4,385,108.

G in formula (VIII) is most preferably a carbonyl group.

Specific examples of the compound represented by formula (VIII) described above are shown below. However, the invention is not limited to these compounds.

VIII-1

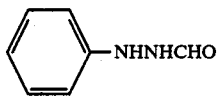

VIII-2

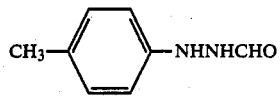

VIII-3

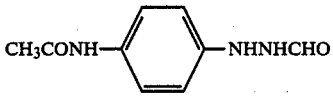

VIII-4

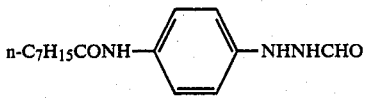

VIII-5

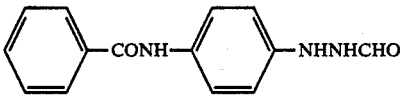

VIII-6

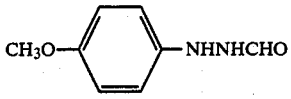

VIII-7

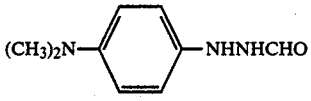

VIII-8

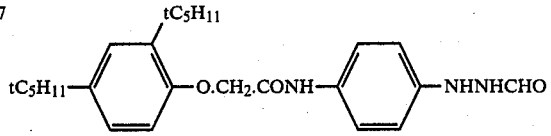

VIII-9

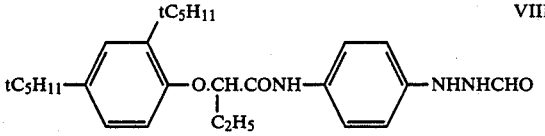

VIII-10

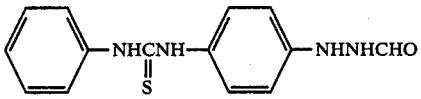

VIII-11

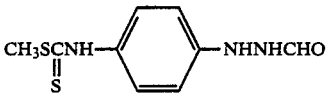

VIII-12

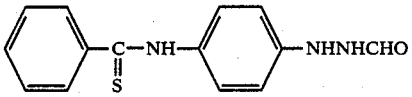

VIII-13

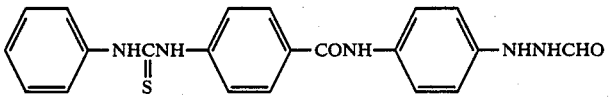

-continued
VIII-14
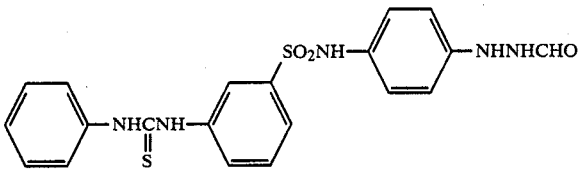
VIII-15
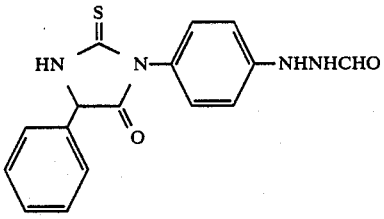
VIII-16
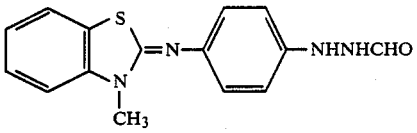
VIII-17
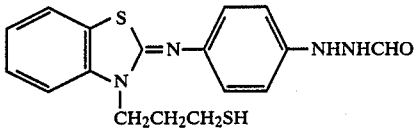
VIII-18
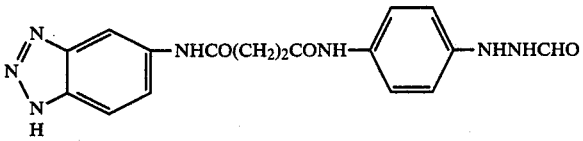
VIII-19
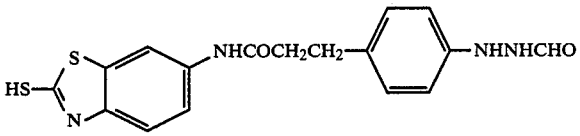
VIII-20
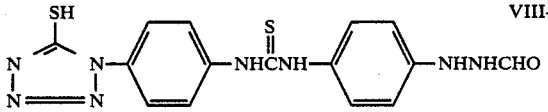
VIII-21
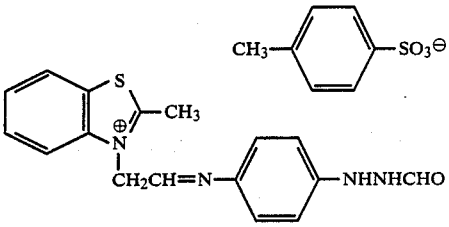
VIII-22
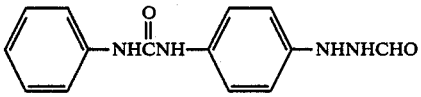
VIII-23
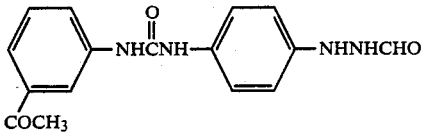
VIII-24
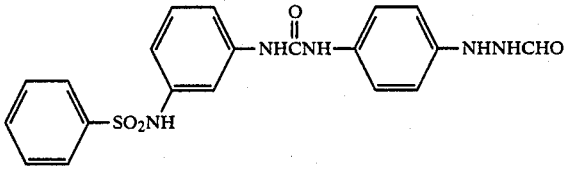
VIII-25
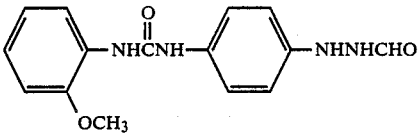

-continued
VIII-26
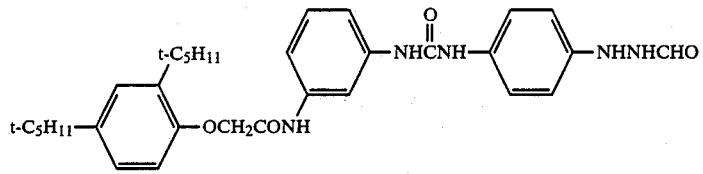
VIII-27
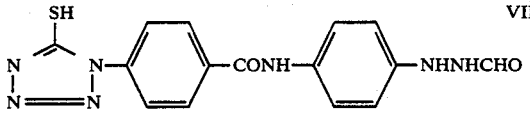
VIII-28
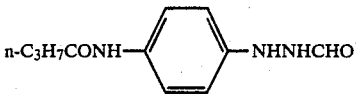
VIII-29
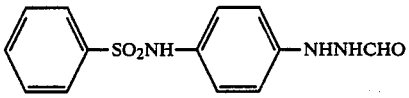
VIII-30
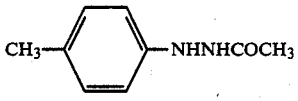
VIII-31
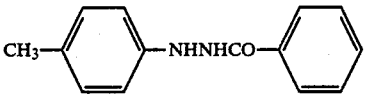
VIII-32
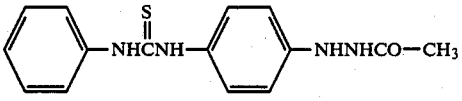
VIII-33
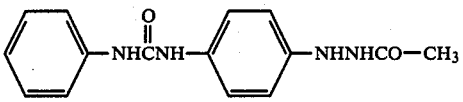
VIII-34
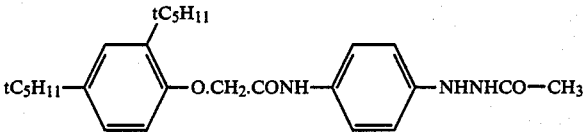
VIII-35
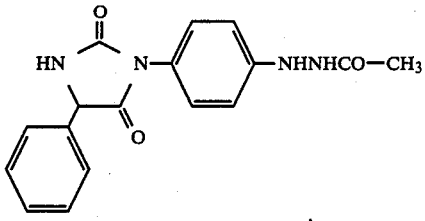
VIII-36
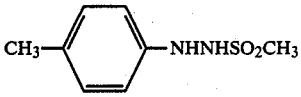
VIII-37
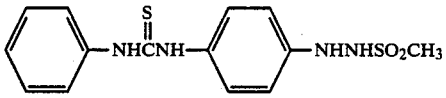
VIII-38
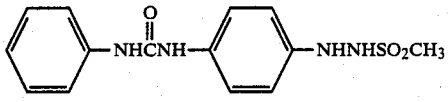
VIII-39
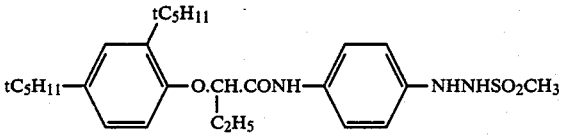
VIII-40
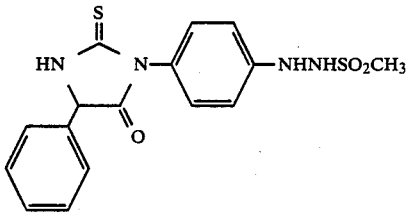
VIII-41
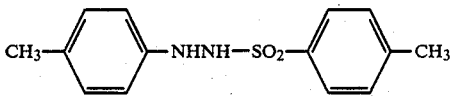
VIII-42
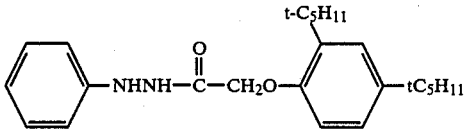
VIII-43
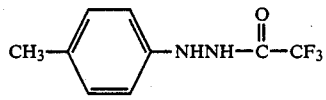

-continued
VIII-44
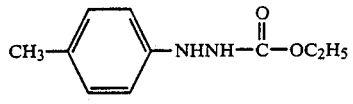
VIII-45
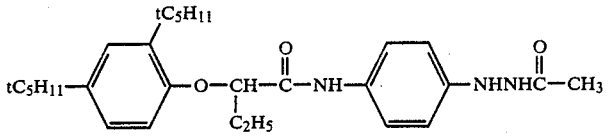
VIII-46
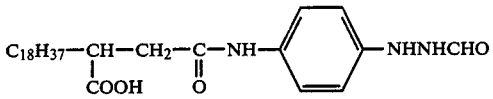
VIII-47
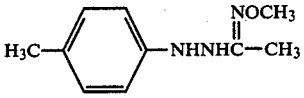
VIII-48
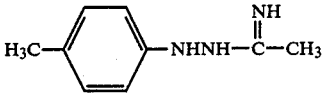
VIII-49
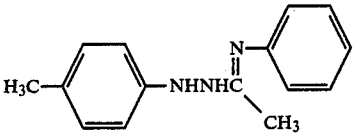
VIII-50
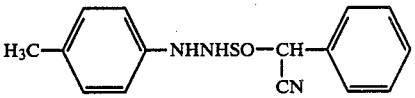
VIII-51
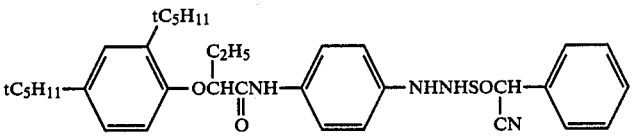
VIII-52
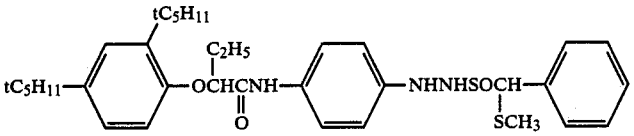
VIII-53
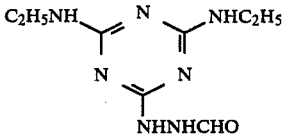
VIII-54
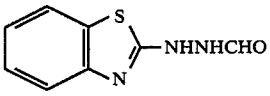
VIII-55
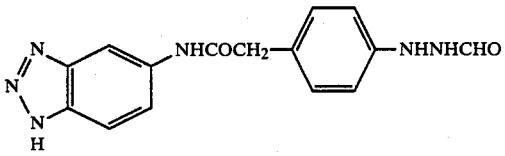
VIII-56
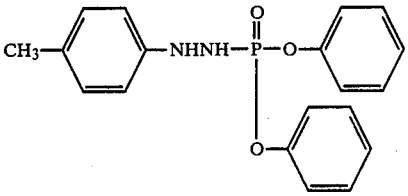
VIII-57
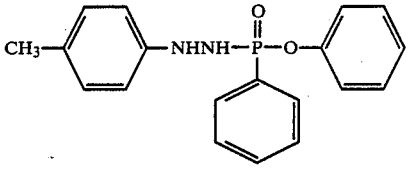
VIII-58
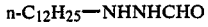

-continued

VIII-59

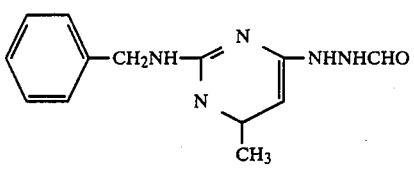

VIII-60

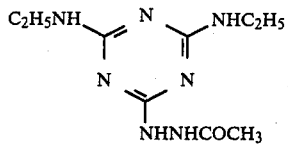

VIII-61

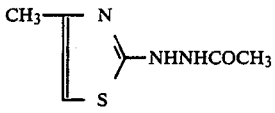

VIII-62

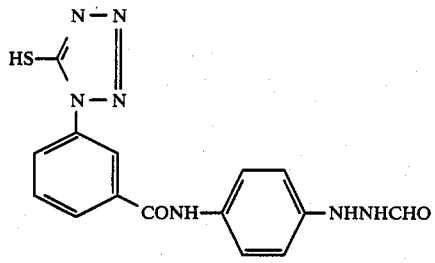

VIII-63

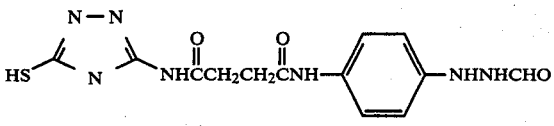

VIII-64

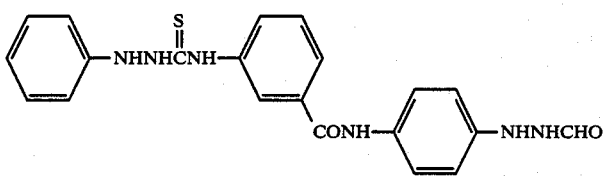

VIII-65

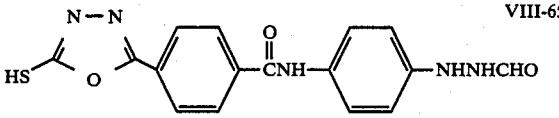

VIII-66

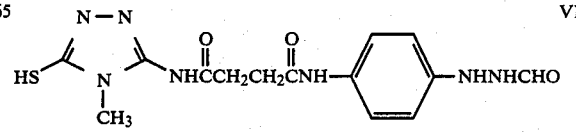

Synthesis methods for these compounds are described in Japanese Patent Application (OPI) Nos. 20921/78, 20922/78, 66732/78, 20318/78, etc.

When the compound shown in formula (VIII) above is incorporated in the photographic light-sensitive material in this invention, it is preferred that the compound is incorporated in the silver halide emulsion layer(s) thereof but it may be incorporated in other non-sensitive hydrophilic colloid layer(s) (e.g., a protective layer, an interlayer, an antihalation layer, etc.). Practically speaking, when the compound is water-soluble, the compound may be added to an aqueous hydrophilic colloid solution as an aqueous solution thereof or a solution of an organic solvent miscible with water, such as alcohols, esters, ketones, etc. When the compound is incorporated in a silver halide emulsion layer, the compound may be added to the emulsion at any period from the initiation of chemical ripening to coating, but it is preferably added after finishing chemical ripening but before coating. It is particularly preferred to add the compound to a coating composition prepared for coating.

It is preferred that the proper content of the compound shown by formula (VIII) is selected according to the grain sizes of the silver halide, the halogen composition thereof, the method and extent of chemical sensitization, the relation between the layer in which the compound is incorporated and a silver halide emulsion layer, the kind of antifogging compound, etc., and the test method for the selection of the compound is well known for a person skilled in the art. It is usually preferred that the amount of the compound is from $1\times10^{-6}$ mole to $1\times10^{-1}$ mole, and particularly preferably from $1\times10^{-5}$ to $4\times10^{-2}$ mole, per mole of silver halide.

(3) The compound of formula (I) for use in this invention can be also applied to multilayer multicolor photographic materials having on a support at least two silver halide emulsion layers, each having different spectral sensitivity, for the purposes of improving graininess, improving sharpness, improving color reproducibility, and increasing sensitivity.

A multilayer natural color photographic material usually has on a support at least one red-sensitive emulsion layer, at least one green-sensitive emulsion layer, and at least one blue-sensitive emulsion layer. The order of these layers may be desirably selected according to the particular use contemplated. A preferred layer order is a red-sensitive emulsion layer, a green-sensitive emulsion layer, and a blue-sensitive emulsion layer, from the support side, or a blue-sensitive emulsion layer, a red-sensitive and a green-sensitive emulsion layer from the support side.

Also, each of the aforesaid emulsion layers may be composed of two or more emulsion layers each having different sensitivity or a light-insensitive layer may exist between two or more emulsion layers having a same sensitivity. A red-sensitive emulsion layer contains a cyan-forming coupler, a green-sensitive emulsion layer a magenta-forming coupler, and a blue-sensitive emulsion layer a yellow-forming coupler, but as the case may be other combinations may be employed.

The compound of formula (I) for use in this invention can be used together with conventional couplers incorporated in the same emulsion layer with such couplers, or may be incorporated in a photographic auxiliary layer such as an interlayer, etc., as an emulsified dispersion thereof.

It is preferred that the compound of formula (I) described above is present in the photographic light-sensitive material of this invention in an amount of from 0.1 to 50 mole%, and particularly from 0.3 to 15 mole%, with respect to each of the yellow coupler in the blue-sensitive emulsion layer, the magenta coupler in the green-sensitive emulsion layer, and the cyan coupler in the red-sensitive emulsion layer. Also, it is preferred that the amount of the compound of formula (I) is from $1\times10^{-5}$ mole to $8\times10^{-2}$ mole, and particularly preferably from $1\times10^{-4}$ mole to $5\times10^{-2}$ mole, per mole of silver halide in the silver halide emulsion layer in which the compound is incorporated.

(4) The compound of formula (I) for use in this invention is also effective for improving the photographic performance such as sharpness, etc., of a black and white photographic light-sensitive material having a layer of silver iodobromide or silver chloroiodobromide containing up to 50% silver chloride and up to 15 mole% silver iodide, such as, in particular, X-ray or radiographic light-sensitive material. In this case, it is preferred that the amount of the compound is from $1\times10^{-6}$ mole to $1\times10^{-1}$ mole, and particularly preferably from $1\times10^{-5}$ mole to $5\times10^{-2}$ mole per mole of silver halide.

(5) The compound of general formula (I) for use in this invention can be also advantageously used for color diffusion transfer process as a dye-providing material having high activity and high efficiency.

The compound formula (I) for use in this invention can be further applied to various photographic light-sensitive materials, such as light-sensitive materials for electron beams, black and white light-sensitive materials having high resolving power, diffusion transfer black and white light-sensitive materials, color X-ray light-sensitive materials, heat-developable light-sensitive materials (including color light-sensitive materials), etc.

The following examples are intended to illustrate the invention in detail, but not to limit it in any way.

The preparation of the silver halide emulsions used in following Examples 1 to 3 and the processing liquid compositions for processing these emulsion layers are shown below.

Preparation of Emulsion (A)

A highly mono-dispersed silver iodobromide emulsion was prepared by simultaneously adding an aqueous silver nitrate and an aqueous solution of potassium iodide and potassium bromide to an aqueous gelatin solution kept at 50° C. by a double jet method while maintaining the pAg of the system at 7.5. The form of the silver iodobromide grains was cube, the mean grain size thereof was 0.26 μm, and the content of silver iodide was 2 mole%.

The emulsion was washed with water in a conventional manner to remove insoluble salts and then chemically sensitized with the addition of sodium thiosulfate.

Preparation of Emulsion (B)

By following the same procedure as the case of preparing Emulsion (A) except that the addition of the aqueous silver nitrate solution and an aqueous solution of halides was performed at 60° C. and in the existence of hexachloroiridium (III) acid potassium corresponding to $4\times10^{-7}$ mole per mole of silver, a mono-dispersed silver chlorobromide was obtained and then washed with water and chemically sensitized as in Emulsion (A). The form of the silver chlorobromide grains thus prepared was cube, the mean grain size thereof was 0.28 μm, and the content of silver chloride was 30 mole%.

Preparation of Emulsion (C)

A mono-dispersed silver chlorobromide emulsion was prepared by simultaneously adding an aqueous silver nitrate solution and an aqueous halides solution to an aqueous gelatin solution kept at 50° C. by a double jet method while maintaining the pAg at 7.8. The emulsion was washed with water by sedimentation according to a conventional method to remove soluble salts, and then chemically sensitized with the addition of sodium thiosulfate as the case of Emulsion (A). The form of the silver chlorobromide grains of this emulsion was cubic, the mean grain size thereof was 0.30 μm, and the content of silver bromide was 30 mole%.

Preparation of Emulsion (D)

By following the same procedure as the case of Emulsion (C) except that the addition of the aqueous silver nitrate solution and the aqueous halides solution was performed in the presence of rhodiumammonium chloride corresponding to $5\times10^{-6}$ mole per mole of silver, a mono-dispersed silver chlorobromide emulsion (mean grain size: 0.30 μm; silver bromide content: 30 mole%) was prepared. The emulsion was washed as the case of Emulsion (C) and then chemically sensitized with the addition of sodium thiosulfate and potassium chloroaurate.

| Development Composition (E) | |
|---|---|
| Hydroquinone | 40.0 g |
| 4,4-Dimethyl-1-phenyl-3-pyrazolidone | 0.4 g |
| Anhydrous Sodium Sulfite | 75 g |
| Sodium Hydrogen Carbonate | 7.0 g |
| Ethylenediaminetetraacetic Acid Di-sodium | 1.0 g |
| Potassium Bromide | 6.0 g |
| 5-Methyl-benzotriazole | 0.6 g |
| Water to make | 1 liter |
| pH adjusted to 12.0 with potassium hydroxide. | |
| **Developer Composition (F)** | |
| Hydroquinone | 40.0 g |
| 4,4-Dimethyl-1-phenyl-3-pyrazolidone | 0.4 g |
| Sodium Hydroxide | 13.0 g |
| Anhydrous Potassium Sulfite | 90.0 g |
| Potassium Tertiary Phosphate | 74.0 g |
| Ethylenediaminetetraacetic Acid Di-sodium | 1.0 g |
| Potassium Bromide | 6.0 g |
| 5-Methylbenzotriazole-1-diethylamino-2,3-dihydroxypropane | 17.0 g |
| Water to make | 1 liter |
| pH adjusted to 11.4 with potassium hydroxide. | |

EXAMPLE 1

To Emulsion (D) were added 4-hydroxy-6-methyl-1,3,3a,7-tetraazaindene, a dispersion of polythyl acrylate, polyethylene glycol (mean molecular weight of 1,000), 1,3-bisvinylsulfonyl-2-propanol, Sensitizing Dye (a), and Compound VIII-9 of formula (VIII), and after adding thereto each of the compounds of formula (I)

described above shown in Table 1 below, the resultant mixture was coated on a polyethylene terephthalate film at a silver coverage of 3.50 g/m$^2$ and a gelatin coverage of 2.00 g/m$^2$ simultaneously with an aqueous solution of gelatin as a main component containing coating aids such as a surface active agent, a tackifier, etc., at a gelatin coverage of 1.10 g/m$^2$, in the order listed to provide each of Samples 101 to 112.

Furthermore, by following the same procedure as above except that each of Comparison Compounds (b) to (e) described below was used in place of the compound of formula (I) used above, Comparison Samples 113 to 116 were prepared.

Each of the samples thus prepared was exposed through a sensitometeric exposure wedge using Scanner Nega Contact Screen No. 2, 150L, made by Dainippon Screen Mfg. Co., Ltd., developed with the developer having Development Composition (E) for 30 seconds at 38° C., fixed, washed, and dried.

The results thus obtained are shown in Table 1.

TABLE 1

Sensitizing Dye (a)

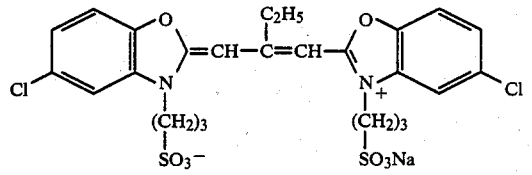

Comparison Compound (b)

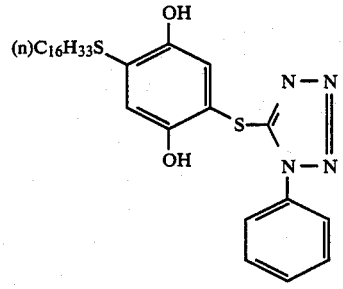

Comparison Compound (c)

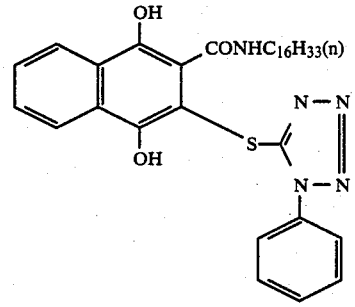

Comparison Compound (d)

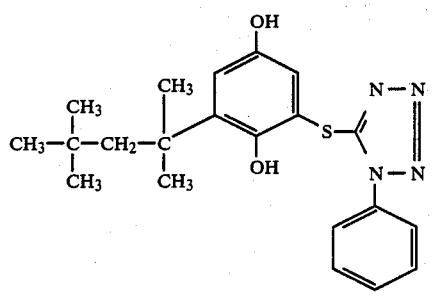

Comparison Compound (e)

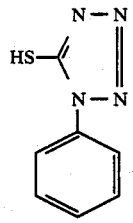

| Sample | Emulsion | Compound of Formula (VIII) | Processing Solution | Compound of General Formula (I) Kind | Compound of General Formula (I) Amount | Result Dot Quality | Result Dot Gradation | Note |
|---|---|---|---|---|---|---|---|---|

TABLE 1-continued

| | | | | | | | | |
|---|---|---|---|---|---|---|---|---|
| 101 | D | VIII - 9 | E | — | — | 4 | 1.18 | Control |
| 102 | D | VIII - 9 | E | I-2 | $4.0 \times 10^{-3}$ mol/mol-Ag | 4.5 | 1.27 | Invention |
| 103 | D | VIII - 9 | E | I-4 | $4.0 \times 10^{-3}$ mol/mol-Ag | 5 | 1.25 | Invention |
| 104 | D | VIII - 9 | E | I-5 | $3.0 \times 10^{-3}$ mol/mol-Ag | 5 | 1.43 | Invention |
| 105 | D | VIII - 9 | E | I-6 | $3.0 \times 10^{-3}$ mol/mol-Ag | 5 | 1.45 | Invention |
| 106 | D | VIII - 9 | E | I-9 | $4.0 \times 10^{-3}$ mol/mol-Ag | 4.5 | 1.30 | Invention |
| 107 | D | VIII - 9 | E | I-15 | $4.0 \times 10^{-3}$ mol/mol-Ag | 4.5 | 1.32 | Invention |
| 108 | D | VIII - 9 | E | I-23 | $3.0 \times 10^{-3}$ mol/mol-Ag | 4.5 | 1.35 | Invention |
| 109 | D | VIII - 9 | E | I-25 | $4.0 \times 10^{-3}$ mol/mol-Ag | 4.5 | 1.25 | Invention |
| 110 | D | VIII - 9 | E | I-28 | $3.0 \times 10^{-3}$ mol/mol-Ag | 5 | 1.44 | Invention |
| 111 | D | VIII - 9 | E | I-33 | $4.0 \times 10^{-3}$ mol/mol-Ag | 5 | 1.24 | Invention |
| 112 | D | VIII - 9 | E | I-34 | $3.0 \times 10^{-3}$ mol/mol-Ag | 5 | 1.47 | Invention |
| 113 | D | VIII - 9 | E | (b) | $4.0 \times 10^{-3}$ mol/mol-Ag | 4.0 | 1.20 | Comparison |
| 114 | D | VIII - 9 | E | (c) | $4.0 \times 10^{-3}$ mol/mol-Ag | 3.5 | 1.25 | Comparison |
| 115 | D | VIII - 9 | E | (d) | $4.0 \times 10^{-3}$ mol/mol-Ag | 4.0 | 1.21 | Comparison |
| 116 | D | VIII - 9 | E | (e) | $4.0 \times 10^{-3}$ mol/mol-Ag | 3.0 | 1.18 | Comparison |

In Table 1, the dot quality is visually evaluated in five ranks, wherein "5" is best and "1" is worst. As a dot plate for making a printing plate, ranks "5" and "4" only are practically usable. Also, a rank "4.5" shows a quality between rank "4" and rank "5".

The dot gradation is the difference between the logarithmic values of the light exposure values giving blackened areas of 5% and 95%, respectively of each dot and a larger difference shows a softer dot gradation.

As is clear from the results shown in Table 1, by using the compounds shown by general formula (I) described above, better dot quality and softer dot gradation than those in the case of using the comparison compounds are obtained.

EXAMPLE 2

To Emulsion (A) were added 4-hydroxy-6-methyl-1,3,3a,7-tetraazaindene, a dispersion of polyethylene acrylate, polyethylene glycol (mean molecular weight of 1,000), 1,3-bisvinylsulfonyl-2-propanol, Sensitizing Dye (a) (used for the samples shown in Table 2-1 or Sensitizing Dye (a') (used for the samples shown in Table 2-2), the compound of formula (VIII) (shown in Table 2-1 and Table 2-2), and potassium iodide, and after adding thereto each of the compounds of formula (I) shown in Tables 2-1 and 2-2, the resultant mixture was simultaneously coated on a polyethylene terephthalate film at a silver coverage of 3.5 g/m$^2$ and a gelatin coverage of 2.0 g/m$^2$ with an aqueous solution composed mainly of gelatin containing coating aids such as a surface active agent, a tackifier, etc., at a gelatin coverage of 1.1 g/m$^2$, in the order listed to provide Samples 201 to 211.

Each of the samples thus prepared was exposed through a sensitometric light exposure wedge using Grace Scanner Negative Contact Screen No. 2, 150L, made by Dainippon Screen Mfg. Co., Ltd., developed with the developer having Developer Composition (E) or (F) as described above for 30 seconds at 38° C., fixed, washed with water, and dried.

The results obtained are shown in Table 2-1 and Table 2-2 below.

Sensitizing Dye (a): Same as the compound described in Example 1.

TABLE 2-1

Sensitizing Dye (a')

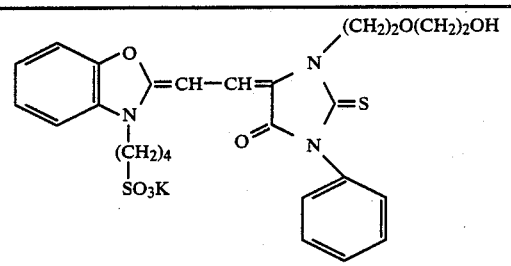

| Sample | Emulsion | Compound of Formula (VIII) | Processing Solution | Compound of General Formula (I) Kind | Compound of General Formula (I) Amount | Result Dot Quality | Result Dot Gradation | Note |
|---|---|---|---|---|---|---|---|---|
| 201 | A | VIII - 9 | E | — | — | 4 | 1.15 | Comparison |
| 202 | A | VIII - 9 | E | I-4 | $4.0 \times 10^{-3}$ mol/mol-Ag | 5 | 1.30 | Invention |
| 203 | A | VIII - 9 | E | I-4 | $8.0 \times 10^{-3}$ mol/mol-Ag | 5 | 1.36 | Invention |
| 204 | A | VIII - 9 | E | I-5 | $2.0 \times 10^{-3}$ mol/mol-Ag | 5 | 1.42 | Invention |
| 205 | A | VIII - 9 | E | I-5 | $4.0 \times 10^{-3}$ mol/mol-Ag | 4.5 | 1.47 | Invention |
| 206 | A | VIII - 9 | E | I-34 | $2.0 \times 10^{-3}$ mol/mol-Ag | 5 | 1.45 | Invention |
| 207 | A | VIII - 9 | E | I-34 | $4.0 \times 10^{-3}$ mol/mol-Ag | 4.5 | 1.48 | Invention |
| 208 | A | VIII - 27 | E | — | — | 4 | 1.13 | Comparison |
| 209 | A | VIII - 27 | E | I-5 | $2.0 \times 10^{-3}$ mol/mol-Ag | 5 | 1.44 | Invention |
| 210 | A | VIII - 25 | E | — | — | 4.5 | 1.05 | Comparison |
| 211 | A | VIII - 25 | E | I-5 | $2.0 \times 10^{-3}$ mol/mol-Ag | 5 | 1.40 | Invention |

TABLE 2-2

| Sample | Emulsion | Compound of Formula (VIII) | Processing Solution | Compound of General Formula (I) Kind | Compound of General Formula (I) Amount | Result Dot Quality | Result Dot Gradation | Note |
|---|---|---|---|---|---|---|---|---|
| 201 | A | VIII - 9 | F | — | — | 4 | 1.10 | Comparison |
| 202 | " | " | " | I-4 | $4.0 \times 10^{-3}$ mol/mol-Ag | 5.0 | 1.22 | Invention |
| 203 | " | " | " | I-5 | $2.0 \times 10^{-3}$ mol/mol-Ag | 5.0 | 1.39 | " |
| 204 | " | " | " | I-34 | " | 5.0 | 1.39 | " |
| 208 | " | VIII - 27 | " | — | — | 4 | 1.09 | Comparison |
| 209 | " | " | " | I-5 | $2.0 \times 10^{-3}$ mol/mol-Ag | 4.5 | 1.41 | Invention |
| 210 | " | VIII - 25 | " | — | — | 4.5 | 1.03 | Comparison |
| 211 | " | " | " | I-5 | $2.0 \times 10^{-3}$ mol/mol-Ag | 5.0 | 1.35 | Invention |

The dot gradation shown in Table 2-1 and Table 2-2 above was graded according to the same ranks as in Table 1 of Example 1.

As is clear from the results of Table 2-1and Table 2-2, the use of compounds according to formula (I) described above gives softer dot gradation than the case of not using these compounds. Also, by comparing Example 1 and Example 2, it can be seen that the effect of softening dot gradation by the compound of general formula (I) for use in this invention is remarkable in any case, although the effect may differ to some extent according to the emulsion composition and the kinds of the nucleating agent and the processing composition.

EXAMPLE 3

By following the same procedure as Example 1 using Emulsion (B) or (C) described above and also using Sensitizing Dye (a) described above and Compound VIII-9 of formula (VIII), Samples 301 to 310 were prepared. Each of the samples was light-exposed as Example 1, developed by the developer having Development Composition (E) for 30 seconds at 38° C., fixed, washed with water, and dried. The results obtained are shown in Table 3.

The dot gradation in Table 3 is same as defined in Table 1 of Example 1.

| | |
|---|---|
| (1) Emulsion Layer: A gelatin layer containing | |
| Negative working silver iodobromide emulsion (silver iodide: 5 mole %; mean gram size: 0.6 μm) | 1.6 g/m$^2$ |
| Coupler C-0 | 0.9 g/m$^2$ |
| Compound I-4 | 0.009 g/m$^2$ |
| Tricresyl Phosphate | 0.6 g/m$^2$ |
| (2) Protective Layer: A gelatin layer containing | |
| Gelatin | 2.5 g/m$^2$ |
| 2,4-Dichloro-6-hydroxy-2-triazine Sodium | 0.13 g/m$^2$ |

Samples 402 to 405:

By following the same procedure as the case of preparing Sample 401 except that the equimolar amount of Compound (I-7) or (I-18) for use in this invention was used in place of Compound (I-4), Samples 402 and 403 were prepared.

Also, by following the same procedure as for Sample 401 except that the equimolar amount of Comparison Compound (b) or (c) described above in Example 1 was used in place of Compound (I-4) for use in this invention, Comparison Samples 404 and 405 were prepared.

Some of these samples thus prepared were kept under forcible deterioration conditions (3 days at 45° C. and 80% in RH) (Condition B), other of the samples were not subjected to the forcible test (Condition A), and then each of the samples was imagewise exposed for sensitometry and then subjected to the following color development process. The density of the images thus processed was measured using a red filter, and the results thus obtained are shown in Table 4 below.

The development process used in this case was as follows.

TABLE 3

| Sample | Emulsion | Compound of Formula (VIII) | Processing Solution | Compound of General Formula (I) Kind | Compound of General Formula (I) Amount | Result Dot Quality | Result Dot Gradation | Note |
|---|---|---|---|---|---|---|---|---|
| 301 | B | VIII - 9 | E | — | — | 4.0 | 1.20 | Comparison |
| 302 | " | " | " | I-4 | $4.0 \times 10^{-3}$ mol/mol-Ag | 5 | 1.35 | Invention |
| 303 | " | " | " | I-5 | $2.0 \times 10^{-3}$ mol/mol-Ag | 5 | 1.47 | " |
| 304 | " | " | " | I-15 | $4.0 \times 10^{-3}$ mol/mol-Ag | 5 | 1.38 | " |
| 305 | " | " | " | I-34 | $2.0 \times 10^{-3}$ mol/mol-Ag | 5 | 1.49 | " |
| 306 | C | " | " | — | — | 4.0 | 1.19 | Comparison |
| 307 | " | " | " | I-4 | $4.0 \times 10^{-3}$ mol/mol-Ag | 5 | 1.33 | Invention |
| 308 | " | " | " | I-5 | $2.0 \times 10^{-3}$ mol/mol-Ag | 5 | 1.49 | " |
| 309 | " | " | " | I-15 | $4.0 \times 10^{-3}$ mol/mol-Ag | 5 | 1.35 | " |
| 310 | " | " | " | I-34 | $2.0 \times 10^{-3}$ mol/mol-Ag | 4.5 | 1.50 | " |

As is clear from the results shown in Table 3, it can be seen that by using the compounds of formula (I) for use in this invention, the effect of softening the dot gradation is remarkable even when the halogen composition of the silver chlorobromide emulsions differs.

EXAMPLE 4

For evaluating the effectiveness of the compounds of formula (I) in this invention, a multilayer color light-sensitive material 401 having the layers of the following compositions on a triacetyl cellulose film was prepared.

The coating amount of the emulsion was shown by the coverage of silver.

Sample 401:

| | |
|---|---|
| 1. Color Development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |

-continued

| | |
|---|---|
| 6. Stabilization | 3 min. 15 sec. |

Compositions of the processing solutions used for the processing are as follows.

Color Developer

| | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |

Bleach Solution

| | |
|---|---|
| Ammonium Bromide | 160.0 g |
| Aqueous Ammonia (28%) | 25.0 ml |
| Ethylenediamine-tetraacetic Acid Sodium Iron Salt | 130.0 g |
| Glacial Acetic Acid | 14.0 ml |
| Water to make | 1 liter |

Fix Solution

| | |
|---|---|
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 liter |

Stabilization Solution

| | |
|---|---|
| Formalin (37 wt % formaldehyde) | 8.0 ml |
| Water to make | 1 liter |

TABLE 4

| | | Condition (A) | | | Condition (B) | | |
|---|---|---|---|---|---|---|---|
| Sample | Compound | Fog | Relative* Sensitivity | Gamma** | Fog | Relative* Sensitivity | Gamma** |
| 401 | (I-4) | 0.07 | 100 | 0.82 | 0.07 | 98 | 0.81 |
| 402 | (I-7) | 0.07 | 96 | 0.81 | 0.07 | 96 | 0.81 |
| 403 | (I-18) | 0.07 | 110 | 0.84 | 0.07 | 108 | 0.83 |
| 404 | (b) | 0.07 | 110 | 0.84 | 0.06 | 93 | 0.78 |
| 405 | (c) | 0.06 | 95 | 0.82 | 0.06 | 80 | 0.76 |

Note:

*Relative sensitivity is the reciprocal of the light-exposure amount giving a density of (fog + 0.2), wherein that of Sample 401 under Condition A is defined as 100.

**Gamma is the inclination of the line passing through the density point of (fog + 0.2) and the density point of (fog + 1.2)

Coupler (C-0)

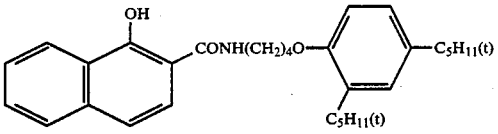

From the results shown in Table 4, it can be seen that Samples 401 to 403 using the compounds of formula (I) for use in this invention show almost no change in photographic performance before and after the forcible deterioration test, in contrast to the samples using conventional comparison compounds.

EXAMPLE 5

A multilayer color light-sensitive material (501) having the following layers on a transparent triacetyl cellulose film was prepared.

Layer 1: Antihalation Layer: A gelatin layer containing

| | |
|---|---|
| Black Colloidal Silver | 0.15 g/m$^2$ |
| Ultraviolet Absorbent U-1 | 0.08 g/m$^2$ |
| Ultraviolet Absorbent U-2 | 0.12 g/m$^2$ |

Layer 2: Interlayer: A gelatin layer containing

| | |
|---|---|
| 2,5-Di-t-pentadecylhydroquinone | 0.18 g/m$^2$ |
| Coupler C-1 | 0.11 g/m$^2$ |

Layer 3: 1st Red-Sensitive Emulsion Layer: A gelatin layer containing

| | |
|---|---|
| Silver Iodobromide Emulsion (silver iodide: 4 mole %, mean grain size 0.4 μm) | 1.2 g/m$^2$ |
| Sensitizing Dye I | $1.4 \times 10^{-4}$ mole per mole of silver |
| Sensitizing Dye II | $0.4 \times 10^{-4}$ mole per mole of Ag |
| Sensitizing Dye III | $5.6 \times 10^{-4}$ mole per mole of Ag |
| Sensitizing Dye IV | $4.0 \times 10^{-4}$ mole per mole of Ag |
| Coupler C-2 | 0.45 g/m$^2$ |
| Coupler C-3 | 0.035 g/m$^2$ |
| Coupler C-4 | 0.025 g/m$^2$ |

Layer 4: 2nd Red-Sensitive Emulsion Layer: A gelatin layer containing

| | |
|---|---|
| Silver Iodobromide Emulsion (silver iodide: 8 mole %, mean grain size 0.8 μm) | 1.0 g/m$^2$ |
| Sensitizing Dye I | $5.2 \times 10^{-4}$ mole per mole of silver |
| Sensitizing Dye II | $1.5 \times 10^{-4}$ mole per mole of Ag |
| Sensitizing Dye III | $2.1 \times 10^{-4}$ mole per mole of Ag |
| Sensitizing Dye IV | $1.5 \times 10^{-4}$ mole per mole of Ag |
| Coupler C-2 | 0.050 g/m$^2$ |
| Coupler C-5 | 0.070 g/m$^2$ |
| Coupler C-3 | 0.035 g/m$^2$ |

Layer 5: Interlayer: A gelatin layer containing

| | |
|---|---|
| 2,5-Di-t-pentadecylhydroquinone | 0.08 g/m$^2$ |

Layer 6: 1st Green-Sensitive Emulsion Layer: A gelatin layer containing

| | |
|---|---|
| Silver Iodobromide Emulsion (silver iodide: 4 mole %, mean grain size 0.4 μm) | 0.80 g/m$^2$ |
| Sensitizing Dye V | $4.0 \times 10^{-4}$ mole per mole of silver |
| Sensitizing Dye VI | $3.0 \times 10^{-4}$ mole per mole of Ag |
| Sensitizing Dye VII | $1.0 \times 10^{-4}$ mole per mole of Ag |

-continued

| | |
|---|---|
| Coupler C-6 | 0.45 g/m$^2$ |
| Coupler C-7 | 0.13 g/m$^2$ |
| Coupler C-8 | 0.02 g/m$^2$ |
| Coupler C-4 | 0.04 g/m$^2$ |

Layer 7: 2nd Green-Sensitive Emulsion Layer: A gelatin layer containing

| | |
|---|---|
| Silver Iodobromide Emulsion (silver iodide: 8 mole %, mean grain size 0.8 μm) | 0.85 g/m$^2$ |
| Sensitizing Dye V | $2.7 \times 10^{-4}$ mole per mole of silver |
| Sensitizing Dye VI | $1.8 \times 10^{-4}$ mole per mole of Ag |
| Sensitizing Dye VII | $7.5 \times 10^{-4}$ mole per mole of Ag |
| Coupler C-6 | 0.095 g/m$^2$ |
| Coupler C-7 | 0.015 g/m$^2$ |

Layer 8: Yellow Filter Layer: A gelatin layer containing

| | |
|---|---|
| Yellow Colloid Silver | 0.08 g/m$^2$ |
| 2,5-Di-t-pentadecylhydroquinone | 0.090 g/m$^2$ |

Layer 9: 1st Blue-Sensitive Emulsion Layer: A gelatin layer containing

| | |
|---|---|
| Silver Iodobromide Emulsion (silver iodide: 5 mole %, mean grain size 0.3 μm) | 0.37 g/m$^2$ |
| Sensitizing Dye VIII | $4.4 \times 10^{-4}$ mole per mole of Ag |

-continued

| | |
|---|---|
| Coupler C-9 | 0.71 g/m$^2$ |
| Coupler C-4 | 0.07 g/m$^2$ |

Layer 10: 2nd Blue-sensitive Emulsion Layer: A gelatin layer containing

| | |
|---|---|
| Silver Iodobromide Emulsion (silver iodide: 7 mole %, mean grain size 0.9 μm) | 0.55 g/m$^2$ |
| Sensitizing Dye VIII | $3.0 \times 10^{-4}$ mole per mole of Ag |
| Coupler C-9 | 0.23 g/m$^2$ |

Layer 11: 1st Protective Layer: A gelatin layer containing

| | |
|---|---|
| Ultraviolet Absorbent U-1 | 0.14 g/m$^2$ |
| Ultraviolet Absorbent U-2 | 0.22 g/m$^2$ |

Layer 12: 2nd Protective Layer: A gelatin layer containing

| | |
|---|---|
| Silver Iodobromide Emulsion (silver iodide: 2 mole %; mean grain size: 0.07 μm) | 0.25 g/m$^2$ |
| Polymethacrylate Particles (mean diameter: 1.5 μm) | 0.10 g/m$^2$ |

Each of the above-described layers further contained a gelatin hardening agent H-1 and a surface active agent in addition to the above-described components.

The structures of the compounds used in the example are as follows.

U-1

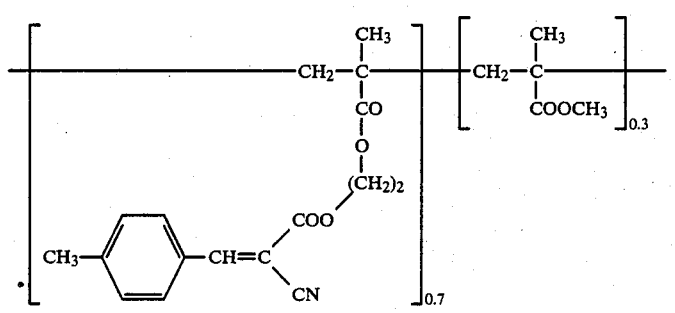

U-2

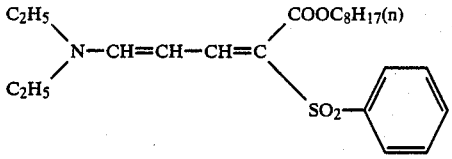

-continued
C-1
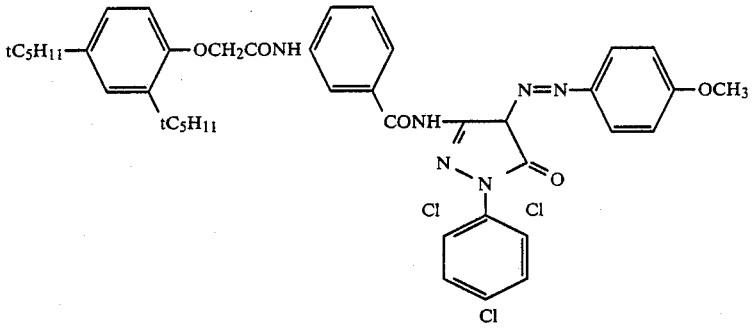
C-2
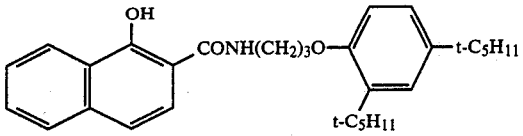
C-3
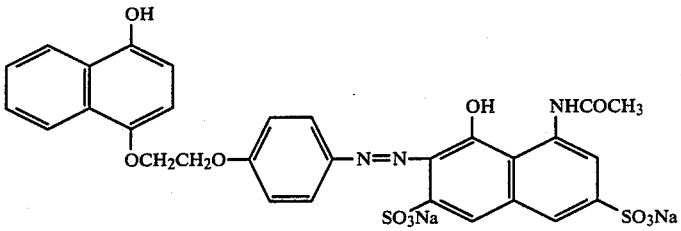
C-4
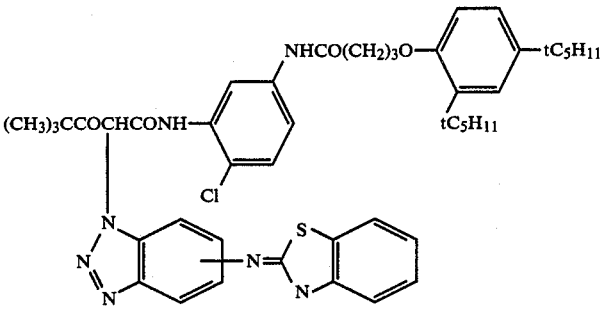
C-5
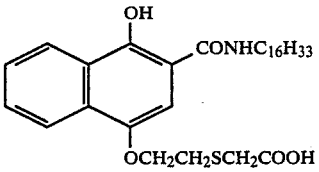
C-6
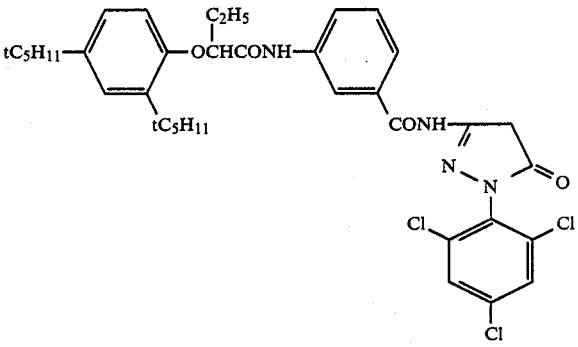

-continued
C-7
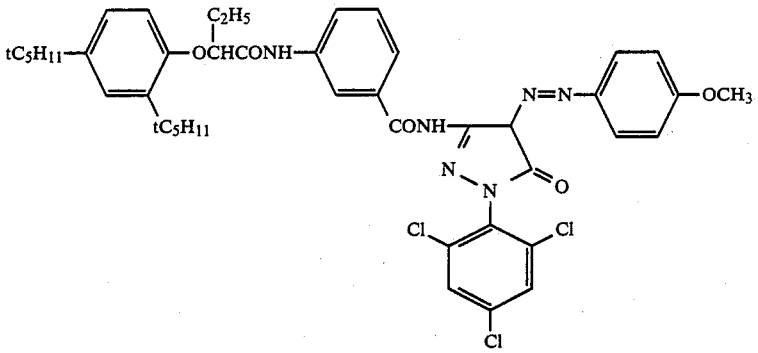
C-8
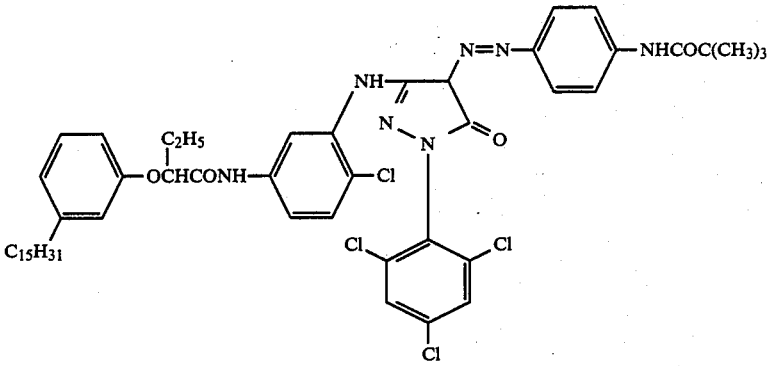
C-9
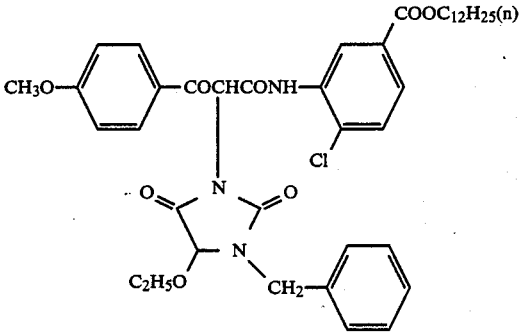
$CH_2{=}CH{-}SO_2{-}CH_2{-}CONH(CH_2)_2NHCO{-}CH_2{-}SO_2{-}CH{=}CH$ H-1
Sensitizing Dye
I
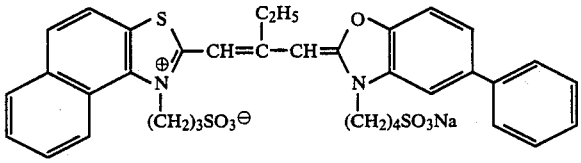
II
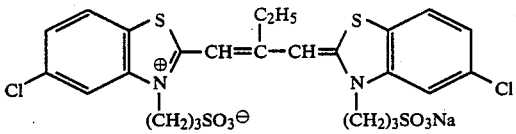

-continued

III

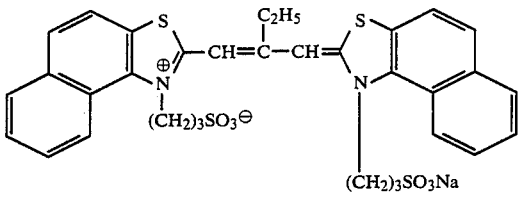

IV

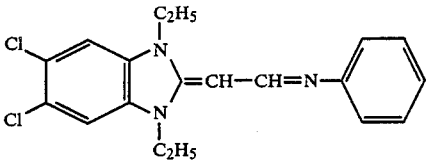

V

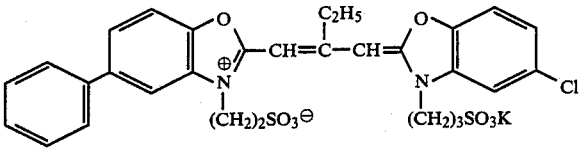

VI

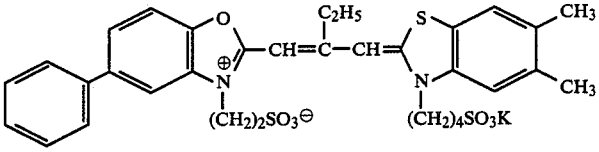

VII

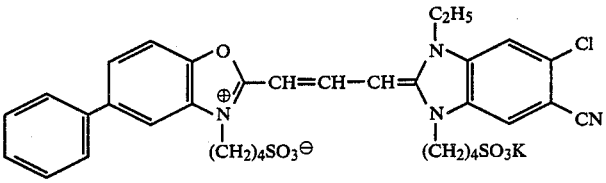

VIII

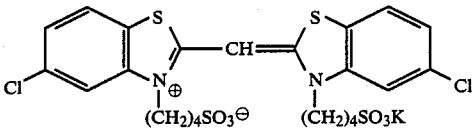

Sample 502:

By following the same procedure as the case of preparing Sample 501 except that Compound (I-4) according to this invention was used at 0.008 g/m$^2$ in place of Coupler C-4 in Layer 6 of Sample 501, Sample 502 was prepared.

Each of the samples was exposed for sensitometry and then subjected to color development processing as in Example 4. The density of the images of the samples was measured using a green filter. Also, each of the samples was exposed through a filter having stepwise changing density and then subjected to the aforesaid color development process. Thereafter, the graininess was measured using a green filter. The graininess was measured by a conventional RMS method (the root means square deviation). A measuring aperture having a diameter of 48 μwas used. The results thus obtained are shown in Table 5.

TABLE 5

| Sample | Relative Sensitivity | Gamma | RMS Value* |
|---|---|---|---|
| 501 (Comparison) | 100 | 0.71 | 0.013 |

TABLE 5-continued

| Sample | Relative Sensitivity | Gamma | RMS Value* |
|---|---|---|---|
| 502 (Invention) | 100 | 0.71 | 0.011 |

*RMS value at a density of 1.0.

From the results shown in Table 5, it can be seen that Sample 502 using the compound of this invention shows lower graininess (RMS value) than that of Sample 501 using the conventional comparison DIR coupler, although the sensitivity and gamma are the same.

EXAMPLE 6

Preparation of photosensitive silver halide emulsion:

A silver iodobromide emulsion (iodine content of 2 mole%) having the silver halide grains of 1.3 μm in mean grain size was prepared from an aqueous solution of silver nitrate and an aqueous solution of potassium bromide and potassium iodide by an ordinary ammonia method, chemically sensitized by a gold and sulfur sensitizing method using chloroauric acid and sodium thiosulfate, washed by an ordinary sedimentation method, and mixed with 4-hydroxy-6-methyl-1,3,3a,7-tetraazaindene as a stabilizer to provide a photosensitive silver iodobromide emulsion.

Preparation of Samples 601 to 627:

Each of the coating compositions prepared by adding each of the compound of formula (I) shown in Table 6 below and Comparison Compounds (b) and (c) to the photosensitive silver halide emulsion prepared as described above and an aqueous solution as a protective layer were uniformly coated, in succession, on both surfaces of a polyester base having subbing layers to provide Samples 601 to 627.

In this case, the coating amounts were the same on both surfaces, the total silver coverage on both surfaces was 8.0 g/m$^2$, the gelatin coverage for the protective layer was 2.6 g/m$^2$ and the gelatin coverage for the emulsion layer was 5.2 g/m$^2$.

Each of the samples was inserted between fluorescent intensifying screens, each containing calcium tungstenate, an aluminum square wave chart was brought into contact with it as a photographic subject, and after exposing it to X-rays to that the density became 1.0, the sample was developed by a developer having the following composition shown below for 25 seconds at 35° C., fixed, washed, and dried. The, CTF was measured by a microphotometer and the results thus obtained are shown in Table 6.

Composition of Developer:

| | |
|---|---|
| Potassium Hydroxide | 29.14 g |
| Glacial Acetic Acid | 10.96 g |
| Potassium Sulfite | 44.20 g |
| Sodium Hydrogencarbonate | 7.50 g |
| Boric Acid | 1.00 g |
| Diethylene Glycol | 28.96 g |
| Ethylenediaminetetraacetic Acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium Metahydrogensulfite | 12.60 g |
| Water to make | 1 liter |

TABLE 6

| | Compound (I) | | CTF | | |
|---|---|---|---|---|---|
| Sample | Kind | Amount of Addition (mol/mol-Ag) | 0.5 line/mm | 1 line/mm | Note |
| 601 | — | — | 0.81 | 0.62 | Control |
| 602 | I-4 | $5 \times 10^{-3}$ | 0.87 | 0.70 | Invention |
| 603 | " | $10 \times 10^{-3}$ | 0.90 | 0.77 | " |
| 604 | I-7 | $5 \times 10^{-3}$ | 0.87 | 0.71 | " |
| 605 | " | $10 \times 10^{-3}$ | 0.89 | 0.77 | " |
| 606 | I-8 | $5 \times 10^{-3}$ | 0.88 | 0.75 | " |
| 607 | " | $10 \times 10^{-3}$ | 0.89 | 0.76 | " |
| 608 | I-9 | $5 \times 10^{-3}$ | 0.90 | 0.74 | " |
| 609 | " | $10 \times 10^{-3}$ | 0.91 | 0.81 | " |
| 610 | I-14 | $5 \times 10^{-3}$ | 0.86 | 0.69 | " |
| 611 | " | $10 \times 10^{-3}$ | 0.88 | 0.74 | " |
| 612 | I-22 | $5 \times 10^{-3}$ | 0.88 | 0.72 | " |
| 613 | " | $10 \times 10^{-3}$ | 0.90 | 0.78 | " |
| 614 | I-25 | $5 \times 10^{-3}$ | 0.86 | 0.71 | " |
| 615 | " | $10 \times 10^{-3}$ | 0.88 | 0.75 | " |
| 616 | (b) | $5 \times 10^{-3}$ | 0.82 | 0.64 | Comparison |
| 617 | " | $10 \times 10^{-3}$ | 0.83 | 0.66 | " |
| 618 | (c) | $5 \times 10^{-3}$ | 0.84 | 0.67 | " |

TABLE 6-continued

| | Compound (I) | | CTF | | |
|---|---|---|---|---|---|
| Sample | Kind | Amount of Addition (mol/mol-Ag) | 0.5 line/mm | 1 line/mm | Note |
| 619 | " | $10 \times 10^{-3}$ | 0.86 | 0.70 | " |

From the results shown in Table 6 above, it can be seen that the photographic light-sensitive materials containing the compounds of formula (I) in this invention show a large CTF value and an improved sharpness as compared with the comparison samples containing no such compounds. Also, it is clear, that the effects are larger than the case of using Comparison Compounds (b) and (c) described above.

EXAMPLE 7

A light-sensitive sheet was prepared by forming, in succession, the following layers on a transparent polyester support.

(1) A layer containing 1.1 g/m$^2$ of the yellow dye-releasing redox compound having the structure shown below, 1.6 g/m$^2$ of tricyclohexyl phosphate, and 1.4 g/m$^2$ of gelatin.

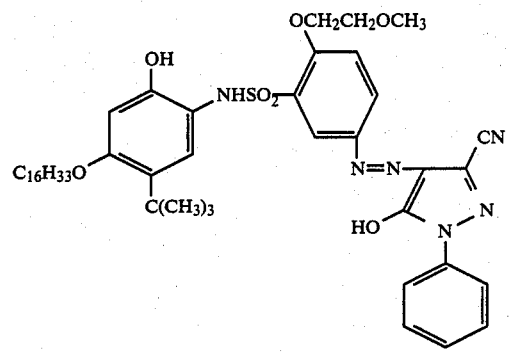

(2) A layer containing a blue-sensitive internal latent image-type direct reversal silver iodide emulsion (1.08 g/m$^2$ of silver and 1.2 g/m$^2$ of gelatin), 0.05 mg/m$^2$ of the nucleating agent having the structure described below, and 0.18 g/m$^2$ of sodium pentadecylhydroquinonesulfonate.

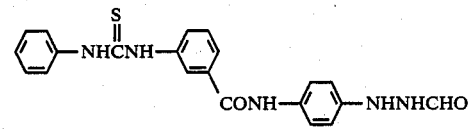

(3) A layer containing 1.0 g/m$^2$ of gelatin.

The sample containing the yellow redox compound in Layer (1) of the aforesaid sheet was defined as Sample 701 and also by following the same procedure as above using Compound I-84 or Compound I-96 in place of the yellow redox compound, Samples 702 and 703 were prepared.

Sample 702: Containing 1.1 g/m$^2$ of Compound I-84.

Sample 703: Containing 1.1 g/m$^2$ of Compound I-96.

Compound I-84

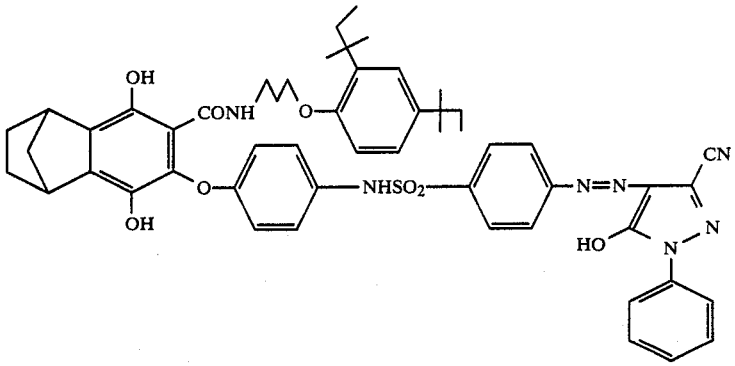

Compound I-96

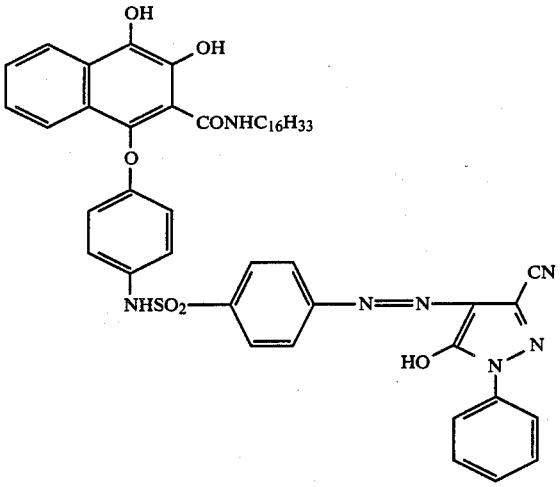

Then, a light-sensitive sheet was prepared by forming, in succession, the following layers on a transparent polyester support.

(4) A layer containing 0.93 g/m$^2$ of the magenta dye-releasing redox compound having the structure described below, 1.3 g/m$^2$ of tricyclohexyl phosphate, 2.0 g/m$^2$ of gelatin.

(5) A layer containing a green-sensitive internal latent image-type direct reversal silver bromide emulsion (1.11 g/m$^2$ of silver and 1.23 g/m$^2$ of gelatin), 0.04 mg/m$^2$ of the nucleating agent as used in layer (2), and 0.22 g/m$^2$ of 2-sulfo-5-n-pentadecylhydroquinone sodium salt.

(6) A layer containing 1.1 g/m$^2$ of gelatin.

The same containing the magenta redox compound in layer (4) of the aforesaid sheet was defined as Sample 704, and by following the same procedure as above using Compound I-83 or I-97 described below in place of the magenta redox compound, Samples 705 and 706 were prepared.

Sample 705: Containing 0.03 g/m$^2$ of Compound I-83.

Sample 706: Containing 0.93 g/m$^2$ of Compound I-97.

Compound I-83

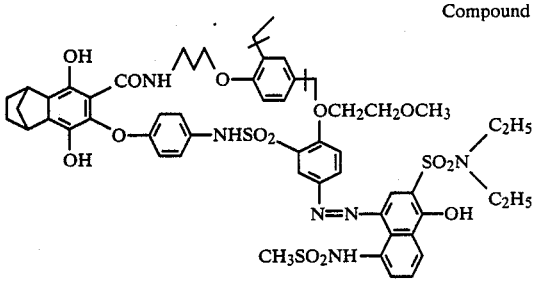

Compound I-97

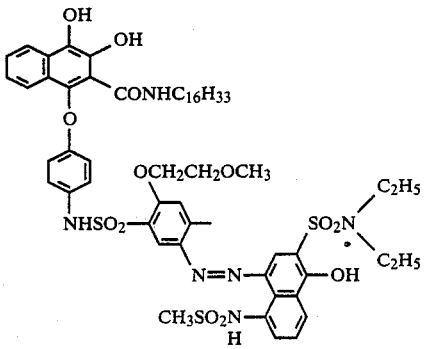

A processing liquid having the following composition was encased in a rupturable container in an amount of 0.8 g.

Composition of Processing Liquid:

| | |
|---|---|
| 1-Tolyl-4-hydroxymethyl-4-methyl-3-pyrazolioinone | 12 g |
| Methylhydroquinone | 0.4 g |
| 5-Methylbenzotriazole | 5.0 g |
| Sodium Sulfite (anhydrous) | 2.0 g |
| Hydroxyethyl Cellulose | 40 g |
| Potassium Hydroxide | 56 g |
| Benzyl Alcohol | 1.5 ml |
| Water to make | 1 kg |

Also, an image-receiving sheet was prepared by forming a mordant layer containing 3.0 g/m$^2$ of a mordant having the following structure and 3.0 g/m$^2$ of gelatin on a transparent polyester support.

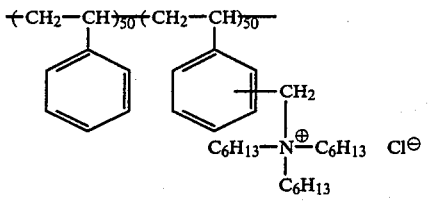

After image exposing each of Samples 701 to 706 thus prepared, the sample was combined with the aforesaid container containing the processing liquid and the aforesaid image-receiving sheet in unity, and the processing liquid was spread thereover in a thickness of 80 μm at 15° C. or 25° C. by means of pressure-applying members. After 5 minutes, the image-receiving sheet was separated to provide a transferred color image. The results are shown in Table 7.

TABLE 7

| Sample | Processing Temperature (°C.) | Maximum Transmission Density (Dmax) | Minimum Transmission Density (Dmin) | | Note |
|---|---|---|---|---|---|
| 701 | 15 | 1.64 | 0.05 | Comparison | Yellow Density |
| 702 | 15 | 1.88 | 0.06 | Invention | " |
| 703 | 15 | 1.94 | 0.07 | " | " |
| 701 | 25 | 1.82 | 0.06 | Comparison | " |
| 702 | 25 | 2.01 | 0.08 | Invention | " |
| 703 | 25 | 2.07 | 0.08 | " | " |
| 704 | 15 | 1.76 | 0.04 | Comparison | Magenta Density |
| 705 | 15 | 1.96 | 0.07 | Invention | " |
| 706 | 15 | 2:01 | 0.07 | " | " |
| 704 | 25 | 1.98 | 0.04 | Comparison | " |
| 705 | 25 | 2.06 | 0.08 | Invention | " |
| 706 | 25 | 2.11 | 0.08 | " | " |

As is clear from the results shown in Table 7, since the compounds of formula (I) for use in this invention release dyes more actively and more effectively than the conventionally known comparison compounds, the use of the compound of this invention can improve the maximum density and reduce the density change occurring by the difference in processing temperatures.

EXAMPLE 8

Preparation of Sample 801:

A multilayer color photographic light-sensitive material was prepared by forming, in succession, the following layers on a cellulose triacetate film support.

Layer 1: Antihalation Layer (AHL): A gelatin layer containing black colloidal silver.

Layer 2: Interlayer: A gelatin layer containing an emulsified dispersion of 2,5-di-t-octylhydroquinone.

Layer 3: 1st Red-sensitive Emulsion Layer ($RL_1$): A gelatin layer containing

| | |
|---|---|
| Silver Iodobromide Emulsion (silver iodide: 5 mole %) | 1.79 g/m$^2$ as Ag |
| Sensitizing Dye I | $6 \times 10^{-5}$ mole per mole of Ag |
| Sensitizing Dye II | $1.5 \times 10^{-5}$ mole per mole of Ag |
| Coupler A | 0.04 mole per mole of Ag |
| Coupler C-1 | 0.0015 mole per mole of Ag |
| Coupler C-2 | 0.0015 mole per mole of Ag |
| Compound I-8 | 0.0006 mole per mole of Ag |

Layer 4: 2nd Red-sensitive Emulsion Layer ($RL_2$): A gelatin layer containing

| | |
|---|---|
| Silver Iodobromide Emulsion (silver iodide: 4 mole %) | 1.4 g/m$^2$ as Ag |
| Sensitizing Dye I | $3 \times 10^{-5}$ mole per mole of Ag |
| Sensitizing Dye II | $1.2 \times 10^{-5}$ mole per mole of Ag |
| Coupler A | 0.005 mole per mole of Ag |
| Coupler C-1 | 0.0008 mole per mole of Ag |
| Coupler C-2 | 0.0008 mole per mole of Ag |
| Compound I-8 | 0.00006 mole per mole of Ag |

Layer 5: Interlayer (ML) Same as Layer 2.

Layer 6: 1st Green-sensitive Emulsion Layer ($GL_1$): A gelatin layer containing

| | |
|---|---|
| Silver Iodobromide Emulsion (silver iodide: 4 mole %) | 1.5 g/m$^2$ as Ag |
| Sensitizing Dye III | $3 \times 10^{-5}$ mole per mole of Ag |
| Sensitizing Dye IV | $1 \times 10^{-5}$ mole per mole of Ag |
| Coupler B | 0.05 mole per mole of Ag |
| Coupler M-1 | 0.008 mole per mole of Ag |
| Compound I-8 | 0.0015 mole per mole of Ag |

Layer 7: 2nd Green-sensitive Emulsion Layer ($GL_2$): A gelatin layer containing

| | |
|---|---|
| Silver Iodobromide Emulsion (silver iodide: 5 mole %) | 1.6 g/m$^2$ as Ag |

-continued

| | |
|---|---|
| Sensitizing Dye III | $2.5 \times 10^{-5}$ mole per mole of Ag |
| Sensitizing Dye IV | $0.8 \times 10^{-5}$ mole per mole of Ag |
| Coupler B | 0.02 mole per mole of Ag |
| Coupler M-1 | 0.003 mole per mole of Ag |
| Compound I-8 | 0.0003 mole per mole of Ag |

Layer 8: Yellow Filter Layer (YEL): A gelatin layer containing yellow colloid silver and an emulsified dispersion of 2,5-di-t-octylhydroquinone.

Layer 9: 1st Blue-sensitive Emulsion Layer ($BL_1$): A gelatin layer containing

| | |
|---|---|
| Silver Iodobromide Emulsion (silver iodide: 6 mole %) | 1.5 g/m$^2$ as Ag |
| Coupler Y-1 | 0.25 mole per mole of Ag |

Layer 10: 2nd Blue-sensitive Emulsion Layer ($BL_2$): A gelatin layer containing

| | |
|---|---|
| Silver Iodobromide Emulsion (silver iodide: 6 mole %) | 1.1 g/m$^2$ as Ag |
| Coupler Y-1 | 0.06 mole per mole of Ag |

Layer 11: Protective Layer (PL): A gelatin layer containing polymethyl methacrylate particles (mean diameter of about 1.5 μm).

Each of the aforesaid layers contained a gelatin hardening agent and a surface active agent.

The sample thus prepared was defined as Sample 801.

Sample 802: This sample was prepared in the same manner as the case of preparing Sample 801, except that an equimolar amount of Compound I-9 described above was used in place of Compound I-8.

Sample 803: This sample was prepared in the same manner as above, except that an equimolar amount of Comparison Compound (b) shown above was used in place in Compound I-8.

Sample 804: This sample was prepared in the same manner as above, except that Comparison Compound (f) described below was used in place of Compound I-8.

The compounds used for preparing the samples in this examples are as follows.

Sensitizing Dye I: Anhydro-5,5'-dichloro-3,3'-di-(γ-sulfopropyl)-9-ethyl-thiacarbocyanine hydroxide pyridium salt.

Sensitizing Dye II: Anhydro-9-ethyl-3,3'-di-(γ-sulfopropyl)-4,5,4',5'-dibenzothiacarbocyanine hydroxide triethylamine salt.

Sensitizing Dye III: Anhydro-9-ethyl-5,5'-dichloro-3,3'-di(γ-suflopropyl)oxacarbocyanine sodium salt.

Sensitizing Dye IV: Anhydro-5,6,5',6'-tetrachloro-1,1'-diethyl-3,3'-di-{β-[β-(γ-sulfopropoxy)ethoxy]ethylimidazolo}carbocyanine hydroxide sodium salt.

Coupler A

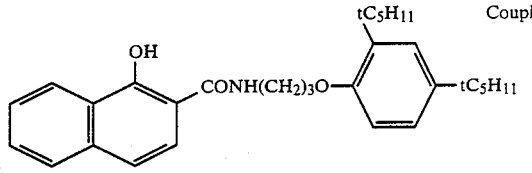

Coupler B

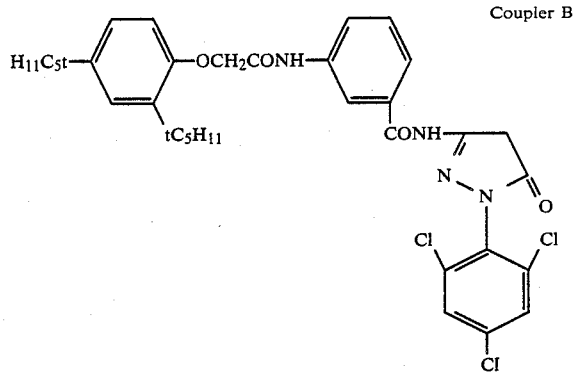

Coupler C-1

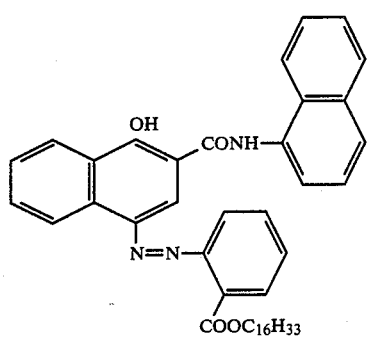

Coupler C-2

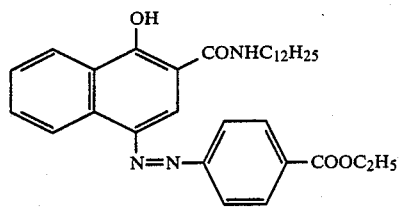

Coupler M-1

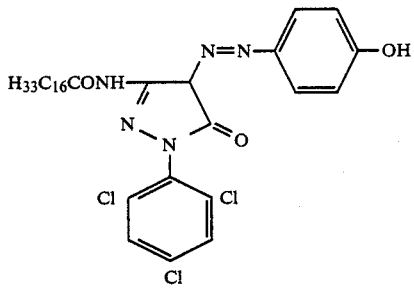

-continued

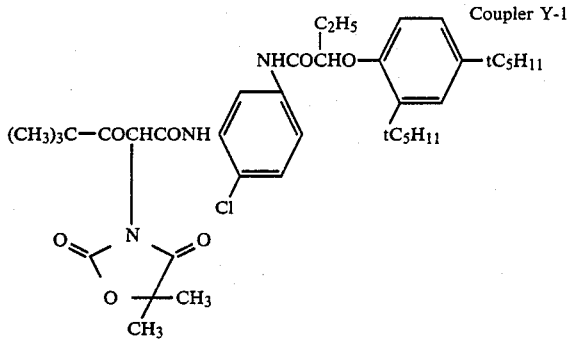

Each of Samples 801 to 804 thus prepared was cut into 35 mm widths, wedge-exposed, and subjected to the following development process in 600 meters length using a two liter developer tank.

| | |
|---|---|
| 1. Color development | 3 min. 15 sec. |
| 2. Bleach | 6 min. 30 sec. |
| 3. Wash | 3 min. 15 sec. |
| 4. Fix | 6 min. 30 sec. |
| 5. Wash | 3 min. 15 sec. |
| 6. Stabilization | 3 min. 15 sec. |

The compositions of processing solutions used for the above steps were as follows.

Color developer

| | |
|---|---|
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |

Bleach solution

| | |
|---|---|
| Ammonium bromide | 160.0 g |
| Aqueous ammonia (28%) | 25.0 ml |
| Ethylenediamine-tetraacetic acid sodium iron salt | 130 g |
| Glacial acetic acid | 14 ml |
| Water to make | 1 liter |

Fix solution

| | |
|---|---|
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1 liter |

Stabilization solution

| | |
|---|---|
| Formalin | 8.0 ml |
| Water to make | 1 liter |

Furthermore, the overflowed developer was regenerated in the following manner and reused repeatedly.

The regeneration was performed by a batch system. Overflowed developer was placed in an electrodialysis bath, and electrodialysis was performed until the content of KBr became less than 0.7 g/liter.

To the solution were supplemented sodium nitrilotriacetic acid, sodium sulfite, sodium carbonate, potassium bromide, hydroxylamine sulfate, and 4-(N-ethyl-N-β-hydroxyethylamino)-2-methylaniline sulfate which were consumed in the running processing and after adjusting the pH thereof to 10.05, the solution was reused as the supplement for the developer.

One liter of the overflowed developer was referred to one time of reuse, and the reduction in sensitivity when the developer was reused 10 times (i.e., after reuse of 10 times × 1 liter overflowed developer) is shown in Table 8 below.

TABLE 8

| | | ΔS fog + 0.3 | | |
|---|---|---|---|---|
| Sample No. | Compound | Blue | Green | Red |
| 801 | I-8 | +0.02 | ±0 | ±0 |
| 802 | I-9 | +0.03 | ±0 | ±0 |
| 803 | (b) | −0.21 | −0.13 | −0.06 |
| 804 | (f) | −0.16 | −0.07 | ±0 |

Samples 801 and 802 are samples of this invention and Samples 803 and 804 are comparison samples.

In Table 8, the reduction in sensitivity at the density of fog + 0.3 is shown by log E.

Comparison Compound (f)

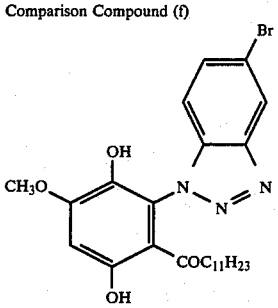

From the results shown in Table 8, it can be seen that Samples 801 and 802 show almost no reduction in sensitivity while Samples 803 and 804 show great reduction in sensitivity. These results show that when the released groups of Compounds I-8 and I-9 flowed in the color developer, they are decomposed into compounds having no photographic influence, and are not accumulated in the developer different from the case of other non-decomposition type releasable groups. Therefore, in the case of using the compound of formula (I), the developer can be reused repeatedly.

EXAMPLE 9

A silver halide emulsion containing 80 mole% silver chloride, 19.5 mole% silver bromide, and 0.5 mole% silver iodide was gold-sensitized and sulfur-sensitized by ordinary methods. Also, the content of gelatin contained in the emulsion was 45% by weight to the silver halides. After adding 5-[3-(8-sulfobutyl)-5-chloro-2-oxazolidylideneethylidene]-1-hydroxyethoxyethyl-3-(2-pyridyl)-2-thiohydantoin potassium salt (sensitizing dye), sodium dodecylbenzenesulfonate (surface active agent), and the polymer latex described in the production formula 3 of U.S. Pat. No. 3,525,620 to the silver halide emulsion, 1,2-bis(vinylsulfonylacetamido)ethane (hardening agent) was added thereto at 2.6 wt% per total dry gelatin (i.e., per total dry gelatin including gelatin in the upper light insensitive layer described below) and further the compound of formula (I) shown in Table 9 below was added thereto as a methanol solution thereof to provide a coating composition for a light-sensitive silver halide emulsion layer.

On the other hand, sodium dodecylbenzenesulfonate (surface active agent) and a polymethyl methacrylate latex having a mean particle size of 3.0 to 4.0 μm (matting agent) were added to an aqueous 5% gelatin solution to provide a coating composition for an upper light-insensitive layer.

The aforesaid coating composition for light-sensitive silver halide emulsion layer and the coating composition for upper light-insensitive layer were simultaneously coated on a polyethylene terephthalate support.

In addition, the silver coverage was 3.0 g/m$^2$ and the dry thickness of the upper light-insensitive layer was 1.0 μm.

Thus, Samples 901 to 904 were prepared. Each of the samples was exposed through a step wedge having a step difference of 0.1 to white tungsten light for 8 seconds.

Dot images were formed using these samples by the following method. A commercially available negative gray contact screen (150 lines/inch) was closely placed on each sample and the sample was exposed through a step wedge of 0.1 in step difference to white tungsten light for 10 seconds. Each sample was then developed using a developer having the following composition for 20 seconds at 38° C., and then fixed, washed and dried by conventional procedures.

Developer composition:

| | |
|---|---|
| Sodium sulfite | 75 g |
| Sodium hydrogencarbonate | 7 g |
| Hydroquinone | 40 g |
| 1-Phenyl-4,4-dimethyl-3-pyrazolidone | 0.4 g |
| Sodium bromide | 3 g |
| 5-Methylbenzotriazole | 0.8 g |
| Ethylenediaminetetraacetic acid di-sodium salt | 1 g |
| 3-Diethylamino-1,2-propanediol | 20 g |
| Water to make | 1 liter |
| pH adjusted to | 11.4 |

The relative sensitivity, gamma (γ), and dot quality were evaluated on each sample thus processed and the results obtained are shown in Table 9 below.

The relative sensitivity is a relative value of the reciprocal of the light exposure amount giving a density of 1.5, wherein that of Sample 901 was defined as 100.

The dot quality was visually evaluated in four ranks. In the evaluation, rank "A" shows the best quality, "B" a practically usable quality, "C" a quality under a practically usable level, and "D" the worst quality.

TABLE 9

| Sample No. | Compound No. | Amount (per mole or Ag) | Relative Sensitivity | Gamma (γ) | Dot Quality |
|---|---|---|---|---|---|
| 901 | none | — | 100 | 5 | D |
| 902 | I-51 | $5.5 \times 10^{-4}$ mole | 230 | 14 | A |
| 903 | I-59 | " | 240 | 16 | A |
| 904 | I-62 | " | 180 | 13 | B |

As is clear from the results shown in Table 9, the samples using the compound of formula (I) according to this invention show very high sensitivity and contrast and also shows very good dot quality.

EXAMPLE 10

A silver halide emulsion containing 80 mole% silver chloride, 19.5 mole% silver bromide, and 0.5 mole% silver iodide was gold-sensitized and sulfur-sensitized by ordinary methods. The content of gelatin of the emulsion was 45% by weight to the silver halide. After adding thereto 3-carboxymethyl-5-[2-(3-ethylthiazolinidene)ethylidene]rhodanine (spectral sensitizer), 4-hydroxy-1,3,3a,7-tetraazaindene (stabilizer), polyoxyethyleneonyl phenyl ether containing 50 ethylene oxide groups, and the polymer latex described in production formula 3 of U.S. Pat. No. 3,525,620, 1,2-bis(vinylsulfonylacetamido)ethane (hardening agent) was added thereto so that it became 2.6 wt% per total dry gelatin (that is, per total dry gelatin including gelatin in the upper light-insensitive layer described below) and the compound of formula (I) for use in this invention as shown in Table 10 as a methanol solution thereof to provide a coating composition for a light-sensitive silver halide emulsion layer.

On the other hand, sodium dodecylbenzenesulfonate (surface active agent) and a polymethyl methacrylate latex having a mean particle size of 3.0 to 4.0 μm (matting agent) were added to an aqueous 5% gelatin solution to provide a coating composition for a light-insensitive upper layer.

Then, the aforesaid coating composition for silver halide emulsion layer and the coating composition for light-insensitive upper layer were simultaneously coated on a polyester terephthalate support by a simultaneous double layer coating method. In addition, the silver coverage was 3.0 g/m$^2$ and the dry thickness of the light-insensitive upper layer was 1.0 μm. Thus, Samples 1001 to 1008 were prepared.

Using each of the samples thus prepared, dot images were formed in the following manner. That is, the sample was brought into close contact with a commercially available negative gray contact screen (150 lines/inch), after exposing the sample through a step wedge having a step difference of 0.1 to white tungsten light for 10 seconds each sample was developed for 100 seconds at 27° C. using a developer having the following composition, and then fixed, washed and dried in an ordinary manner.

Composition of Developer:

| | |
|---|---|
| Sodium carbonate (mono-hydrate) | 50 g |
| Formaldehyde-hydrogen sulfite addition product | 45 g |
| Potassium bromide | 2 g |
| Hydroquinone | 18 g |
| Sodium sulfite | 2 g |
| 5-Nitroindazole | 3 mg |
| Water to make | 1 liter |

In addition, the comparison compounds used in Table 10 below are as follows.

[Comparison Compound a]

1-Phenyl-5-mercaptotetrazole

[Comparison Compound b]

5-Methylbenzotriazole

[Comparison Compound c]

2-Methylthio-5-mercapto-1,3,4-thiadiazole

The results of evaluating the dot quality and dot gradation obtained are shown in Table 10. The evaluation shown in Table 10 are same as defined in Table 8. Also, the dot gradation is a difference between the logarithmic values of the exposure amounts giving 5% and 95% of the blackened area of the dot, wherein the larger difference shows a softer dot gradation.

TABLE 10

| Sample No. | Compound of Formula (I) Kind | Amount of Addition (mol/mol-Ag) | Dot Quality | Dot Gradation |
|---|---|---|---|---|
| 1001 | — | — | B | 1.13 |
| 1002 | I-4 | $2.6 \times 10^{-4}$ | A | 1.23 |
| 1003 | I-12 | " | A | 1.26 |
| 1004 | I-22 | " | A | 1.24 |
| 1005 | Comparison Compound (a) | $6.5 \times 10^{-5}$ | C | 1.16 |
| 1006 | Comparison Compound (a) | $1.3 \times 10^{-4}$ | D | 1.30 |
| 1007 | Comparison Compound (b) | $6.5 \times 10^{-5}$ | C | 1.15 |
| 1008 | Comparison Compound (b) | $1.3 \times 10^{-4}$ | D | 1.24 |
| 1009 | Comparison Compound (c) | $6.5 \times 10^{-5}$ | C | 1.15 |
| 1010 | Comparison Compound (c) | $1.3 \times 10^{-4}$ | D | 1.23 |

From the results shown in Table 10 above, it can be seen that the compounds of formula (I) used in this invention are very effective for softening the dot gradation without reducing the dot quality. That is, when the dot gradation was softened by using each of Comparison Compounds (a), (b), and (c) to a degree of more than 0.1 as compared with the case of no addition of such a compound, the rank of the dot quality became "D", but in the case of using the compounds of this invention, the dot gradation was softened to a degree as high as 0.1 to 0.2 as compared with the case of no addition of such a compound, and yet the dot quality was ranked as "A".

EXAMPLE 11

Each of Samples 1001, 1002, and 1003 in Example 10 was exposed and processed as in Example 10. In this case, however, the development was performed in three manners of 90 seconds, 100 seconds, and 110 seconds at 27° C. The dot quality was evaluated in five ranks, and the results obtained are shown in Table 11. In Table 11, rank 5 indicates the best quality, 1 the worst, and 5 to 3.5 indicate the practically useful range. The results thus obtained are shown in Table 11 below.

TABLE 11

| Sample No. | Compound | Development Time/Dot % Dot % | 90 Sec. | 100 Sec. | 110 Sec. |
|---|---|---|---|---|---|
| 1001 | | 5 | 3.5 | 4.0 | 4.5 |
| | | 95 | 4.5 | 4.0 | 3.5 |
| 1002 | I-4 | 5 | 4.0 | 4.5 | 4.5 |
| | | 95 | 4.5 | 4.5 | 4.0 |
| 1003 | I-12 | 5 | 4.0 | 4.5 | 4.5 |
| | | 95 | 4.5 | 4.5 | 4.0 |

From the results shown in Table 11, it can be seen that the dot qualities of the samples of this invention are good in dots of 5% and 95% as compared with the case of adding no such compound and the dot qualities are better in shorter development time or longer development time than a standard development time (100 seconds), which shows a wider development latitude by the use of the compounds of this invention.

EXAMPLE 12

Each of Samples 1001, 1002, and 1003 in Example 10 was disposed on an original (A) having a white line of 50 μm in thickness with black background or an original (B) having a black line of 50 μm in thickness with white background, and, after exposing the sample for 10 seconds to white tungsten lamp using a printing plate making camera, each sample was developed as in Example 10. The results thus obtained are shown in Table 12.

TABLE 12

| Sample No. | Compound | Developed Black Line Width (μm) in the case of Using Original (A) | Developed White Line Width (μm) in the case of Using Original (B) |
|---|---|---|---|
| 1001 | — | 75 μm | 30 μm |
| 1002 | I-4 | 70 μm | 36 μm |
| 1003 | I-12 | 65 μm | 40 μm |

From the results shown in Table 12, it can be seen that the good line width reproducibility of fine line is obtained by using the compounds of formula (I) for use in this invention. Also, from the results thereof, the use of the compound of this invention gives a wide exposure latitude in the case of using an original having Ming style types and Gothic types.

EXAMPLE 13

To a silver halide emulsion containing 95 mole% silver chloride, 5 mole% silver bromide, and $1 \times 10^{-4}$ mole of rhodium per mole of silver were added 2-hydroxy-4,6-dichloro-1,3,5-triazine sodium salt as a hardening agent and $1 \times 10^{-4}$ mole/mole of silver of polyoxyethylene nonylphenyl ether containing 30 ethylene oxide groups, and after further adding thereto the compound of general formula (I) for use in this invention as shown in Table 13 as the methanol solution thereof, the resulting mixture was coated on a polyethylene terephthalate film at a silver coverage of 4.5 g/m$^2$.

Each of the samples thus prepared was exposed on a printer P-607, made by Dainippon Screen Mfg. Co., Ltd. using the original composed of as FIG. 1 described in U.S. Pat. No. 4,542,882, developed for 20 seconds at 38° C. using the developer having the following composition, and then fixed, washed, and dried in an ordinary manner.

Developer Composition:

| | |
|---|---|
| Potassium bromide | 2.0 g |
| Potassium hydroxide | 20 g |
| Potassium carbonate | 35 g |
| Potassium sulfite | 80 g |
| Hydroquinone | 20 g |
| Triethylene glycol | 30 g |
| Polyethylene glycol (molecular weight: 4,000) | 2.0 g |
| 5-Nitroindazole | 0.1 g |
| Water to make | 1 liter (pH 11.7) |

The results thus obtained are shown in Table 13 below.

TABLE 13

| Sample No. | Compound of General Formula (I) Structure | Amount | White-on-Black Headline Image Quality |
|---|---|---|---|
| 1301 | — | — | 2 |
| 1302 | I-3 | $1.3 \times 10^{-4}$ mole/mole-Ag | 4 |
| 1303 | I-12 | " | 5 |

The white-on-black headline quality "5" in Table 13 is the quality that when an aptitude exposure is applied using the original as shown in FIG. 1 of U.S. Pat. No.

4,452,882 so that the dot area of 50% is duplicated on the contact work light-sensitive material as a dot area of 50%, a letter of 30 μm in width is reproduced and the quality is very good white-on-black headline quality. On the other hand, the quality "1" is an image quality such that when the same aptitude exposure as above is applied, letters of more than 150 μm in width only can be reproduced, and has a bad white-on-black headline quality. Between ranks "5" and rank "1", ranks "4" to "2" are provided by panel evaluation. The ranks "2" to "5" are practically usable level.

As is clear from the results shown in Table 13, the samples using the compounds of formula (1) for use in this invention show good white-on-black headline qualities.

EXAMPLE 14

For comparison, the following experiment was performed in order to compare the compound of formula (I) according to this invention and a comparison compound with respect to the speed and efficiency of releasing a photographically useful group from the oxidation product thereof. Experimental Procedure: With respect to each of Samples (a) to (f) shown below, 100 ml of an acetonitrile solution of $2\times10^{-3}$ mole/liter thereof was prepared. Then, 4 ml of the solution thus prepared was added to a mixture of 20 ml of Britton-Robinson buffer and 16 ml of methanol to perform reaction in a short period of time. Then, the concentration of phenol released was measured successively by high-speed liquid chromatography and the reaction rate was determined using a calibration line separately prepared.

Under the experimental condition, the initial reaction can be considered as almost pseudo first order reaction, and a pseudo first order reaction rate constant R' and a half-life t were calculated. The results thus obtained are shown in Table 14.

TABLE 14

Sample (a)

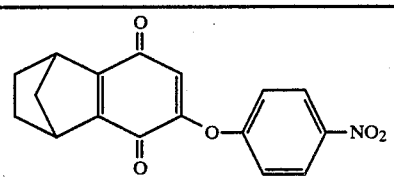

Sample (b)

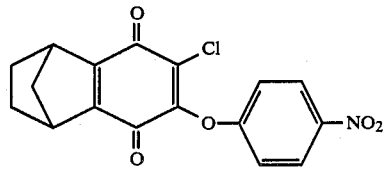

Sample (c)

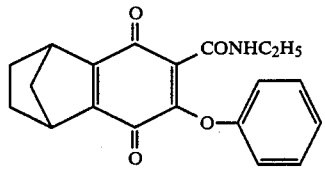

Sample (d)

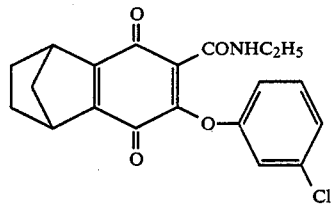

Sample (e)

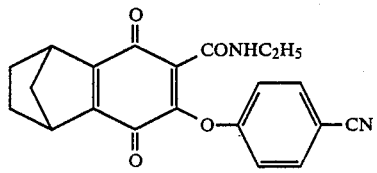

Sample (f)

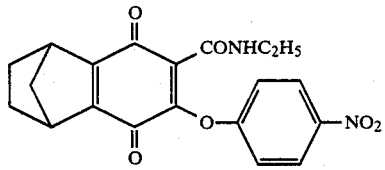

| | pKa of Released Phenol | Pseudo First Order Reaction Constant R' ($Sec^{-1}$) at pH 10 | Half-Life t at pH 10 | Releasing Efficiency(*) |
|---|---|---|---|---|
| Sample (a) | 7.15 | $2.32\times10^{-4}$ | 3110 Sec. | 36% |

TABLE 14-continued

| | | | | |
|---|---|---|---|---|
| Comparison Example 1 | | | | |
| Sample (b) | 7.15 | $9.59 \times 10^{-4}$ | 723 Sec. | 42% |
| Comparison Example 2 | | | | |
| Sample (c) (Invention) | 9.99 | $2.24 \times 10^{-1}$(**) | 3.1 Sec. | 100% |
| Sample (d) (Invention) | 9.02 | $2.89 \times 10^{-1}$(**) | 2.4 Sec. | 100% |
| Sample (e) (Invention) | 7.95 | $7.7 \times 10^{-1}$(**) | 0.9 Sec. | 100% |
| Sample (f) (Invention) | 7.15 | $8.7 \times 10^{-1}$(**) | 0.8 Sec. | 100% |

Notes:

(*)The releasing efficiency is the ratio of the amount of phenol released in infinite reaction time to the amount of sample used for the reaction, expressed as a % value.

(**)Since k' was very large, the value at pH 10 was evaluated from the value measured at pH 8 by extrapolation.

As is clear from the results shown in Table 14, it can be seen that in the compounds of formula (I) for use in this invention, the releasing speed from the oxidation products thereof is $10^2$ to $10^3$ times higher than the conventional comparison compounds, and furthermore the releasing efficiency is greatly improved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one silver halide emulsion layer formed thereon, in which said emulsion layer or other layer contains a compound represented by formula (I)

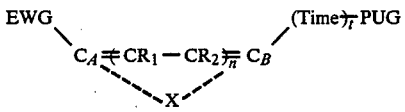

(I)

wherein X represents an atomic group capable of releasing (Time)$_t$PUG by undergoing an oxidation-reduction reaction with CA=CR$_1$—CR$_2$)$_n$C$_B$; $C_A$ and $C_B$ each represents a carbon atom; n represents an integer of 0, 1, 2, or 3; $R_1$ and $R_2$ each a hydrogen atom or a group substitutable for a hydrogen atom; EWG represents an electron withdrawing group having a Hammett's $\sigma$ para value greater than 0.3; (Time)$_t$PUG represents a group bonded to $C_B$ through an oxygen atom thereof; Time represents a timing group; t represents 0 or 1; and PUG represents a photographically useful group.

2. A silver halide photographic material as in claim 1, wherein X, including showing the bonding to the $C_A$=CR$_1$—CR$_2$)$_n$C$_B$ group, is selected from the groups

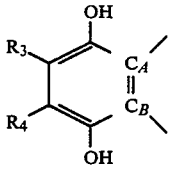

(a)

-continued

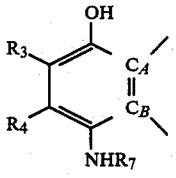

(b)

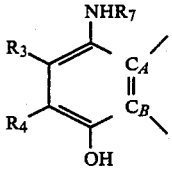

(c)

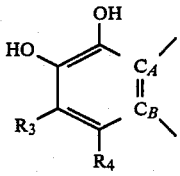

(d)

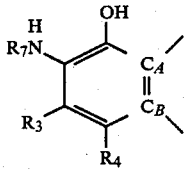

(e)

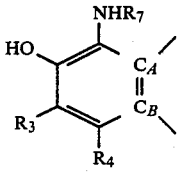

(f)

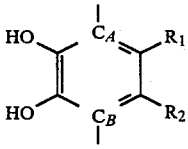

(h)

-continued (j)

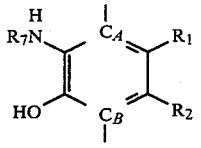

(k)

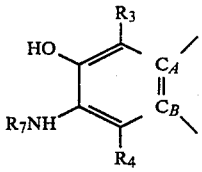

(m)

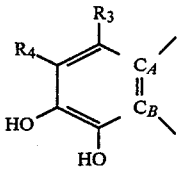

(n)

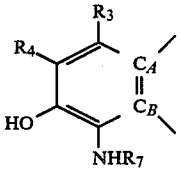

(o)

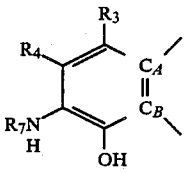

(p)

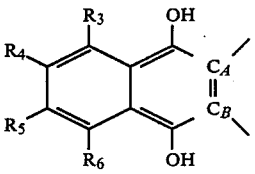

(q)

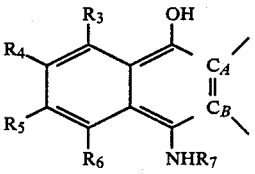

(r)

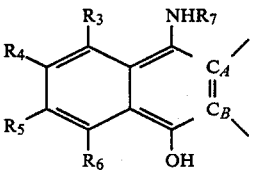

(s)

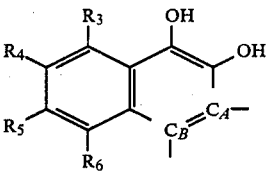

-continued (t)

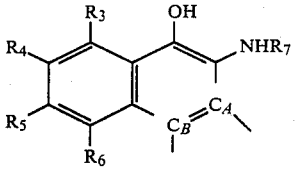

(u)

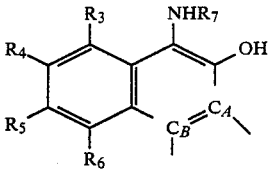

(w)

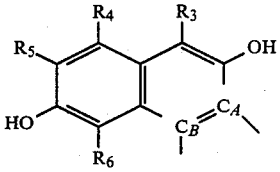

wherein $R_1$, $R_2$, $R_3$, $R_4$, $R_5$, and $R_6$ each represents a hydrogen atom, a substituted or unsubstituted alkyl group having from 1 to 30 carbon atoms, a substituted or unsubstituted aromatic group having from 6 to 30 carbon atoms, a substituted or unsubstituted alkylthio group having from 1 to 30 carbon atoms, a substituted or unsubstituted arylthio group having from 6 to 30 carbon atoms, a substituted or unsubstituted alkoxy group having from 1 to 30 carbon atoms, a substituted or unsubstituted aryloxy group having from 6 to 30 carbon atoms, a substituted or unsubstituted amino group having from 1 to 30 carbon atoms, a substituted or unsubstituted amido group having from 1 to 30 carbon atoms, a substituted or unsubstituted sulfonamido group having from 1 to 30 carbon atoms, a substituted or unsubstituted alkoxycarbonylamino group having from 1 to 30 carbon atoms, a substituted or unsubstituted ureido group having from 1 to 30 carbon atoms, a substituted or unsubstituted carbamoyl group having from 1 to 30 carbon atoms, a substituted or unsubstituted alkoxycarbonyl group having from 1 to 30 carbon atoms, a substituted or unsubstituted sulfamoyl group having from 1 to 30 carbon atoms, a substituted or unsubstituted sulfonyl group having from 1 to 30 carbon atoms, a cyano group, a haogen atom, a substituted or unsubstituted acyl group having from 1 to 30 carbon atoms, a carboxy group, a sulfo group, a nitro group, a heterocyclic ring residue having at most 30 carbon atoms, a sulfur residue bonded to a heterocyclic ring having at most 30 carbon atoms; cr $R_1$ and $R_2$, $R_3$ and $R_4$, $R_4$ and $R_5$, or $R_5$ and $R_6$ combine with each other to form a saturated or unsaturated carbocyclic ring or a saturated or unsaturated heterocyclic ring; and $R_7$ represents a substituted or unsubstituted sulfonyl group having from 1 to 30 carbon atoms, or a substituted or unsubstituted acyl group having from 1 to 30 carbon atoms.

3. A silver halide photographic material as in claim 2, wherein X, including showing the bonding to the $C_A$=CR$_1$—CR$_2$=$_n$C$_B$ group, is selected from a group consisting of (a)

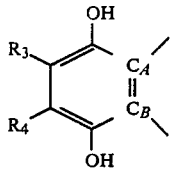

(b)

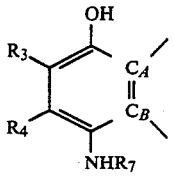

(c)

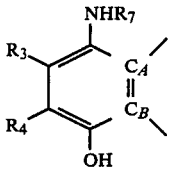

(d)

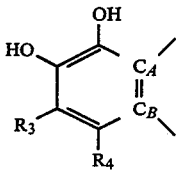

(e)

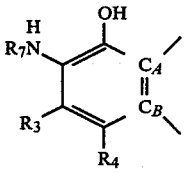

(f)

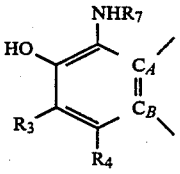

(p)

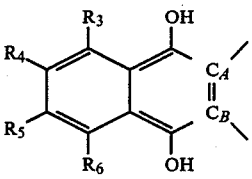

(q)

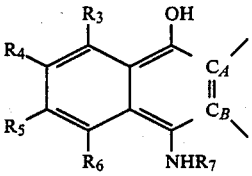

(r)

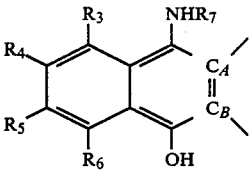

-continued (s)

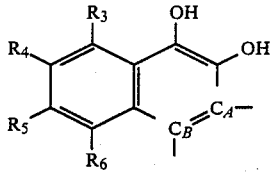

(t)

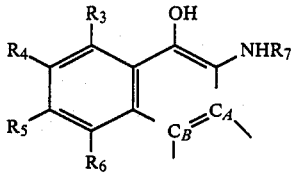

(u)

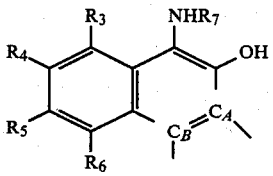

wherein $R_3$, $R_4$, $R_5$, $R_6$, and $R_7$ are the same as defined in claim 2.

4. A silver halide photographic material as in claim 2, wherein X, including showing the bonding to the $C_A{=}(CR_1{-}CR_2)_n{-}C_B$ group, is selected from a group consisting of (a)

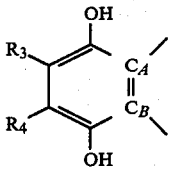

(d)

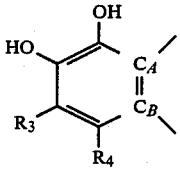

(s)

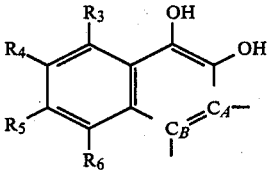

wherein $R_3$, $R_4$, $R_5$, and $R_6$, are the same as defined in claim 2.

5. A silver halide photographic material as in claim 2, wherein $R_7$ represents a sulfonyl group.

6. A silver halide photographic material as in claim 3, wherein $R_7$ represents a sulfonyl group.

7. A silver halide photographic material as in claim 1, wherein the compound of formula (I) is present in an amount of from $1\times10^{-7}$ mole to $1\times10^{3}$ mole per mole of silver halide.

8. A silver halide photographic material as in claim 2, wherein the compound of formula (I) is present in an amount of from $1\times10^{-7}$ mole to $1\times10^{3}$ mole per mole of silver halide.

9. A silver halide photographic material as in claim 3, wherein the compound of formula (I) is present in an amount of from $1\times10^{-7}$ mole to $1\times10^{3}$ mole per mole of silver halide.

10. A silver halide photographic material as in claim 4, wherein the compound of formula (I) is present in an amount of from $1\times10^{-7}$ mole to $1\times10^{3}$ mole per mole of silver halide.

11. A silver halide photographic material as in claim 5, wherein the compound of formula (I) is present in an amount of from $1\times10^{-7}$ mole to $1\times10^{3}$ mole per mole of silver halide.

12. A silver halide photographic material as in claim 6, wherein the compound of formula (I) is present in an amount of from $1\times10^{-7}$ mole to $1\times10^{3}$ mole per mole of silver halide.

* * * * *